US008382168B2

(12) United States Patent
Carabalona et al.

(10) Patent No.: US 8,382,168 B2
(45) Date of Patent: Feb. 26, 2013

(54) MAGNETIC LATCH MECHANISM

(75) Inventors: Eric Carabalona, Kenilworth (GB); Kevin A. McCloskey, Hatboro, PA (US); Robert B. Speers, Jr., West Chester, PA (US); Robin Talukdar, Chittenango, NY (US)

(73) Assignee: Southco, Inc., Concordville, PA (US)

( * ) Notice: Subject to any disclaimer, the term of this patent is extended or adjusted under 35 U.S.C. 154(b) by 1059 days.

(21) Appl. No.: 11/969,914

(22) Filed: Jan. 6, 2008

(65) Prior Publication Data

US 2008/0191494 A1 Aug. 14, 2008

Related U.S. Application Data

(60) Provisional application No. 60/879,346, filed on Jan. 6, 2007.

(51) Int. Cl.
*E05C 17/56* (2006.01)
*E05C 19/16* (2006.01)

(52) U.S. Cl. ..... 292/251.5; 292/44; 292/51; 292/216

(58) Field of Classification Search ..... 292/44–55, 292/216, 251.5, DIG. 21, DIG. 71
See application file for complete search history.

(56) References Cited

U.S. PATENT DOCUMENTS

| | | | | |
|---|---|---|---|---|
| 1,320,444 | A | 11/1919 | Buczynski et al. | |
| 2,219,186 | A | 10/1940 | Hornfeck | |
| 2,288,688 | A * | 7/1942 | Dubilier | 292/144 |
| 2,446,336 | A * | 8/1948 | Mark et al. | 49/395 |
| 2,565,891 | A * | 8/1951 | Sherman | 292/251.5 |
| 2,586,900 | A | 2/1952 | Alderman | |
| 2,797,655 | A * | 7/1957 | Morehouse | 109/63.5 |
| 3,184,654 | A * | 5/1965 | Bey | 335/295 |
| 3,288,511 | A * | 11/1966 | Tavano | 292/251.5 |
| 3,516,701 | A | 6/1970 | Graham | |
| 3,596,958 | A * | 8/1971 | Bowerman | 292/201 |
| 3,860,277 | A | 1/1975 | Wang | |
| 4,958,508 | A | 9/1990 | Lin | |
| 5,305,623 | A | 4/1994 | Kello | |
| 5,389,920 | A | 2/1995 | DeLand et al. | |
| 5,549,337 | A * | 8/1996 | McCulloch | 292/225 |
| 5,915,766 | A | 6/1999 | Baumeister et al. | |
| 6,279,972 | B1 * | 8/2001 | Brill et al. | 292/216 |
| 6,705,140 | B1 | 3/2004 | Dimig et al. | |
| 6,843,085 | B2 | 1/2005 | Dimig | |

(Continued)

FOREIGN PATENT DOCUMENTS

| | | | |
|---|---|---|---|
| DE | 2455520 | * | 5/1976 |
| DE | 3333746 | A1 | 6/1985 |

(Continued)

OTHER PUBLICATIONS

Tech-Train Bulletin—Steven E. Young, Issue #16, 2002, 3 pages.

(Continued)

*Primary Examiner* — Carlos Lugo
(74) *Attorney, Agent, or Firm* — Paul & Paul

(57) ABSTRACT

A latch with dual rotary magnets is disclosed. The latch is particularly suited for releasably securing dual doors of a compartment in the closed position. Each rotary magnet helps secure in a closed position a respective door that is provided with a magnetic insert. Hook-like rotary pawls that rotate with the magnets provide for mechanical securing of the doors in the closed position. The latch is provided with a safety feature that makes the latch resistant to opening in the event that the vehicle in which the latch is installed is involved in a collision.

58 Claims, 79 Drawing Sheets

U.S. PATENT DOCUMENTS

| | | | | |
|---|---|---|---|---|
| 7,004,517 | B2 | 2/2006 | Vitry et al. | |
| 7,029,040 | B2 | 4/2006 | Lippoldt et al. | |
| 7,234,739 | B2 | 6/2007 | Saitoh et al. | |
| 7,332,990 | B2 * | 2/2008 | Lo et al. | 335/205 |
| 2008/0231060 | A1 * | 9/2008 | Carabalona et al. | 292/251.5 |
| 2008/0265588 | A1 * | 10/2008 | Carabalona | 292/251.5 |

FOREIGN PATENT DOCUMENTS

| | | | |
|---|---|---|---|
| DE | 10009370 | A1 | 9/2001 |
| EP | 0239229 | A3 | 2/1987 |
| EP | 0408951 | A2 | 6/1990 |
| EP | 0546668 | B1 | 10/1992 |
| FR | 2860023 | A1 | 9/2003 |
| JP | 54013000 | A * | 1/1979 |
| JP | 54102046 | A * | 8/1979 |
| WO | WO0138671 | A2 | 5/2001 |
| WO | WO2006034057 | A1 | 3/2006 |
| WO | WO2006088775 | A2 | 8/2006 |
| WO | WO2006122151 | A2 | 11/2006 |

OTHER PUBLICATIONS

TrMark Website print out—www.trimarkcorp.com, 050-0410 Floating Striker Single Rotor Latch Single Position, 19 pages. Printed out on Apr. 13, 2004.

Photographs showing a TriMark latch similar to those shown in TriMark's Website.

* cited by examiner

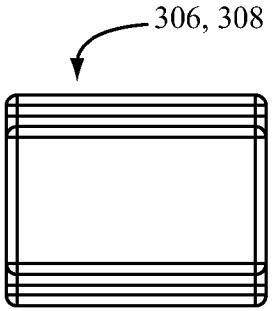
Fig. 36
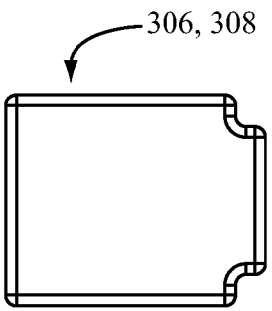
Fig. 37
Fig. 38
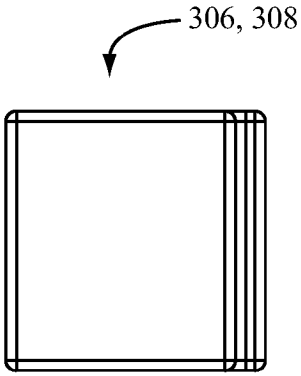
Fig. 39
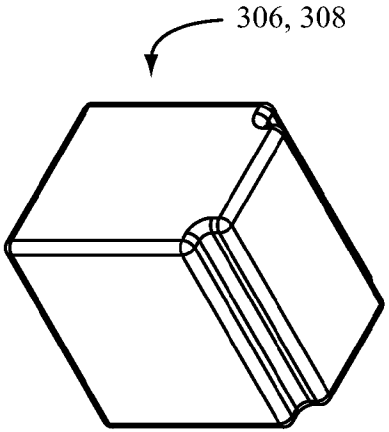
Fig. 40

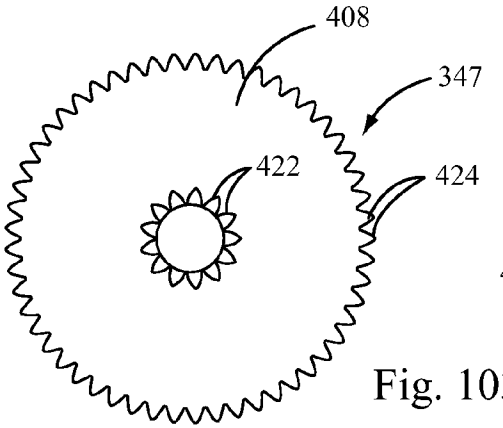
Fig. 103
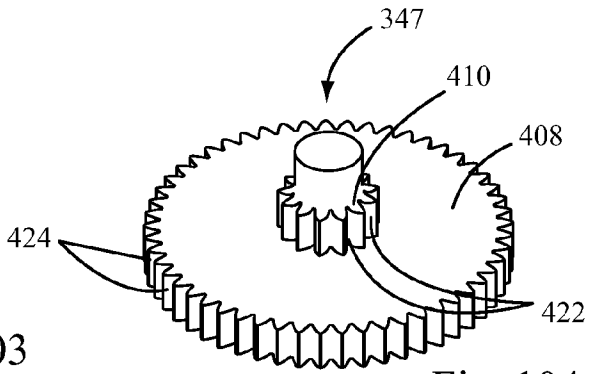
Fig. 104
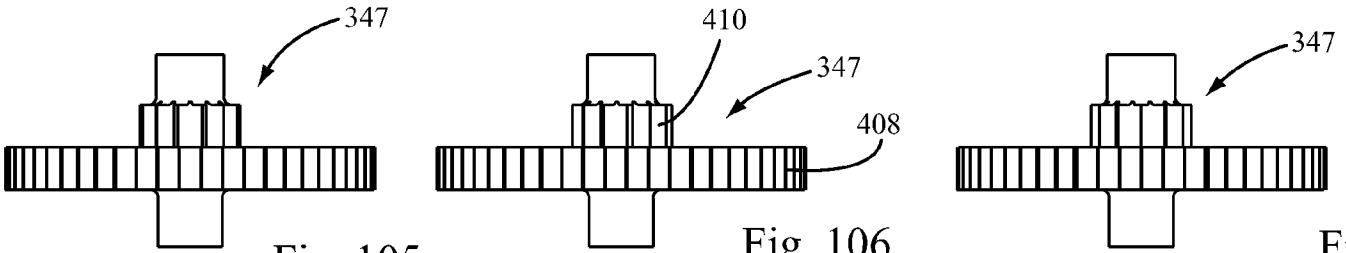
Fig. 105
Fig. 106
Fig. 107
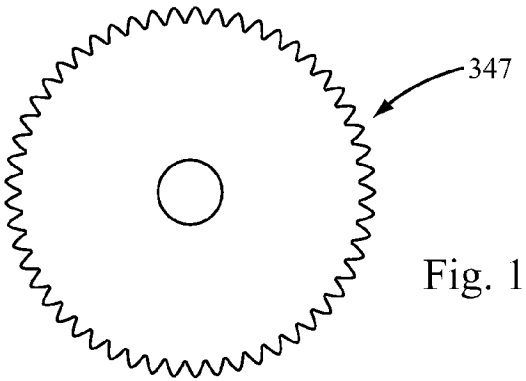
Fig. 108

MAGNETIC LATCH MECHANISM

CROSS REFERENCE TO RELATED APPLICATIONS

This application claims the benefit of the priority of, and is the non-provisional of, U.S. provisional application for patent Ser. No. 60/879,346, filed on Jan. 6, 2007, the entirety of which is incorporated herein by reference.

BACKGROUND OF THE INVENTION

1. Field of Invention

This invention relates to latch having magnets for use in securing one or more closure panels of a compartment in the closed position.

2. Brief Description of the Related Art

In many applications the need arises to secure a panel in a closed position relative to a compartment opening or another panel. For example, in the automotive industry the panels acting as closures for the interior compartments of the vehicle must be secured in the closed position when the compartment is not being accessed. Examples of such compartments include the vehicle's glove compartment and the center console compartment between a vehicle's front seats. The closure members for such compartments are selectively secured in the closed position by latches in order to secure the contents of the compartments while allowing a user to selectively open the closure members to access the contents of the compartments. Many latches for this purpose have been proposed in the art. Examples of such latches can be seen in U.S. Pat. Nos. 5,927,772 and 6,761,278. However, none of the known latches are seen to teach or suggest the novel and unique latch of the present invention.

SUMMARY OF THE INVENTION

The present invention is directed to a latch mechanism that is particularly advantageous for, but is not limited to, releasably securing dual doors of a compartment in the closed position. The latch has two rotary magnets, and each rotary magnet at least helps to secure a respective one of the doors in the closed position relative to the compartment by magnetically attracting a magnetic insert attached to the respective door. Mechanical hook-like rotary pawls provided to rotate with the magnets act to mechanically secure the doors in the closed position. The latch according to the present invention is particularly well suited for use in applications where the dual doors are linked. In such applications closing one of the doors also moves the other door to the closed position. However, the mechanical linkage between the doors is not perfect and the closing of the doors is not always simultaneous. Often one door will slightly lag behind the other door in closing. The latch of the present invention is designed to effect proper securing of the doors in the closed position even when one door lags behind the other. In addition, the latch is provided with a safety feature that prevents the latch from opening in the event that the vehicle in which the latch is installed is involved in a collision.

BRIEF DESCRIPTION OF THE DRAWINGS

FIGS. 36-40 are views of the rotary magnets of an embodiment of the magnetic latch mechanism of the present invention.

FIGS. 103-108 are views of the second gear wheel of the motor drive of an embodiment of the magnetic latch system of the present invention, shown in isolation.

Like reference numerals indicate like elements throughout the several views.

DETAILED DESCRIPTION OF THE INVENTION

The disclosures of U.S. Provisional Application for Patent Ser. No. 60/652,295, filed on Feb. 12, 2005, U.S. Provisional Application for Patent Ser. No. 60/666,694, filed on Mar. 29, 2005, U.S. Provisional Application for Patent Ser. No. 60/679,274, filed on May 8, 2005, and U.S. Provisional Application for Patent Ser. No. 60/683,981, filed on May 23, 2005, are incorporated herein by reference in their entirety. Also, the disclosure of International Application for Patent Serial Number PCT/US2006/17985, filed on May 8, 2006, and designating The United States of America, is incorporated herein by reference in its entirety.

Figure 1:
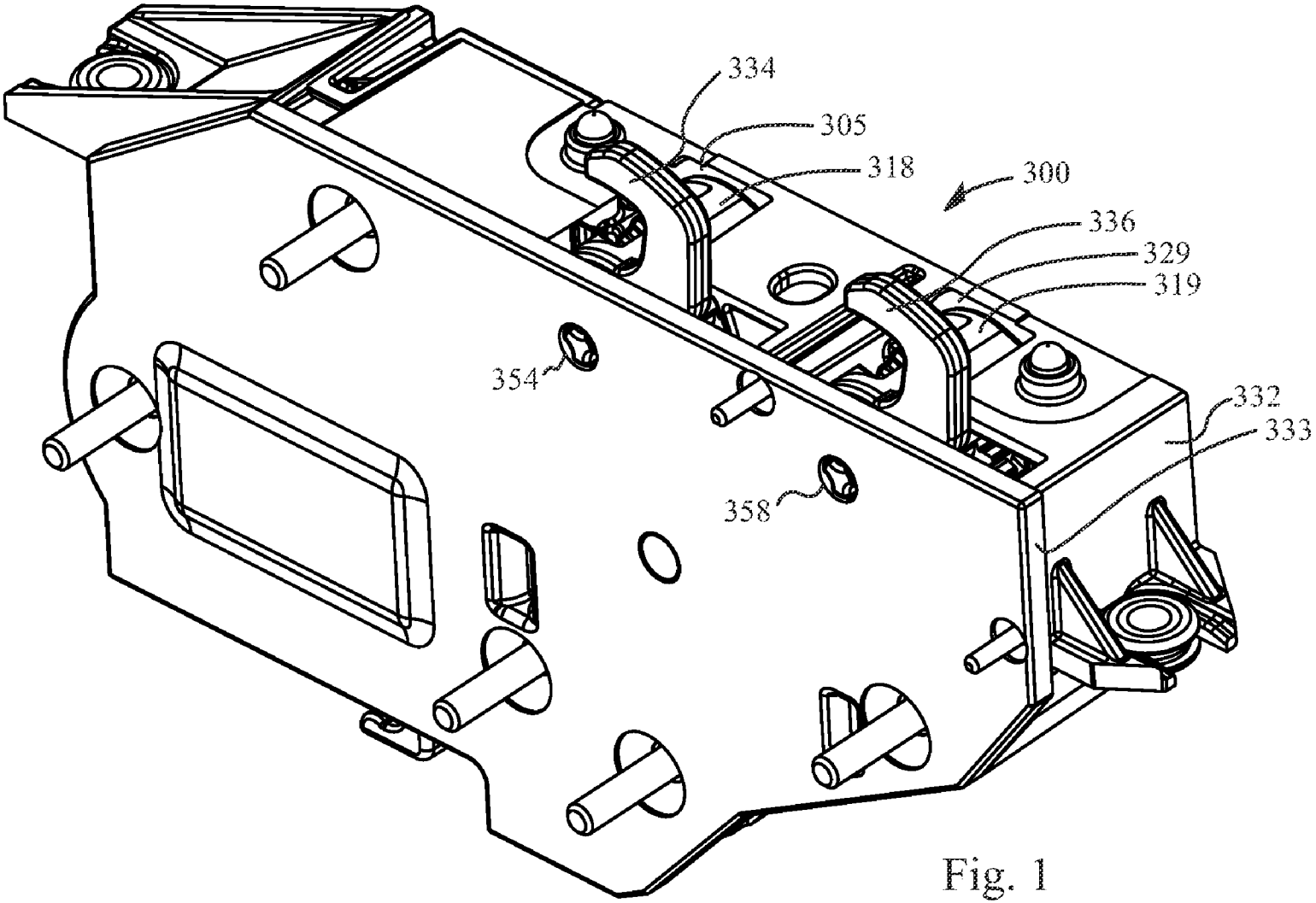
FIGS. 1-9 are views of an embodiment of the magnetic latch mechanism and its components according to the present invention shown in the latched configuration.
Figure 2:
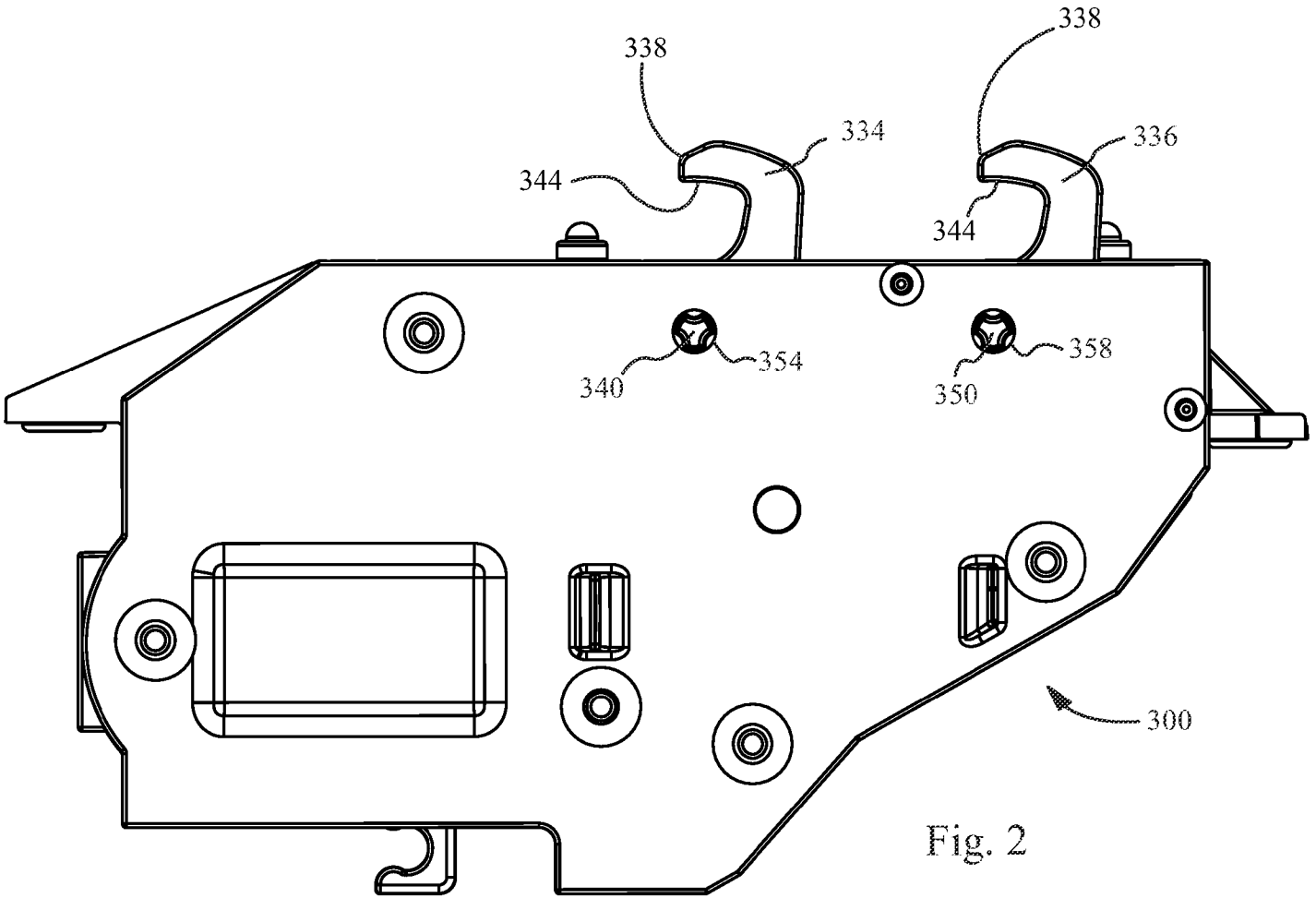
Figure 3:
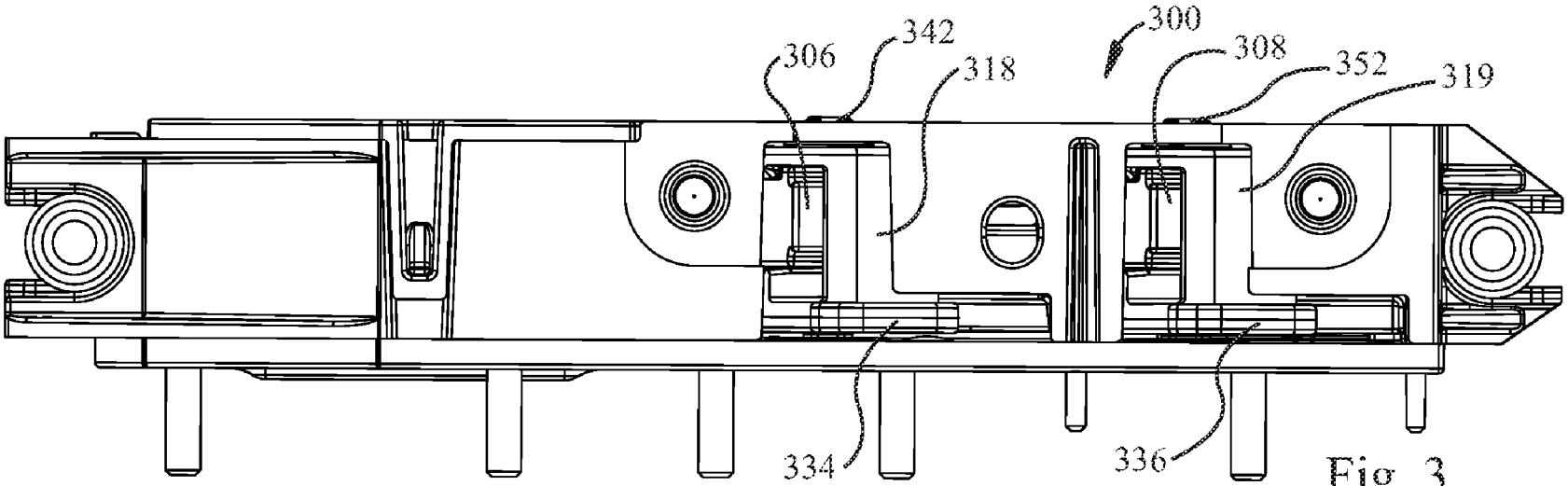
Figure 4:
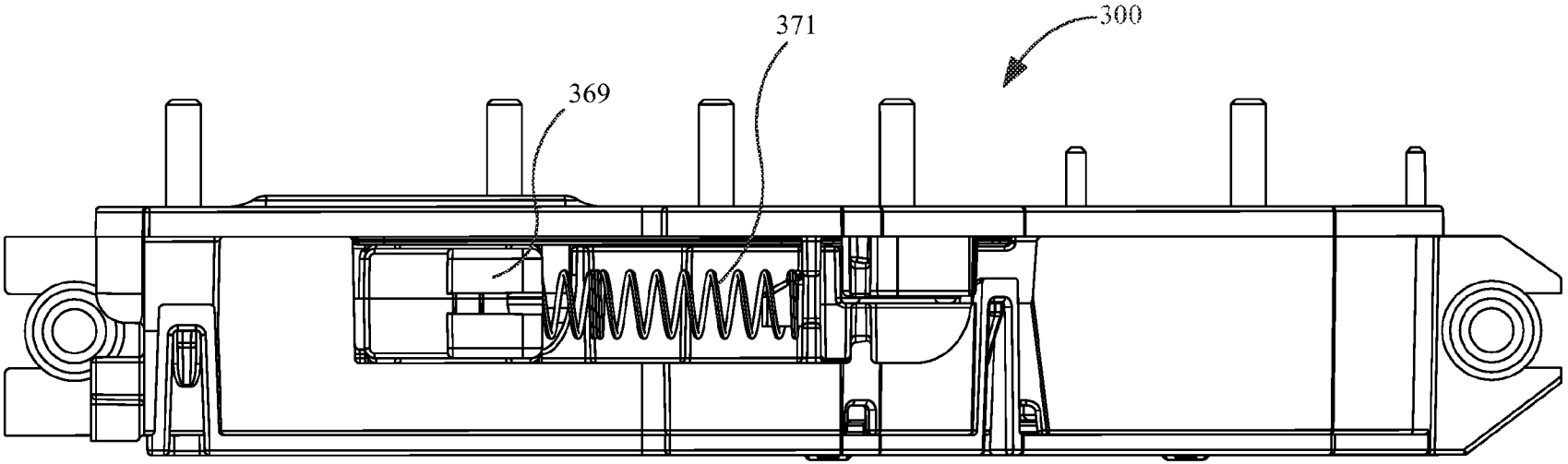
Figure 5:
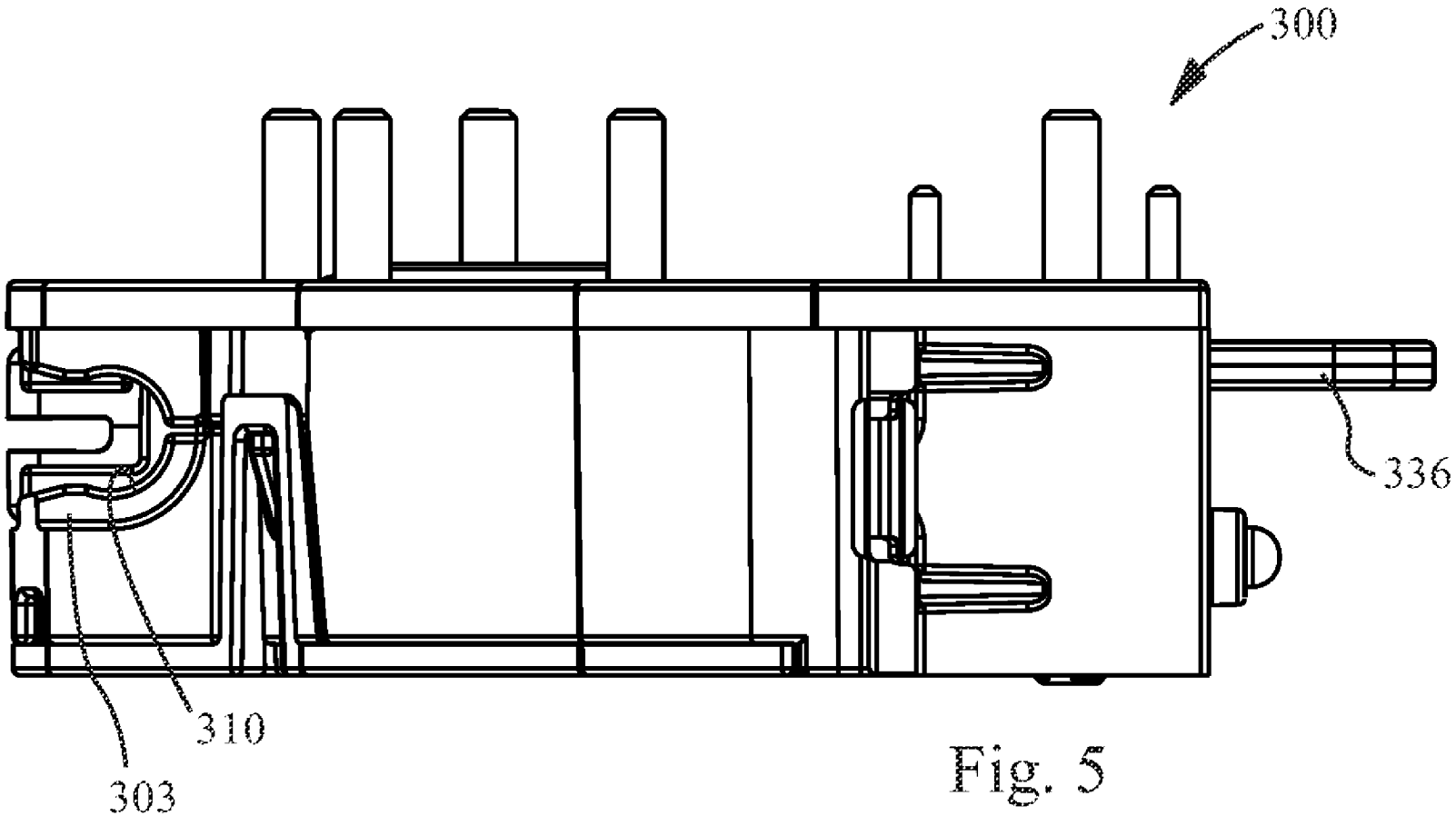
Figure 6:
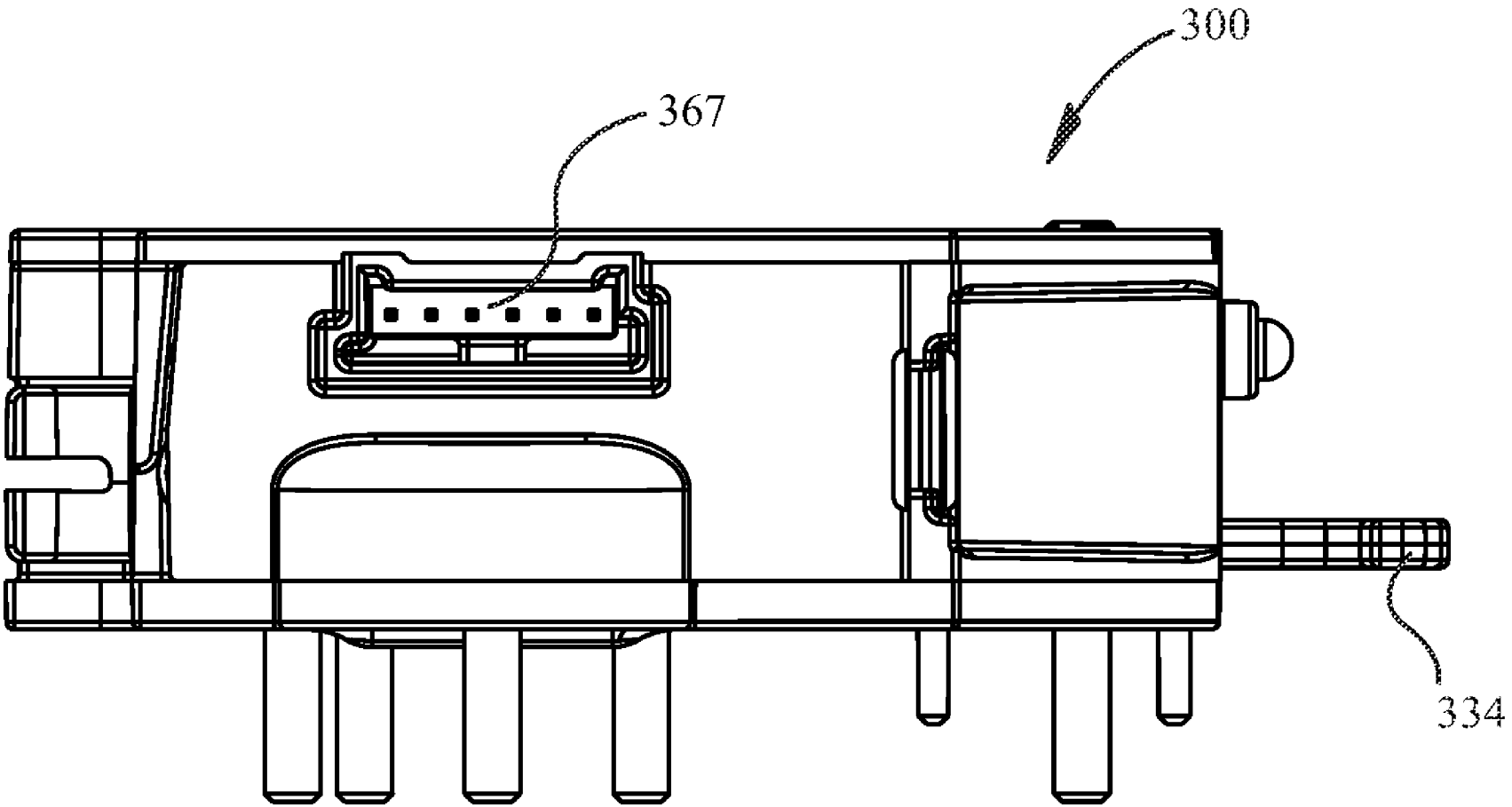
Figure 150:
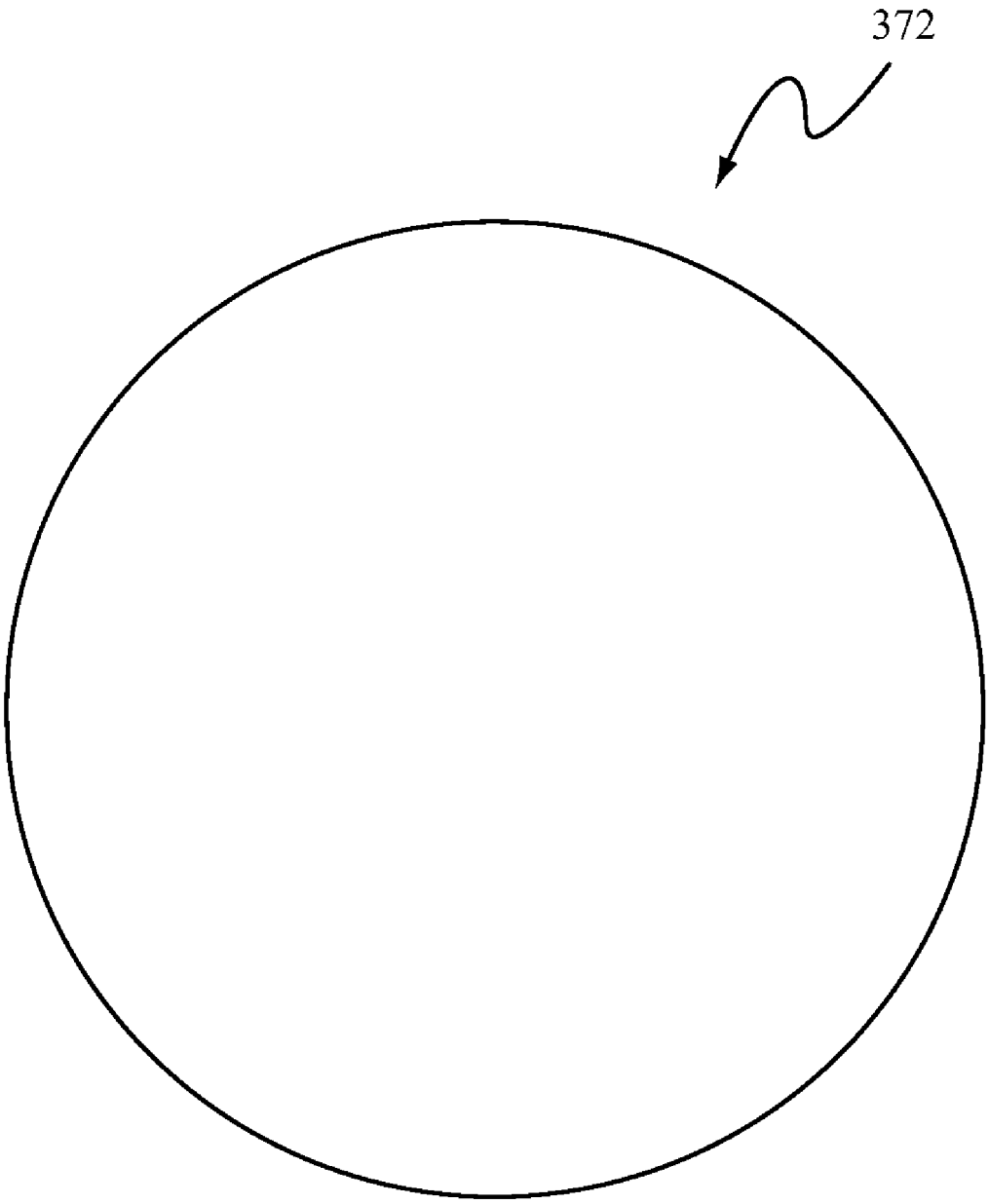
FIG. 150 shows the locking ball bearing for locking the rack bar of an embodiment of the magnetic latch mechanism of the present invention in the latched position.

Referring to FIGS. 1-150, the present invention is directed to a magnetic latch mechanism for securing a first member in a closed position relative to a second member, the first member being movable between the closed position and an open position relative to the second member. The first member may, for example, be a door and the second member may, for example, be a compartment or a doorframe. In the illustrated example, one or more doors provide closures for the compartment. The latch according to the present invention is particularly well suited for use in applications where dual doors that are mechanically linked are to be secured in the closed position. In such applications closing one of the doors also moves the other door to the closed position. However, the mechanical linkage between the doors is not perfect and the closing of the doors is not always simultaneous. Often one door will slightly lag behind the other door in closing. With the magnetic latch of the present invention, once the door is within the region of the influence of the magnetic field of the latch magnet, the door will be pulled to the final closed position by magnetic attraction. Therefore, movement of each door to the final closed position in a dual door application will be properly effected regardless of significant variations in relative positions of the doors as the doors approach their closed positions. Accordingly, the latch of the present invention is designed to effect proper securing of the doors in the closed position even when one door lags behind the other.

Referring to FIGS. 1-150, an embodiment 300 of the magnetic latch mechanism with dual rotary magnets according to the present invention can be seen. The latch mechanism 300 is a remotely operated latch mechanism designed to secure two doors 302 and 304 in the closed position substantially simultaneously, using two rotating magnets 306 and 308. The latch mechanism 300 is designed to be installed between the pivots or hinges of the doors 302, 304 with the rotary magnets 306, 308 supported for rotation about parallel and spaced-apart axes of rotation. Also, the rotary magnets 306, 308 rotate in the same direction. Each of the rotary magnets 306 and 308 are supported by a separate magnet carrier 318, 319, respectively. Each magnet carrier 318, 319 is rotationally supported by the housing 332. Each of the rotary magnets 306, 308 are attached to the respective magnet carrier 318, 319 such that the rotary magnet and its respective magnet carrier rotate as one unit. Each of the rotary magnets 306, 308, and their respective magnet carriers 318, 319, are rotationally movable between respective latched and unlatched positions.

The magnetic latch mechanism 300 also includes a pair of hook-shaped pawls 334, 336. Each hook-shaped pawl 334, 336 is supported by a respective magnet carrier 318, 319 such that the hook-shaped pawl 334, 336 and the respective magnet carrier 318, 319 rotate as a unit. Each hook-shaped pawl 334, 336 has a hooked head 322 with a cam surface 338 that faces away from the respective magnet carrier 318, 319 and a catch surface 344 that faces toward the respective magnet carrier 318, 319.

The magnetic latch mechanism 300 also includes magnetic inserts 314 and 316 that can be attached to the doors 302 and 304, respectively. Each of the magnetic inserts 314 and 316 corresponds to a respective one of the rotary magnets 306, 308. When the rotary magnets 306, 308 are in their latched positions and the doors 302 and 304 are in their closed positions, the pole of each of each of the rotary magnets 306, 308 facing the respective magnetic insert 314, 316 is of an opposite type (i.e. north, south) as compared to the pole of the magnetic insert 314, 316 facing its respective rotary magnet 306, 308. For example, the magnetic inserts 314, 316 may be positioned such that their south poles face their respective rotary magnet 306, 308 when the doors 302 and 304 are in their closed positions. In this case, the rotary magnets 306, 308 would be positioned in their carriers 318, 319 such that their north poles substantially face their respective magnetic inserts 314, 316 when the rotary magnets 306, 308 and their carriers are in their latched positions and the doors 302 and 304 are in their closed positions. Accordingly, an attractive force is exerted between each rotary magnet 306, 308 and its respective magnetic insert 314, 316 with the result that the doors 302, 304 to which the magnetic inserts 314, 316 are attached are held in the closed position.

Furthermore, the hook-shaped pawls 334, 336 engage respective strikers 324, 326 to mechanically block the movement of the doors 302, 304 from the closed position to the open position. This feature prevents the doors 302, 304 from being forcibly pried open from the exterior of the compartment being secured by the doors 302, 304.

The magnetic latch mechanism 300 includes the pair of strikers 324, 326 each of which corresponds to a respective one of the pair of hook-shaped pawls 334, 336. Each striker 324, 326 is supported by a respective door 302, 304 such that the striker is spaced apart from the respective door's interior surface and the head 322 of the hook-shaped pawl 334, 336 can fit between the respective striker 324, 326 and the respective door 302, 304. Each striker 324, 326 has a cam surface 328 that faces away from the respective door 302, 304 and a catch surface 330 that faces toward the respective door 302, 304. The cam surface 328 of each striker can interact with the cam surface 338 of the respective hook-shaped pawl 334, 336 to move the pawl out of the way of the striker 324, 326 and allow the respective door to move to the closed position if the respective hook-shaped pawl happens to be near the latched position, illustrated in FIGS. 1-9, when the respective door is being moved to the closed position. Once the door 302, 304 is in the closed position, the magnetic attraction between the respective rotary magnet 306, 308 and the respective magnetic insert 314, 316 moves the respective hook-shaped pawl 334, 336 to the latched position. In the latched position, the head 322 of the respective hook-shaped pawl 334, 336 is positioned between the respective striker 324, 326 and the respective door 302, 304, where the catch surface 344 of the respective hook-shaped pawl 334, 336 can engage the catch surface 330 of the respective striker 324, 326 to thereby mechanically block the movement of the respective door 302, 304 from the closed position to the open position.

When the rotary magnets 306, 308 are in their unlatched positions (illustrated in FIGS. 13-19 and 31-32) and the doors 302 and 304 are in their closed positions (illustrated in FIGS. 7-11 and 23-28), the pole of each of each of the rotary magnets 306, 308 that is of an opposite type compared to the pole of the respective magnetic insert 314, 316 facing the rotary magnet 306, 308, is positioned farther from the respective magnetic insert 314, 316, while the pole of each of the rotary magnets 306, 308 that is of the same type compared to the pole of the respective magnetic insert 314, 316 facing toward the rotary magnet 306, 308, is positioned closer to the respective magnetic insert 314, 316, in comparison to the latched position of the rotary magnets 306, 308. In the unlatched position, the repulsive force between the like poles of each rotary magnet 306, 308 and the respective magnetic insert 314, 316 overcomes the attractive force between the opposite poles of each rotary magnet 306, 308 and the respective magnetic insert 314, 316. Accordingly, a net repulsive force is exerted between each rotary magnet 306, 308 and its respective magnetic insert 314, 316. In addition, the hook-shaped pawls 334, 336 rotate to their unlatched positions along with the rotary magnets 306, 308 and their magnet carriers 318, 319, which removes the mechanical impediment to the opening of the doors 302, 304, with the result that the doors 302, 304 to which the magnetic inserts 314, 316 are attached are moved from the closed position toward the open position.

Again, for example, we can assume that the magnetic inserts 314, 316 are positioned such that their south poles face their respective rotary magnet 306, 308 when the doors 302 and 304 are in their closed positions. In this case, the north poles of the rotary magnets 306, 308 move away from the south poles of their respective magnetic inserts 314, 316 and the south poles of the rotary magnets 306, 308 move toward the south poles of their respective magnetic inserts 314, 316 as the rotary magnets 306, 308 and their carriers 318, 319 move from the latched position to the unlatched position, such that a net repulsive force is exerted between each rotary magnet 306, 308 and its respective magnetic insert 314, 316 when the rotary magnets 306, 308 reach their unlatched positions.

The opposite type pole of the respective rotary magnet 306, 308 need not directly face the pole of the magnetic insert 314, 316 facing its respective rotary magnet 306, 308 in the latched position. In the unlatched position, the rotary magnets 306, 308 may deviate from the direct facing relationship between the opposite type poles of the rotary magnets and of their respective magnetic inserts as long as the net attractive force between the rotary magnet 306, 308 and the respective magnetic insert 314, 316 is sufficiently strong to produce reliable simultaneous latching of the doors 302, 304 even when one door lags the other during closing as previously described. As long as this result is achieved, the poles of the rotary magnets 306, 308 having a polarity opposite the poles of the respective magnetic inserts 314, 316 facing toward the magnets 306, 308, can be said to be substantially facing the poles of the respective magnetic inserts 314, 316 facing toward the magnets 306, 308. Of course, the direct facing relationship between the opposite type poles of the rotary magnets and of their respective magnetic inserts gives the greatest holding power to the latch mechanism and it would be desirable for the north poles of the rotary magnets 306, 308 to approach the direct facing relationship with the south poles of their respective magnetic inserts as closely as possible in the latched position. The key consideration is that the angular position of the rotary magnets 306, 308 in the latched position must be selected such that the north poles of the rotary magnets 306, 308 are closer to the south poles of their respective magnetic inserts as compared to the south poles of the rotary magnets 306, 308 to such an extent that the net attractive force between the rotary magnets 306, 308 and their respective magnetic inserts is strong enough for the rotary magnets to draw in and hold the doors 302, 304 in the closed position as described herein. In the example being considered, the north poles of the rotary magnets 306, 308 deviate from the direct facing relationship with the south poles of their respective magnetic inserts by a few degrees in the latched position.

Each magnetic insert 314, 316 is attached to a respective one of the doors 302, 304 by being inserted in a magnetic insert housing 376, 378, respectively, which in turn are attached to a respective one of the doors 302, 304. In the illustrated example, the magnetic insert housings 376, 378 are attached to the doors 302, 304 by screws 380 whose heads are embedded in the material of the magnetic insert housings 376, 378. The screws 380 engage threaded holes in the doors 302, 304, such that turning the screws 380 adjusts the height of the magnetic insert housings 376, 378, and therefore the height of the strikers 324, 326, above the interior surfaces of the doors 302, 304.

The means for attaching the magnetic insert housings 376, 378 to the doors 302, 304 is not critical to the present invention and any suitable fastening means including screws, rivets, pins, nails and adhesives may be used. Furthermore, the magnetic insert housings 376, 378 may be of unitary construction with the doors 302, 304. The magnetic insert housings 376, 378 may also be dispensed with entirely and the magnetic inserts 314, 316 may be attached to the doors 302, 304 directly. As with the housings 376, 378, any suitable fastening means including screws, rivets, pins, nails and adhesives may be used to attach the magnetic inserts 314, 316 to the doors 302, 304. As yet another alternative, the magnetic inserts 314, 316 may be embedded in the material of the doors 302, 304.

However, it is preferred to use the illustrated means for attaching the magnetic insert housings 376, 378 to the doors 302, 304, because the illustrated means allows for the adjustment of the height of the strikers 324, 326 above the interior surfaces of the doors 302, 304 to accommodate variations in the gap between the doors 302, 304 in the closed position and the housing 332.

In the illustrated embodiment, the strikers 324, 326 are of unitary construction with the magnetic insert housings 376, 378, respectively. As with the housings 376, 378, the means for attaching the strikers 324, 326 to the doors 302, 304 are not critical to the present invention. Any suitable structure that supports the striker 324, 326 such that the striker is spaced apart a sufficient amount from the respective door's interior surface in order for the head 322 of the hook-shaped pawl 334, 336 to fit between the respective striker 324, 326 and the respective door 302, 304 may be employed and any suitable fastening means including screws, rivets, pins, nails and adhesives may be used to attach the structure to the respective door. Furthermore, the strikers 324, 326 may be of unitary construction with the doors 302, 304.

The magnetic latch mechanism 300 includes a housing 332 that rotationally supports the magnet carriers 318, 319 having the rotary magnets 306, 308, respectively, attached thereto. The top openings 305, 329 of the housing 332 allow the hook-shaped pawls 334, 336 to extend out of the housing 332 to engage the strikers 324, 326 in the latched position.

Each magnet carrier 318, 319 includes a receptacle 384, 386 for receiving the respective rotary magnet 306, 308. Each magnet carrier 318, 319 has a pair of spindles, 340, 342 and 350, 352, respectively, with each pair of spindles projecting outward on opposite sides of the respective receptacle 384, 386. The receptacles 384, 386, and consequently carriers 318, 319, are positioned in tandem along the longitudinal axis of the housing 332 with their axes of rotation being transverse, i.e. perpendicular, to the longitudinal axis of the housing 332. The spindles 340, 342, 350, 352 are received in and rotationally supported by the holes 354, 356, 358, 360 in the sides of the housing 332, respectively. Thus the magnet carriers 318, 319 are rotationally supported by the housing 332. In the illustrated example, the spindles 340, 342, 350, 352 are fluted. A cover 335 is provided for the circuit board 363. The holes 356, 360 are provided in a cover plate 333 that forms part of the housing 332. Again, the particular modality used for rotationally supporting the magnet carriers 318, 319 in the housing 332 is not critical to the present invention.

Each hook-shaped pawl 334, 336 is integrally formed with its respective magnet carrier 318, 319. Thus, there is no relative rotation between each receptacle 384, 386 and the respective hook-shaped pawl 334, 336; and each hook-shaped pawl 334, 336 and the respective receptacle 384, 386, and consequently the respective magnet carrier 318, 319, rotate as a unit.

Each magnet carrier 318, 319 also has a plurality of gear teeth 387 and 389, respectively. Each set of gear teeth 387, 389 is distributed along an arc defined by a sector of a circle centered at the axis of rotation of the respective magnet carrier 318, 319. The axis of rotation of each magnet carrier 318, 319 is of course defined by the central axis of the respective pair of spindles 340, 342 or 350, 352 of each magnet carrier 318, 319. The gear teeth 387, 389 of each magnet carrier 318, 319 are supported by, and are integral with, the respective receptacle 384, 386 of each magnet carrier. The first and second sets of gear teeth 313 and 337 of the rack bar 317 engage the gear teeth 387 and 389 of the magnet carriers 318 and 319, respectively.

The latch mechanism 300 includes a rack bar 317 that has first and second sets of gear teeth 313, 337 distributed along its length. Each set of gear teeth 313, 337 includes a plurality of gear teeth. The gear teeth 313, 337 are in constant mesh with the gear teeth 387, 389, respectively, such that the magnet carriers 318, 319 are linked by the rack bar 317. The rack bar 317 is supported for rectilinear motion back and forth in the direction of its longitudinal axis between a latched position, illustrated in FIGS. 7-8, and an unlatched position, illustrated in FIGS. 18-19 and 31. The rack bar 317 causes the magnet carriers 318, 319 to move in unison such that they and the rotary magnets 306, 308 can be moved from the latched position to the unlatched position by a common actuation mechanism in order to provide for the simultaneous opening of the dual doors 302, 304. The rack bar 317 supports a sliding bar 315 for limited rectilinear movement relative to the rack bar 317. A portion of the sliding bar 315 is at least partially surrounded by the rack bar 317 such that the gear teeth 313, 337 are positioned intermediate the sliding bar 315 and the gear teeth 387, 389. A projection 307 projects from the sliding bar 315 and is capable of engagement by a flexible link 339. The flexible link 339 includes a flexible ribbon or strap portion 345, a receptacle 369 for attachment of a Bowden cable 220, and a barb or projection 349 adapted for engaging the projection 307 of the sliding bar 315 in order to move the sliding bar 315 from a locked position to an unlocked position relative to the rack bar 317 and then to pull both the sliding bar 315 and the rack bar 317 until the rack bar 317 is in the unlatched position. The strap portion 345 of the link 339 is flexible but is of sufficiently high tensile strength to pull the sliding bar 315 to the unlocked position relative to the rack bar 317 and then to pull both the sliding bar 315 and the rack bar 317 until the rack bar 317 is in the unlatched position without yielding. The receptacle 369 is adapted for receiving the cylindrical enlargement 209 at the end of the Bowden cable 220 for actuating the latch mechanism 300. The strap portion 345 of the link 339 is positioned in a U-shaped track 351 in the housing 332. This arrangement allows the sliding bar 315 and the rack bar 317 to be pulled in a direction opposite to the direction in which the Bowden cable 220 is pulled outside the housing 332. In an alternative embodiment the Bowden cable was directly engaged to the sliding bar 315 and routed through a U-shaped track in the housing 332, however, the illustrated arrangement is preferred for ease of assembly and manufacture. The sliding bar 315 is movable rectilinearly between the locked position and the unlocked position relative to the rack bar 317. A spring 370 is provided that acts between the sliding bar 315 and the rack bar 317 and that biases the sliding bar 315 toward the locked position. The spring 370 is housed in a cavity 353 in the rack bar 317. When the sliding bar 315 is in the locked position it pushes the ball bearing 372 outward from the opening 374 on the top side of the rack bar 317 such that the ball bearing 372 projects outward from the top side of the rack bar 317. When the sliding bar 315 is in the locked position and the rack bar 317 is in the latched position, the ball bearing 372 engages the recess 373 in the housing 332 such that the rack bar 317 cannot move unless the sliding bar 315 is moved to the unlocked position first. The rate of the spring 370 is selected such that the sliding bar 315 cannot move due to its own inertia under the forces expected during collisions. Thus, the engagement of the ball bearing 372 with the recess 373 essentially prevents the latch 300 from unlatching during a collision and makes the latch 300 resistant to unlatching due to collisions.

The sliding bar 315 has a depression 375 that registers with the opening 374 when the sliding bar 315 is in the unlocked position. The depression 375 allows the ball bearing 372 to retract into the rack bar 317 once the sliding bar 315 is in the unlocked position, which in turn frees the rack bar 317 for movement to the unlatched position.

The receptacle 369 has an opening at one end and a slot 311 extending down one side and partway through the bottom of the receptacle 369. The slot 311 extends along the length of the receptacle 369 from the open end of the receptacle 369 to the bottom of the receptacle 369 and along a portion of a diameter of the bottom of the receptacle. The slot 311 is wide enough to allow the Bowden cable 220 to extend through the slot 311. The cylindrical enlargement 209 may have any other shape and size such that it will not fit through the slot 311 but that it will fit into the receptacle 369.

The housing 332 has a bracket 303 with a U-shaped slot 310 that can support one end of the sheath 223 of the Bowden cable 220. The Bowden cable 220 allows the remote operation of the latch mechanism 300. With the one end of the sheath 223 of the Bowden cable 220 installed in the U-shaped slot 310 of the bracket 303 and with the spherical enlargement 209 positioned in the receptacle 369, pulling the remote end (not illustrated) of the Bowden cable 220 will cause the rectilinear movement of the sliding bar 315 from the locked position to the unlocked position. This initial movement of the sliding bar 315 frees the rack bar 317 for movement to the unlatched position. The range of motion of the sliding bar 315 from the locked position to the unlocked position is relatively limited, and further pulling the remote end (not illustrated) of the Bowden cable 220 will cause the rectilinear movement of both the sliding bar 315 and the rack bar 317 together such that the rack bar 317 is moved from the latched position to the unlatched position. Consequently, the rotary magnets 306, 308, magnet carriers 318, 319, and hook-shaped pawls 334, 336 are caused to rotate from their latched positions, assuming them to initially be in the latched position, to their unlatched positions.

Figure 20:
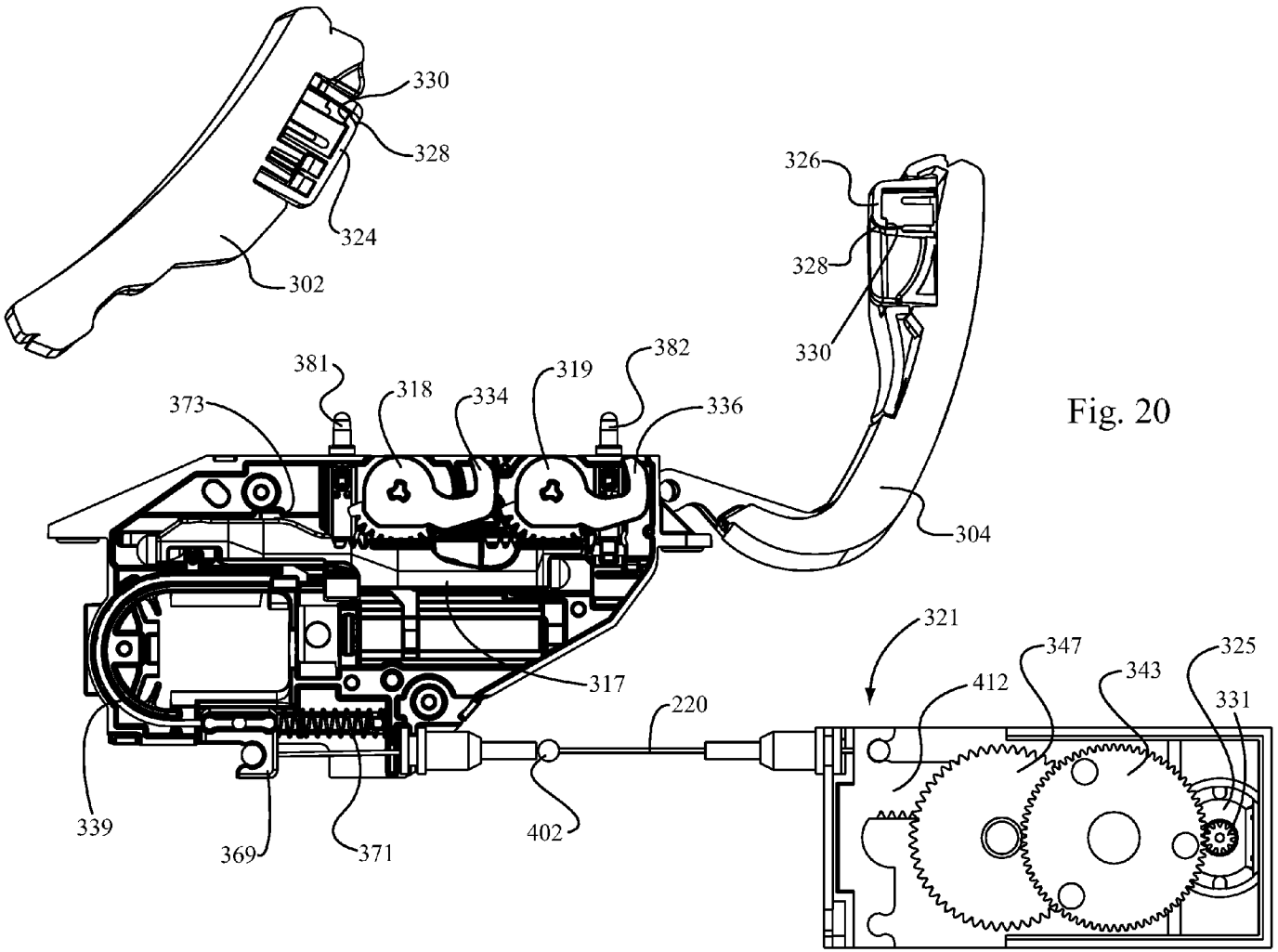
FIG. 20 is a view of an embodiment of the magnetic latch mechanism according to the present invention showing the latch mechanism hooks in the resting or first intermediate position after the unlatching process.

The Bowden cable 220 can be pulled manually or by using an electrical actuator acting at a location remote from the cable that is engaged to the receptacle 369. Generally some type of remotely located handle or push button would be provided as a user interface for the manual or electrical operation of the latch mechanism 300, respectively. A spring 371 biases the flexible link 339 to the latched position best illustrated in FIGS. 7 and 20.

The latch mechanism 300 is mounted to the compartment secured by the doors 302, 304.

The magnets 306, 308 pull the doors 302, 304 in to ensure they both latch correctly. The magnets 306, 308 control the final movement and positions of the doors 302, 304 during closing. The magnets 306, 308 also aid the opening of the doors 302, 304 when the mechanism is unlatched.

To open the latch mechanism 300 the button (not shown), for example, is pushed. This would cause the remote end of the Bowden cable 220 to be pulled by one of the mechanisms previously mentioned. The pulling of the Bowden cable 220 causes the rotation of the rotary magnets 306, 308, magnet carriers 318, 319, and hook-shaped pawls 334, 336 from their latched positions to their unlatched positions. This action disengages the hook-shaped pawls 334, 336 from their respective strikers 324, 326, which mechanically releases the doors 302 and 304. In addition, the magnets 306, 308 are rotated to their unlatched positions where these magnets repel the magnetic inserts 314, 316 attached to the doors 302, 304, forcing the doors to swing open. Once the magnets 306, 308 are clear of the influence of the magnetic field of the magnetic inserts 314, 316 and the Bowden cable 220 is released, the magnetic attraction of the north pole of one of the magnets 306, 308 for the south pole of the other one of the magnets 306, 308, or vice versa, will maintain the rotary magnets 306, 308, the magnet carriers 318, 319, and the hook-shaped pawls 334, 336 in first intermediate positions—corresponding to the open but un-actuated, at rest, condition of the magnetic latch mechanism illustrated in FIG. 20—near their unlatched positions ready for latching the doors 302, 304 as the doors 302, 304 move to the closed position. In the illustrated embodiment, the magnetic attraction of the north pole of the rotary magnet 306 for the south pole of the rotary magnet 308 maintains the rotary magnets 306, 308, the magnet carriers 318, 319, and the hook-shaped pawls 334, 336 in their first intermediate positions.

Figure 7:
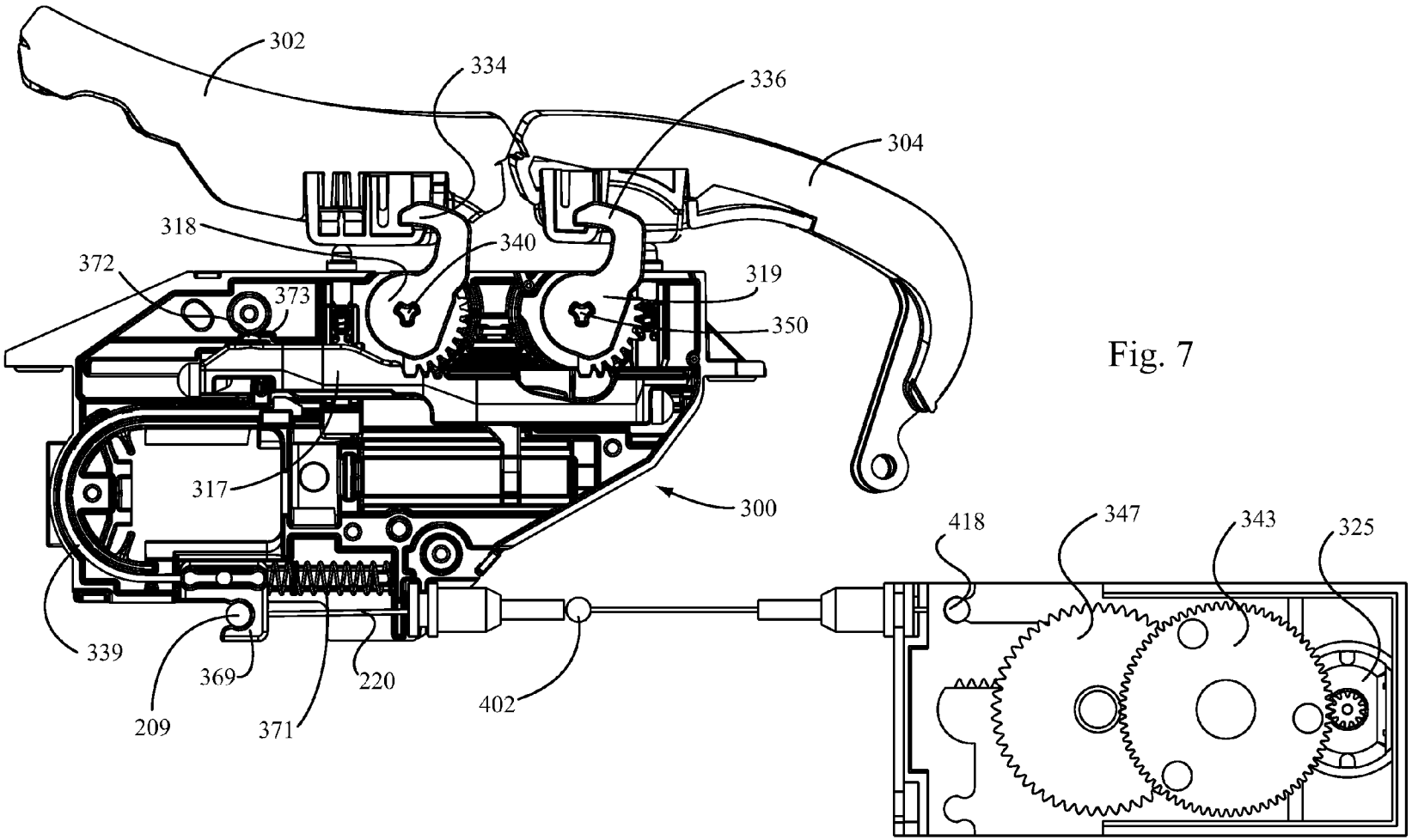
Figure 8:
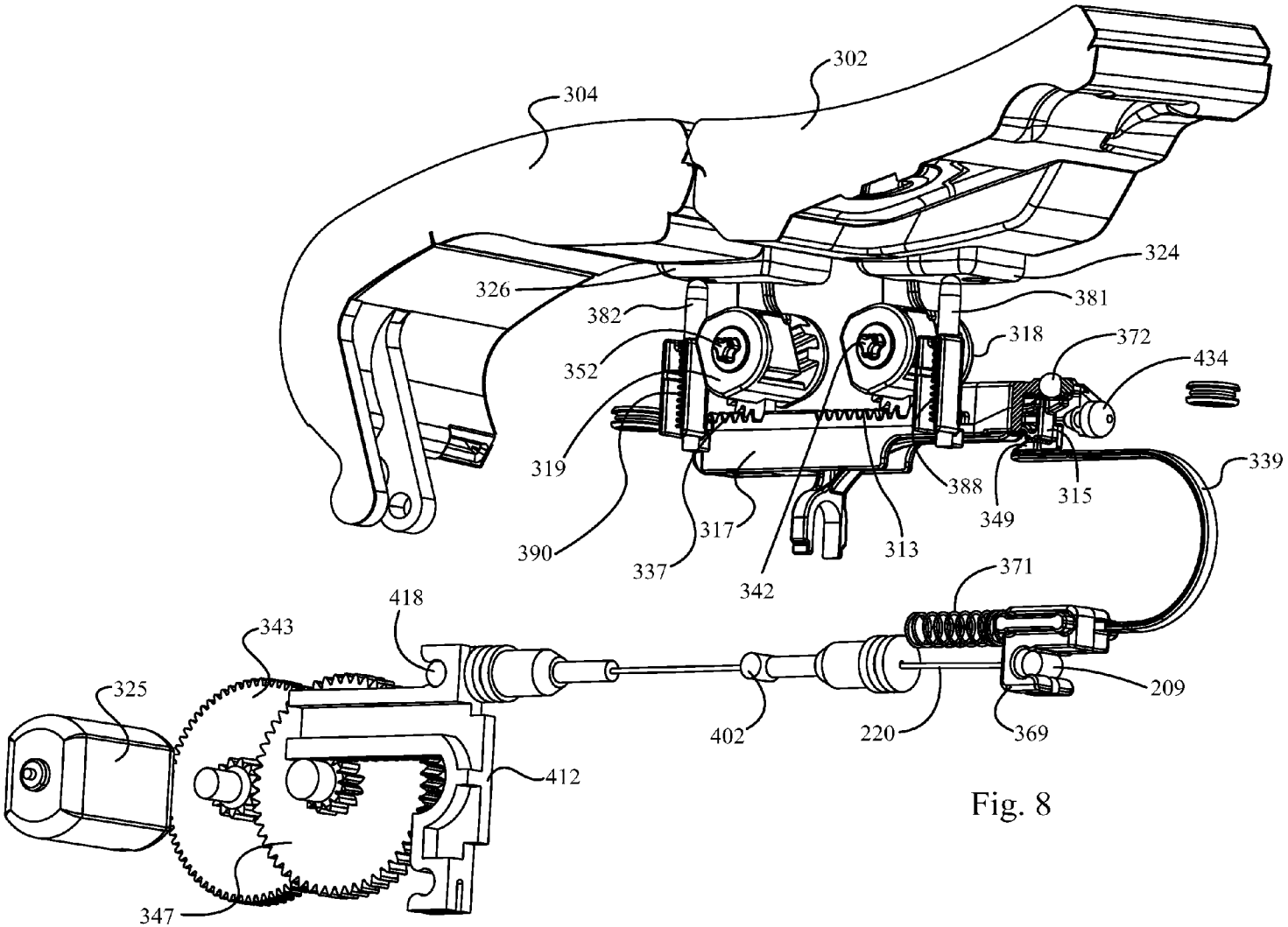
Figure 9:
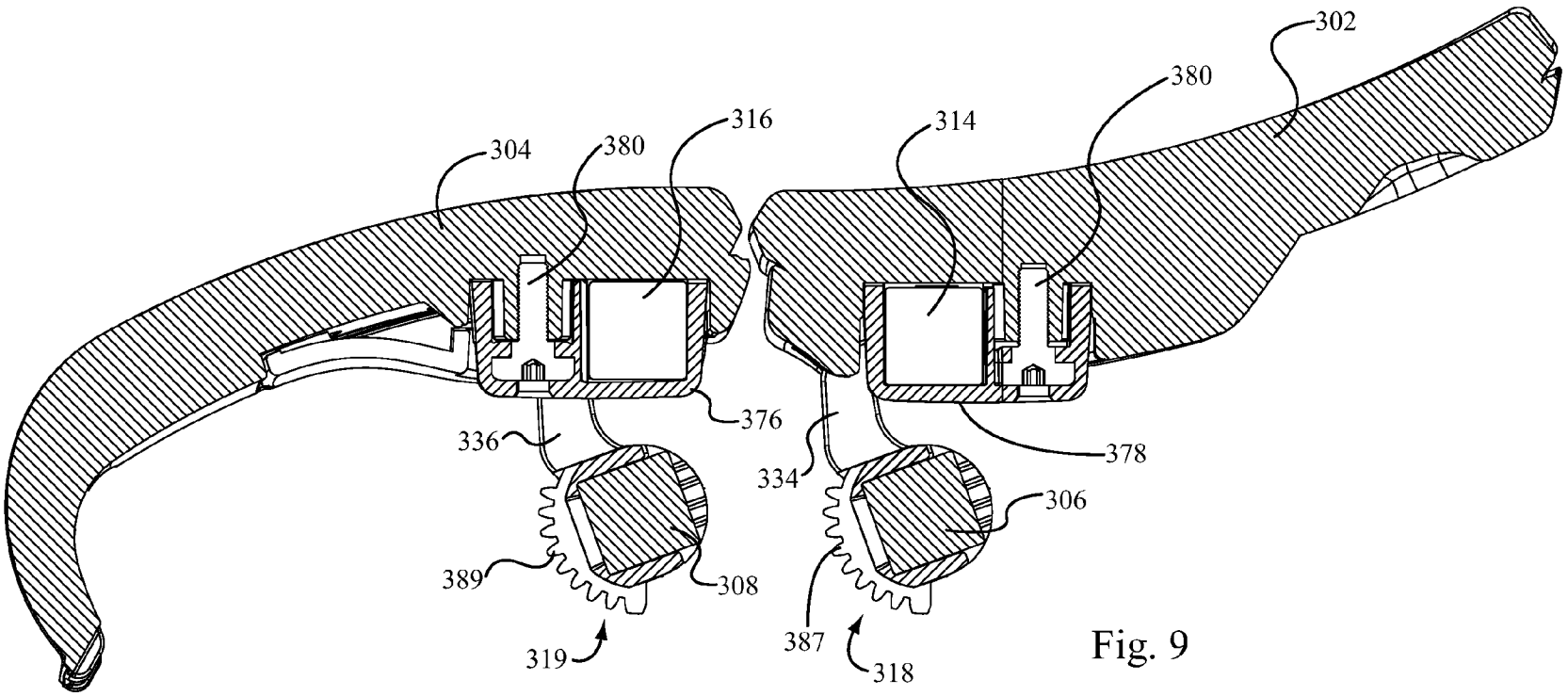
Figure 10:
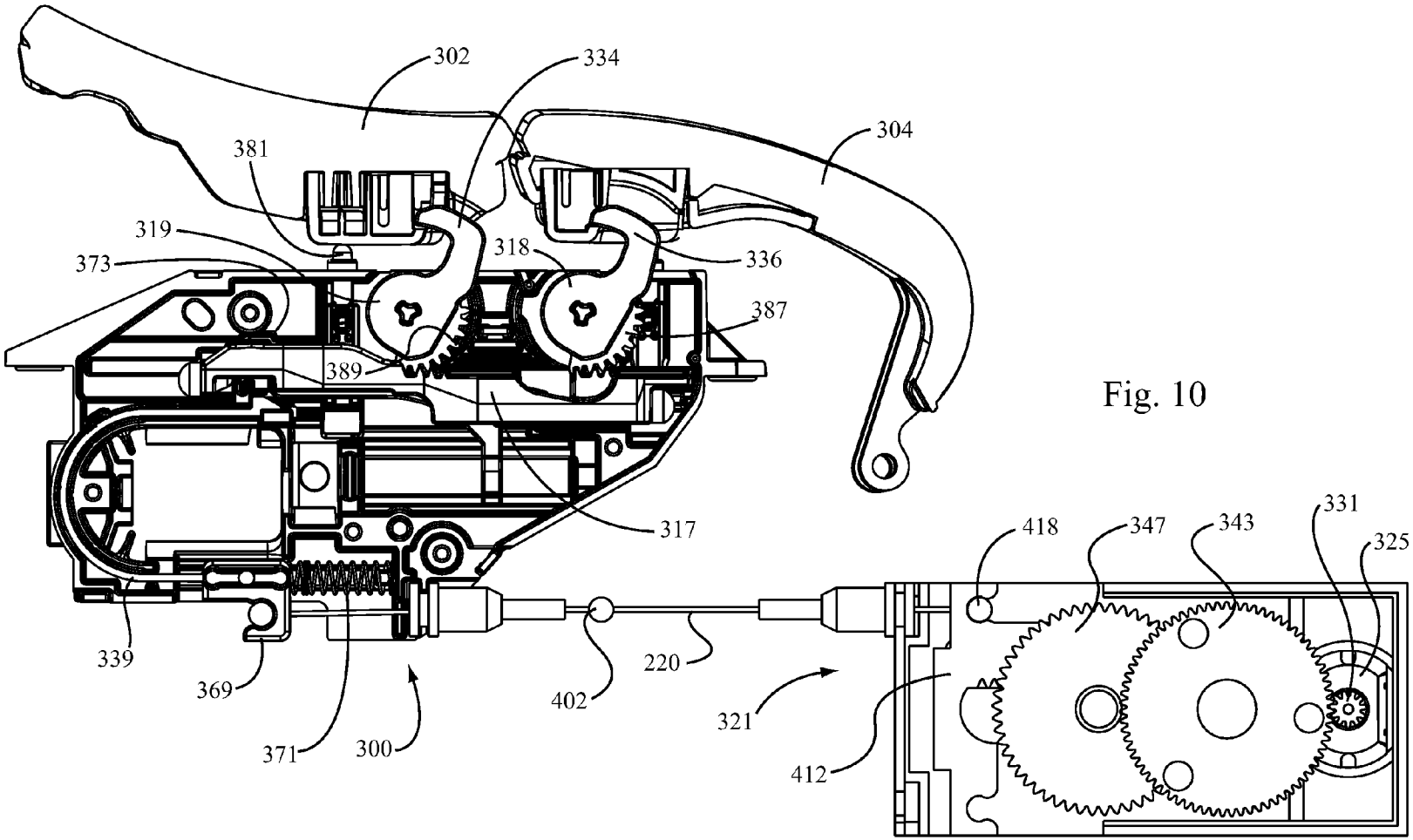
FIGS. 10-11 are views of an embodiment of the magnetic latch mechanism and its components according to the present invention shown after the initiation of the unlatching process.
Figure 11:
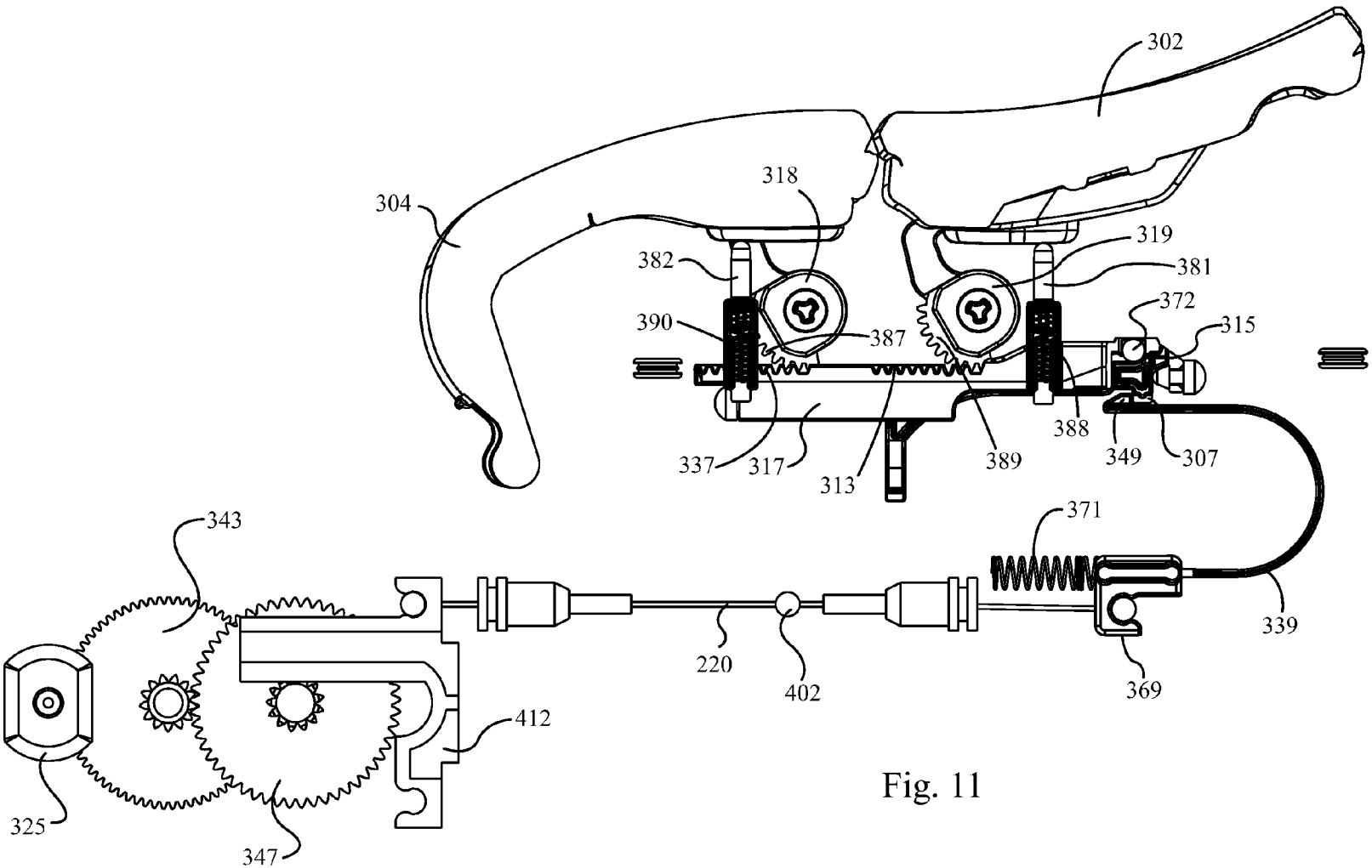
Figure 12:
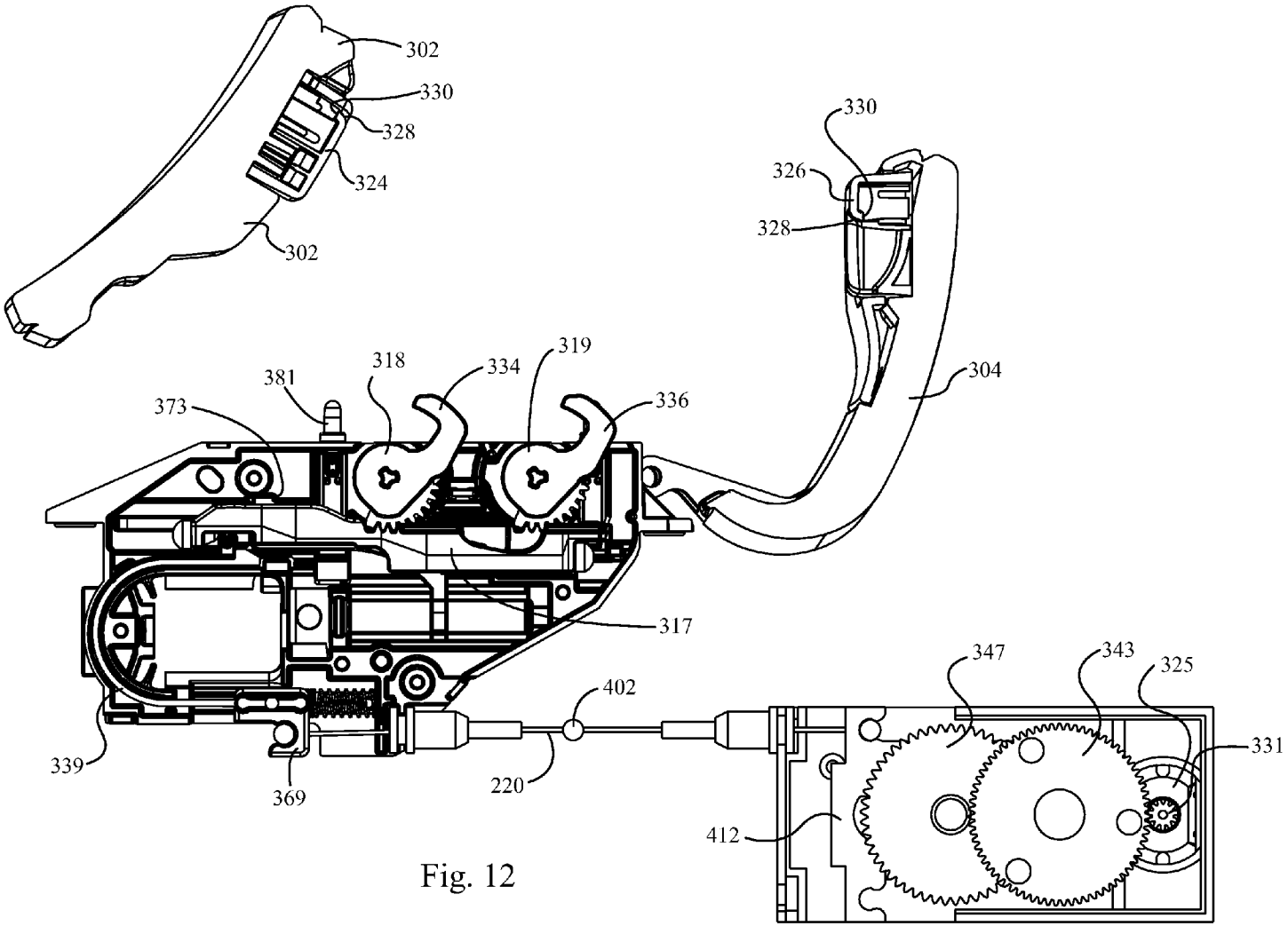
FIG. 12 is a view of an embodiment of the magnetic latch mechanism according to the present invention showing the latch mechanism hooks disengaged from the doors initially secured by the latch during the unlatching process.
Figure 13:
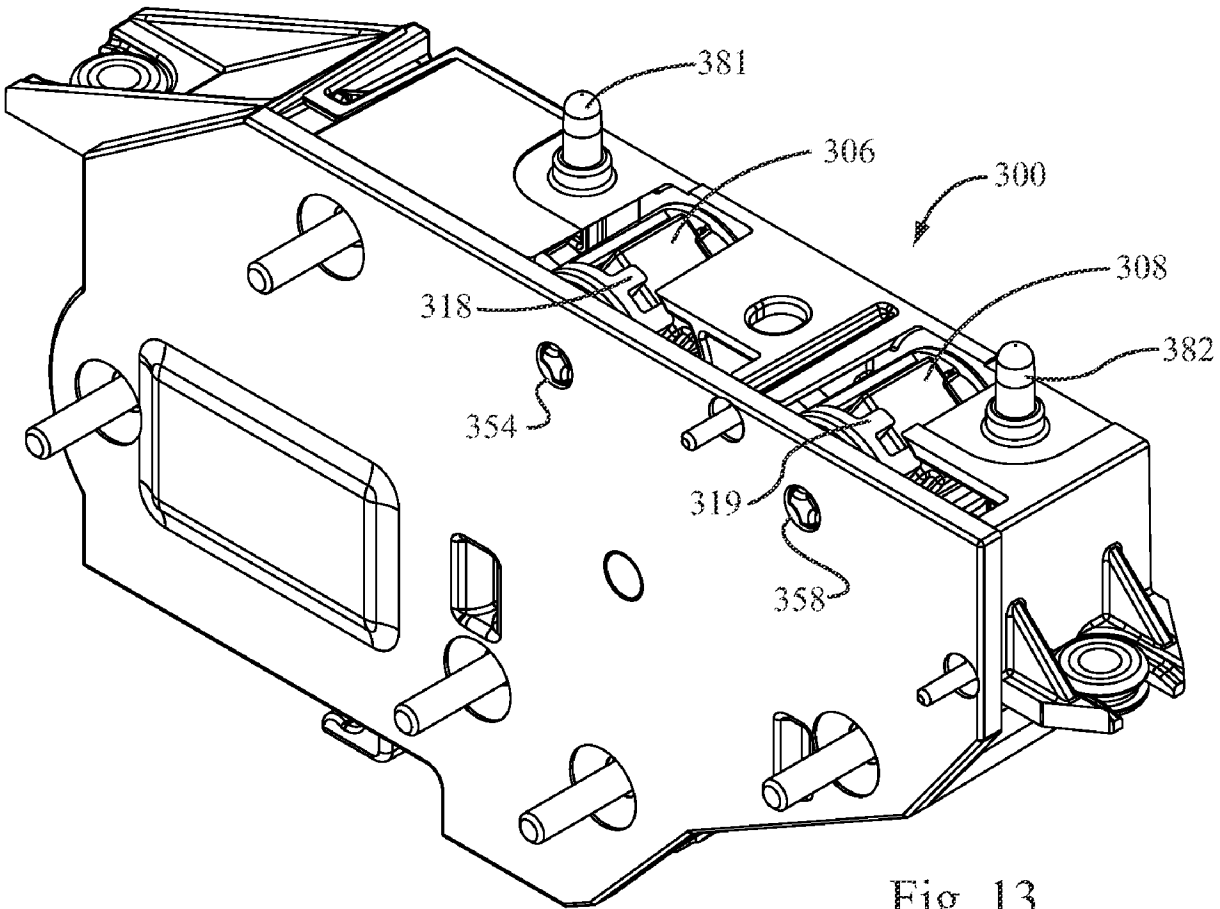
FIGS. 13-19 are views of an embodiment of the magnetic latch mechanism and its components according to the present invention shown in the unlatched configuration.
Figure 14:
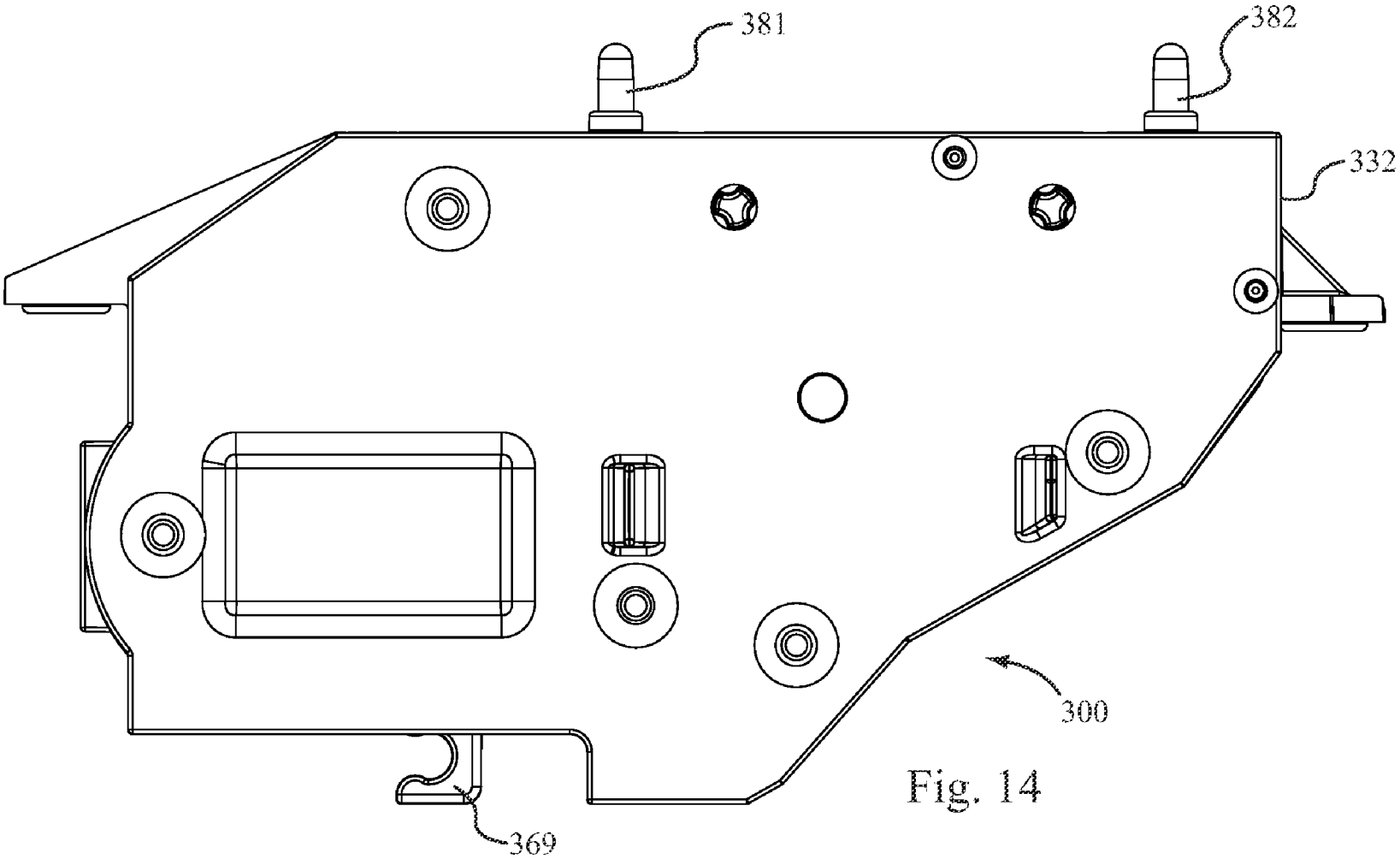
Figure 15:
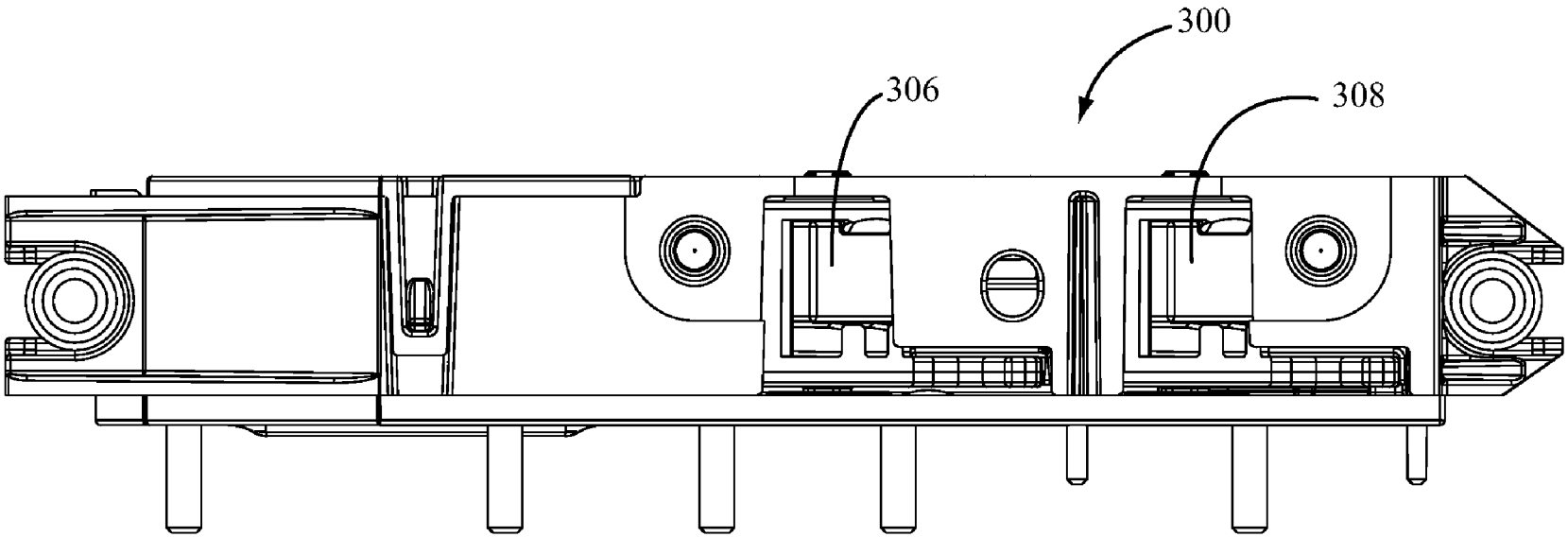
Figure 16:
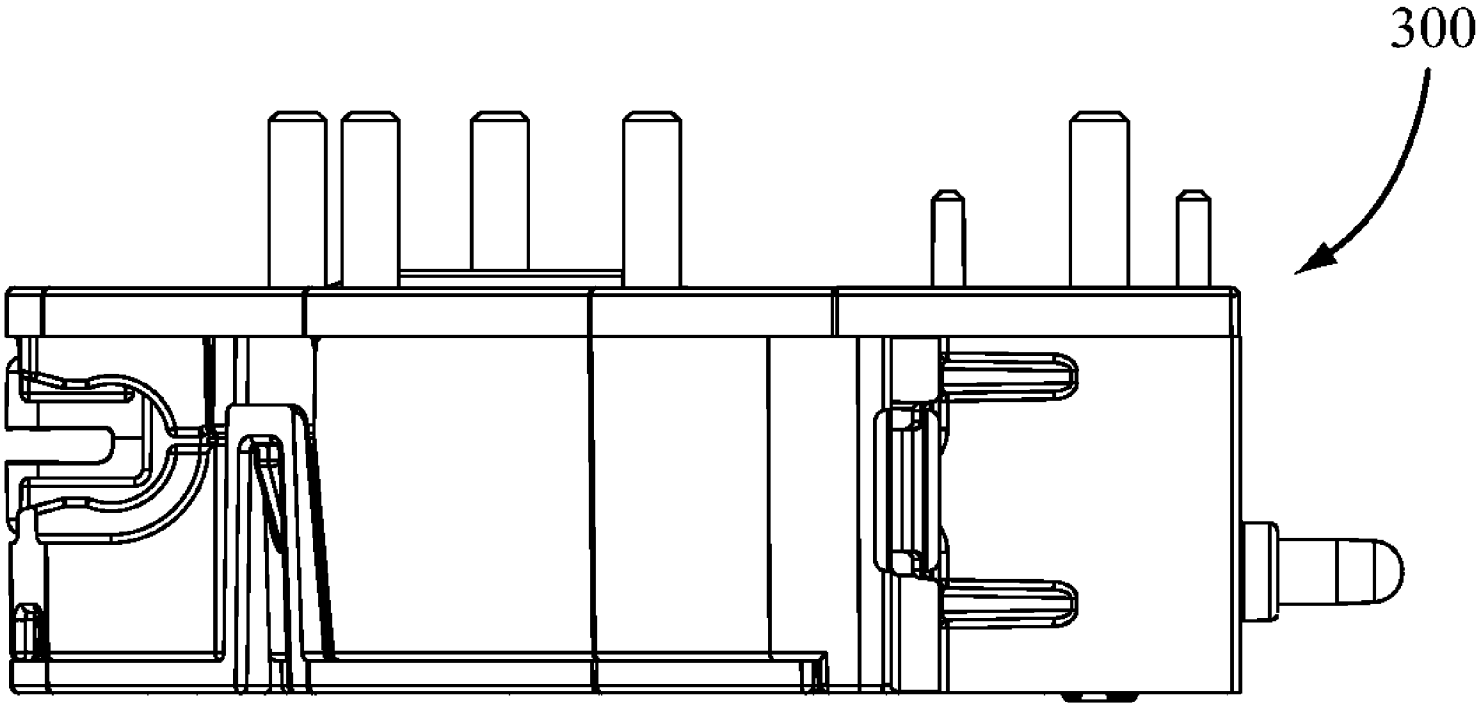
Figure 17:
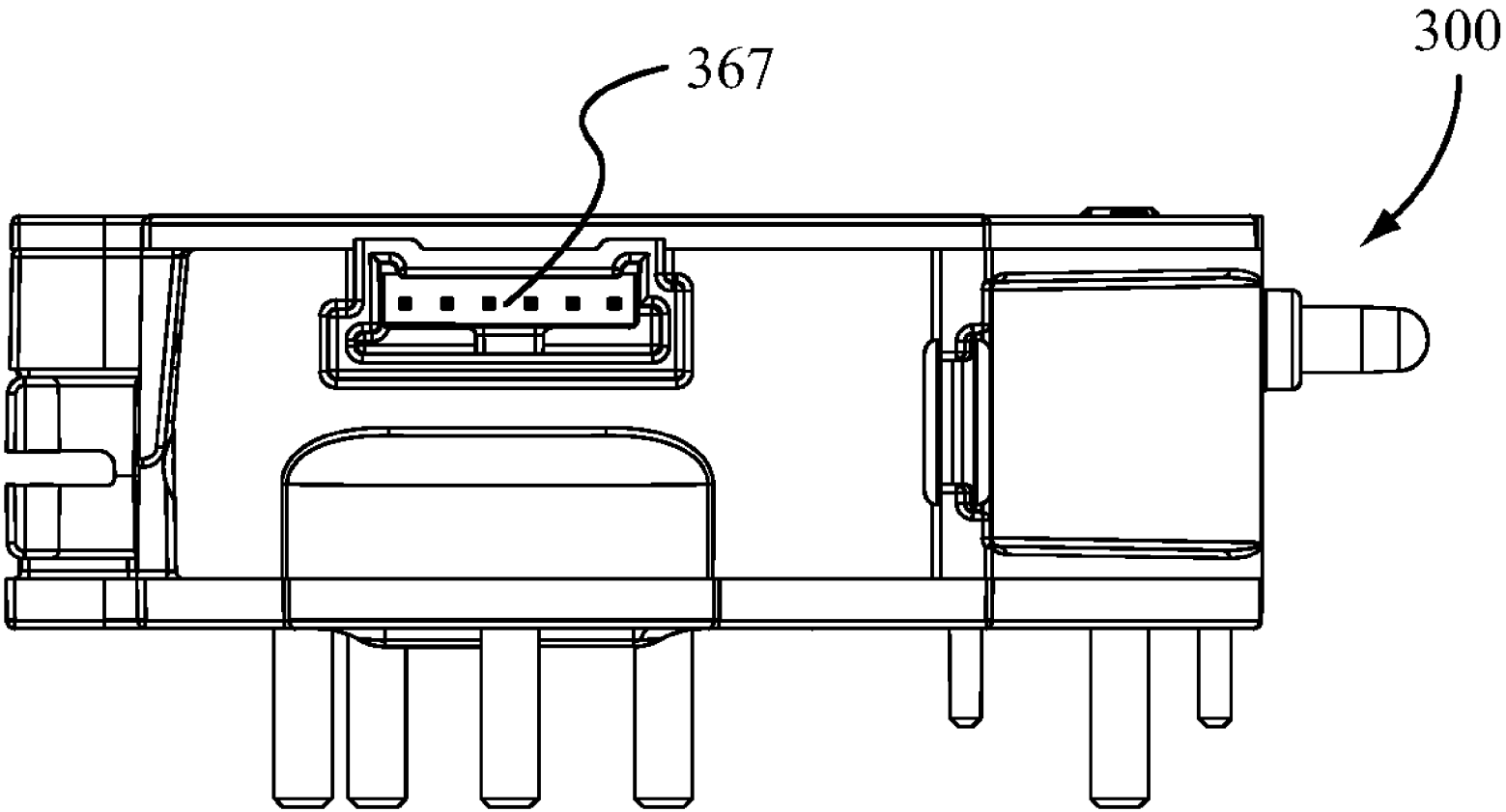
Figure 18:
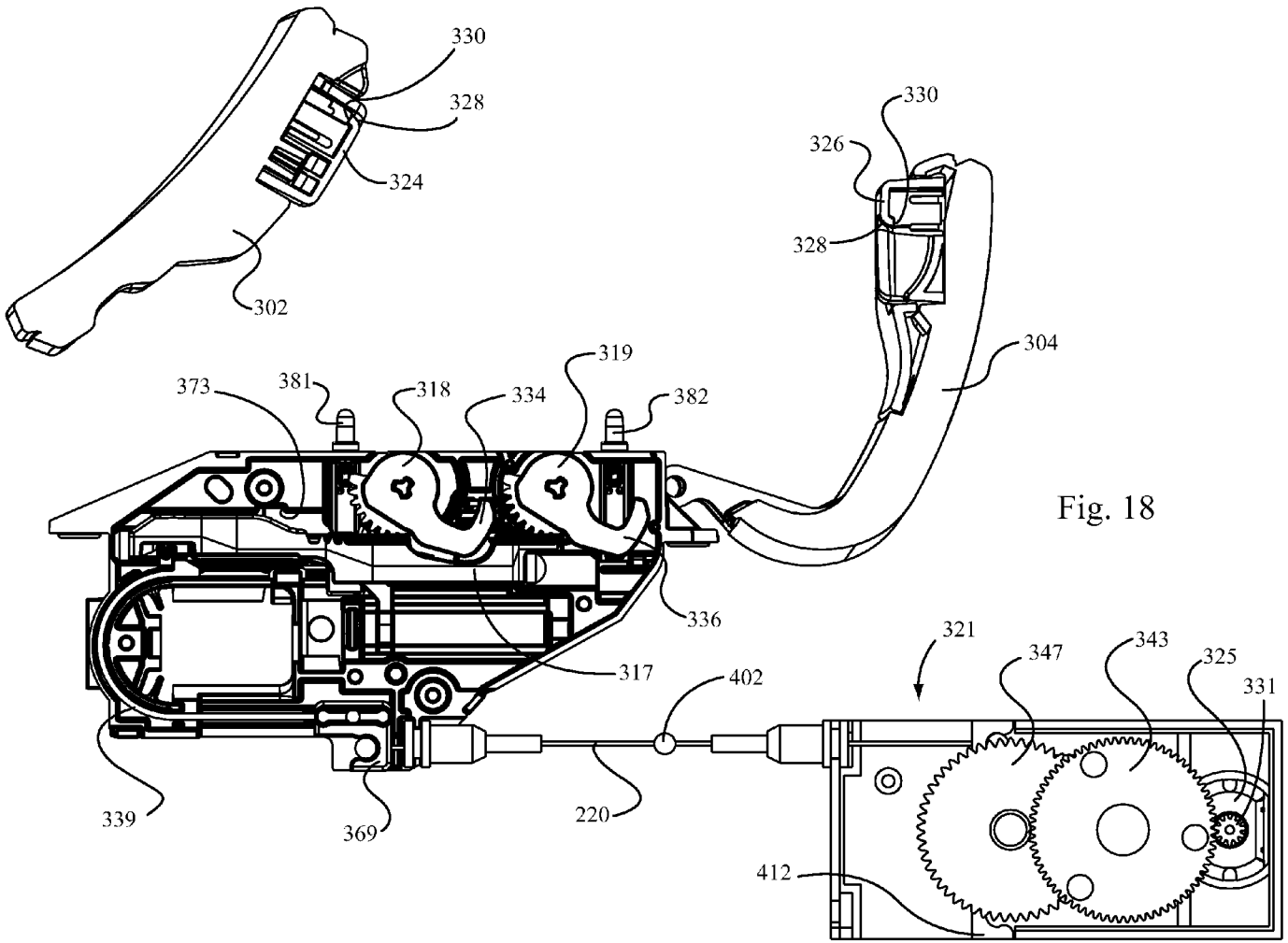
Figure 19:
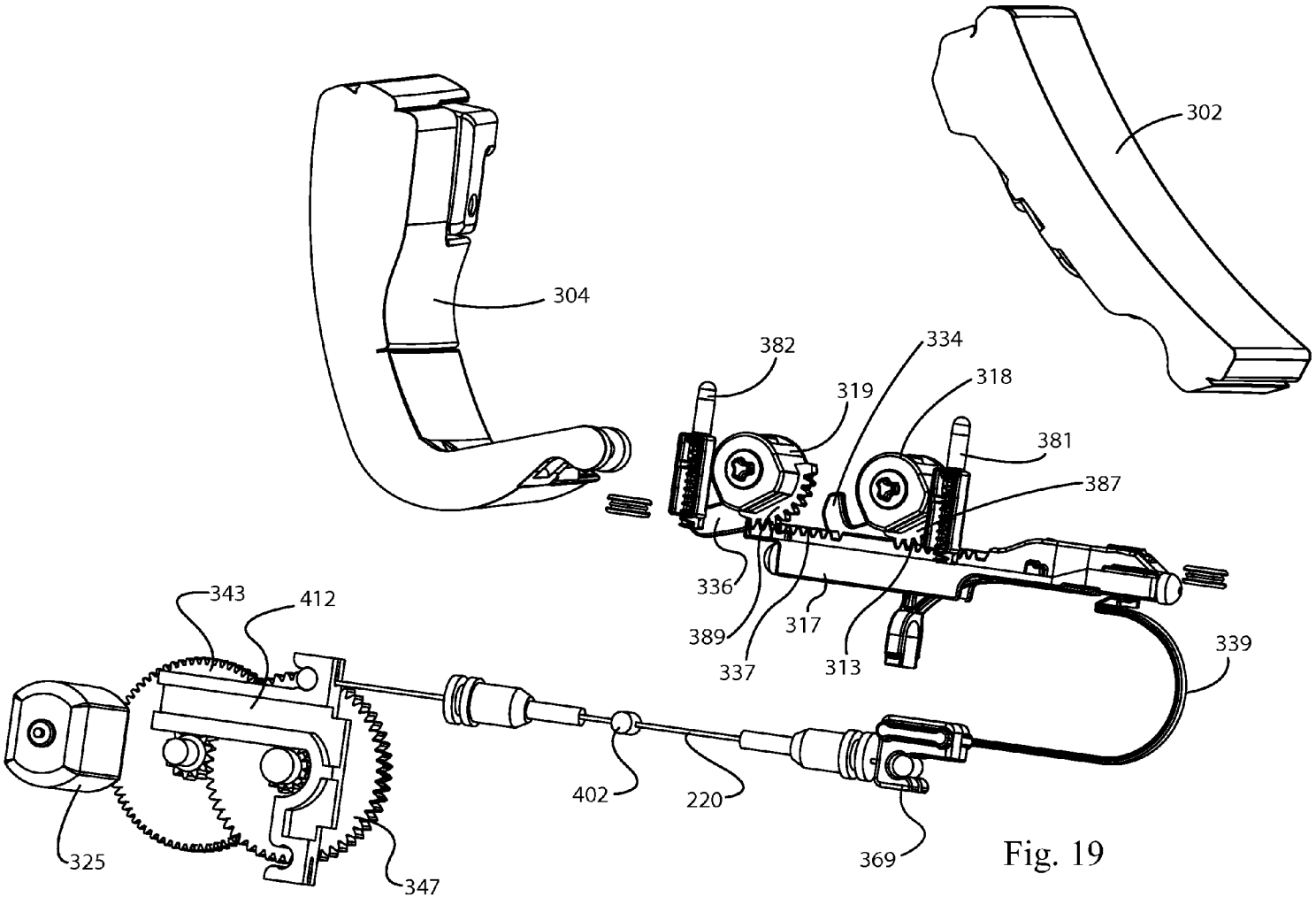

To close the doors 302, 304, one of the doors 302, 304 is pushed closed. This action pulls the other door shut through the mechanical linkage between the doors (not shown), however, one door will sometimes lag behind the other due to the free play of the linkage. Once the doors 302, 304 are almost closed the rotary magnets 306, 308, the magnet carriers 318, 319, and the hook-shaped pawls 334, 336 will begin to rotate toward their latched positions under the influence of the magnetic field of the magnetic inserts 314, 316, such that they will be in a second intermediate position nearer their latched positions. At this point the strong magnetic attraction between the magnetic inserts 314, 316 and their respective rotary magnets 306, 308 causes the lagging door to accelerate such that both doors close simultaneously, and the rotary magnets 306, 308 and the hook-shaped pawls 334, 336 simultaneously rotate to their latched positions. At this point the hook-shaped pawls 334, 336 engage the strikers 324, 326 and there is strong magnetic attraction between the magnetic inserts 314, 316 and their respective rotary magnets 306, 308. Accordingly, both doors are held in the closed position mechanically and magnetically. This condition is illustrated in FIGS. 7-9. Thus, the magnetic latch mechanism 300 provides a latching system that tolerates the free play of the mechanical linkage of the doors 302, 304 and the positional difference between the doors near closing, but still closes the doors simultaneously. In addition, at this time the ball bearing 372 engages the recess 373 in the housing 332 such that the rack bar 317 is locked in place and cannot move unless the sliding bar 315 is moved to the unlocked position.

If the lag between the doors 302, 304 is great enough, one door may close completely, causing both rotary magnets 306, 308 and both hook-shaped pawls 334, 336 to move to their respective latched positions, before the lagging door reaches its closed position. In such an event, the ball bearing 372 would lock the rack bar 317 and consequently the hook-shaped pawls 334, 336 in the latched position. The striker of the lagging door will collide with the top of the respective hook-shaped pawl and the lagging door cannot move to the fully closed position. To prevent this outcome the control pins 381 and 382 are provided. Each of the control pins 381 and 382 is in the form of an elongated shaft 383 having a projecting lug 385 at one end thereof. The control pins 381 and 382 are supported by the housing 332 for rectilinear movement in the direction of the longitudinal axes of the shafts 383 between extended and retracted positions. The control pins 381 and 382 are spring biased toward the extended position by springs 388 and 390, respectively. The strikers 324, 326 are each provided with a portion or pad 391 and 392, respectively, that engage and move the respective control pin 381, 382 to the retracted position when the corresponding door 302, 304 is moved to the fully closed position.

Figure 21:
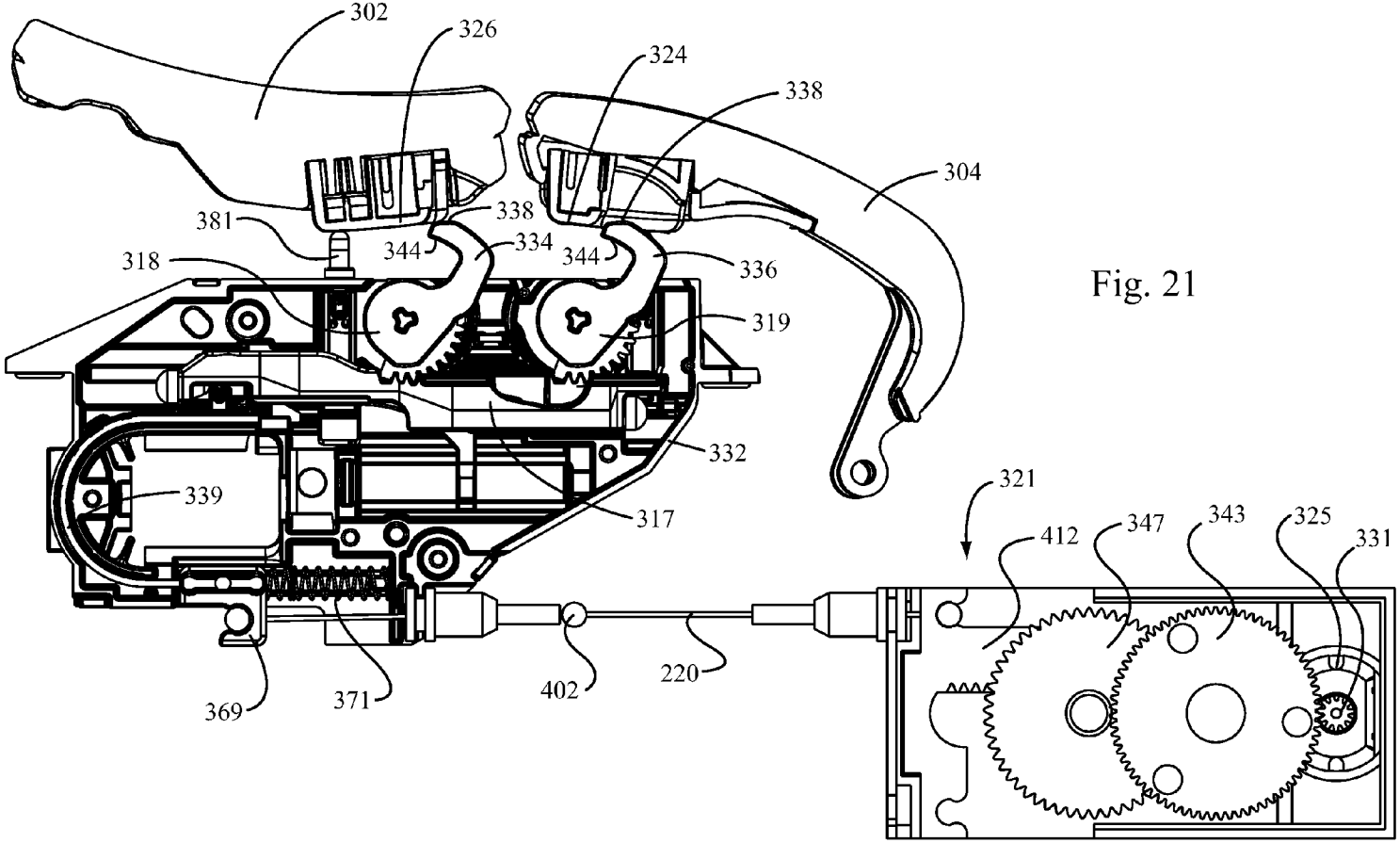
FIGS. 21-22 are views of an embodiment of the magnetic latch mechanism and its components according to the present invention showing the latch mechanism hooks in the second intermediate position during the latching process.
Figure 22:
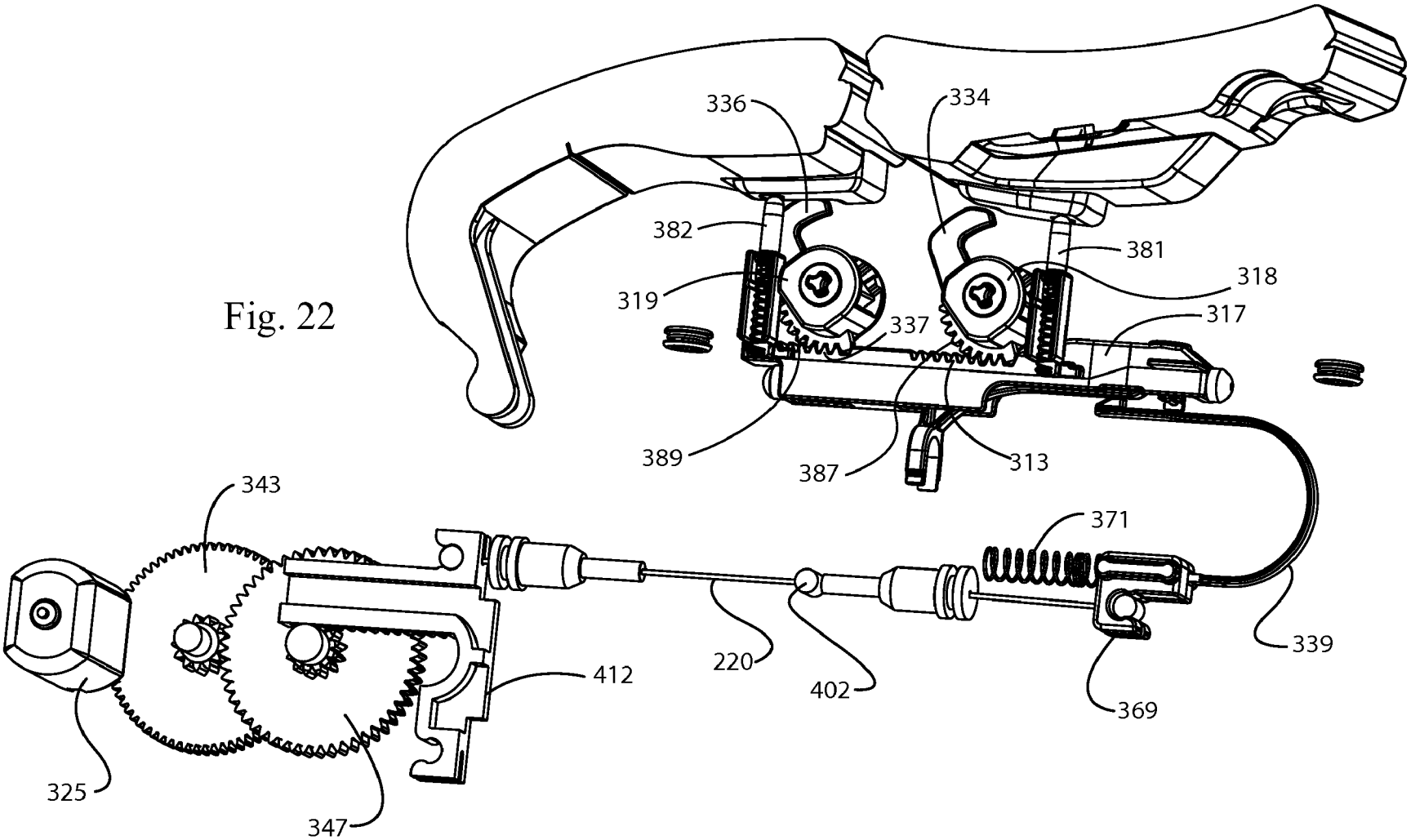
Figure 23:
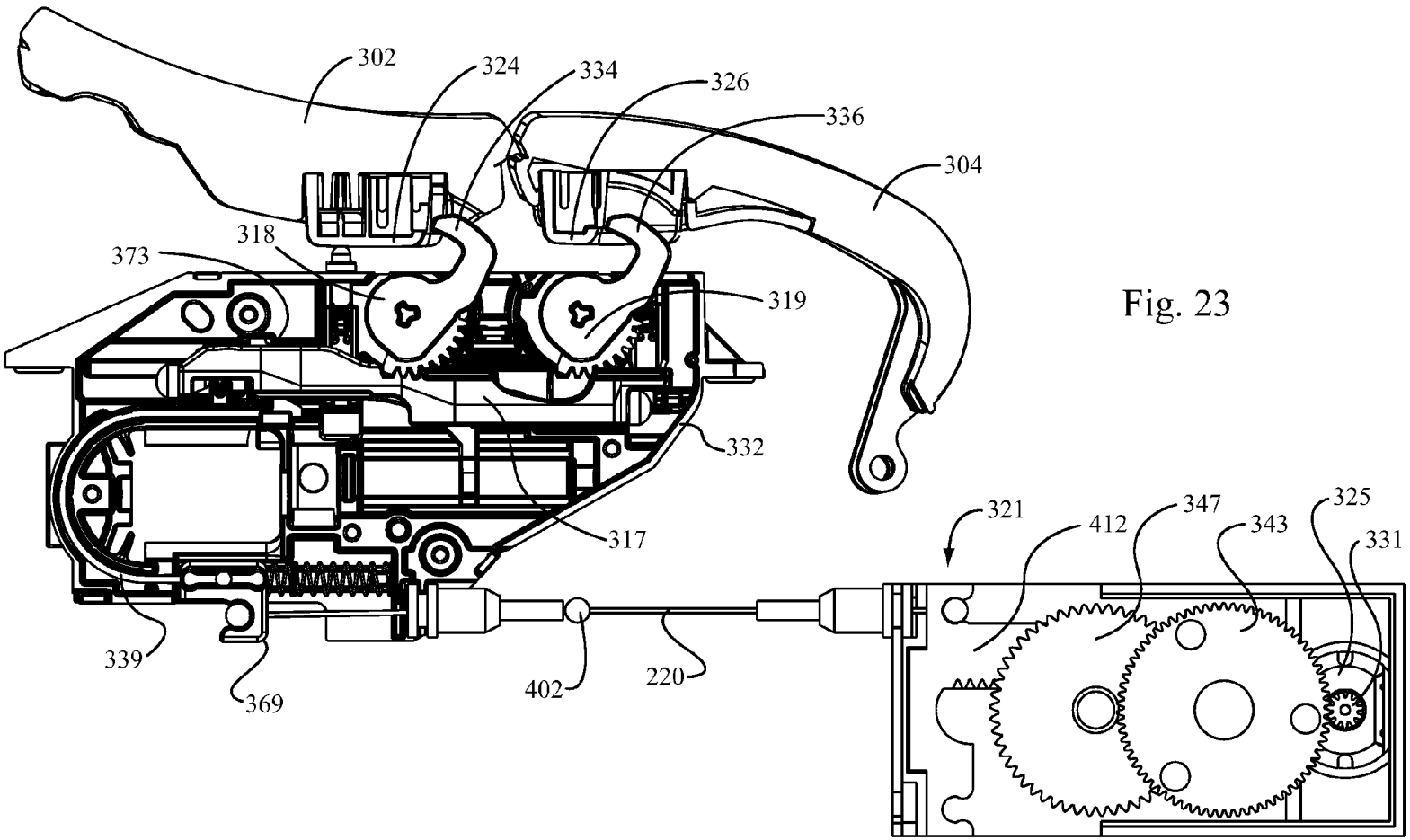
FIG. 23 is an environmental view of an embodiment of the magnetic latch mechanism according to the present invention showing the doors in the closed position and the latch mechanism hooks ready for engagement with the strikers on the doors during the latching process.
Figure 24:
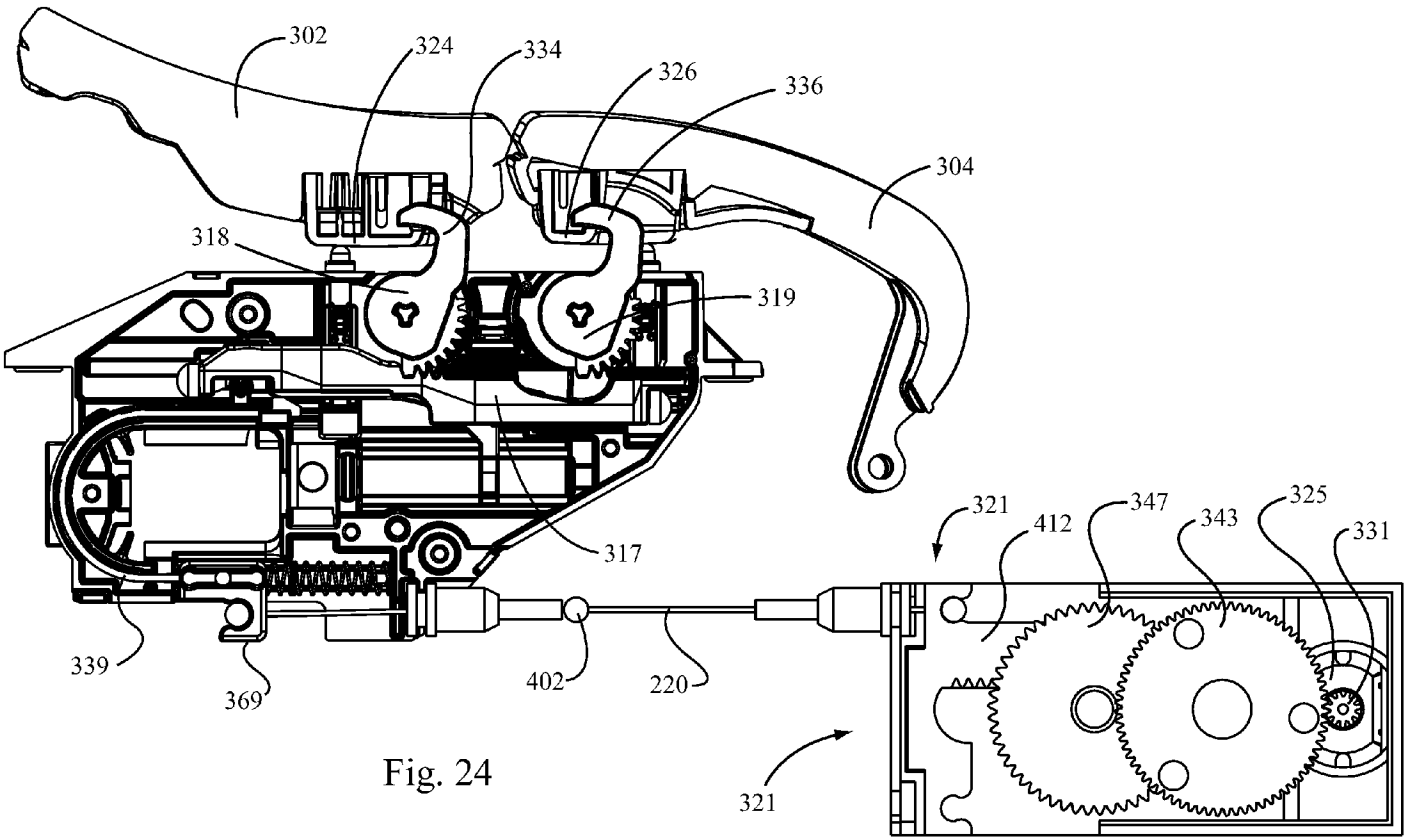
FIGS. 24-26 are views of an embodiment of the magnetic latch mechanism and its components according to the present invention showing the doors in the closed position the latch mechanism hooks engaging the strikers on the doors during the latching process, just before the rack bar is locked in place by the ball bearing.
Figure 25:
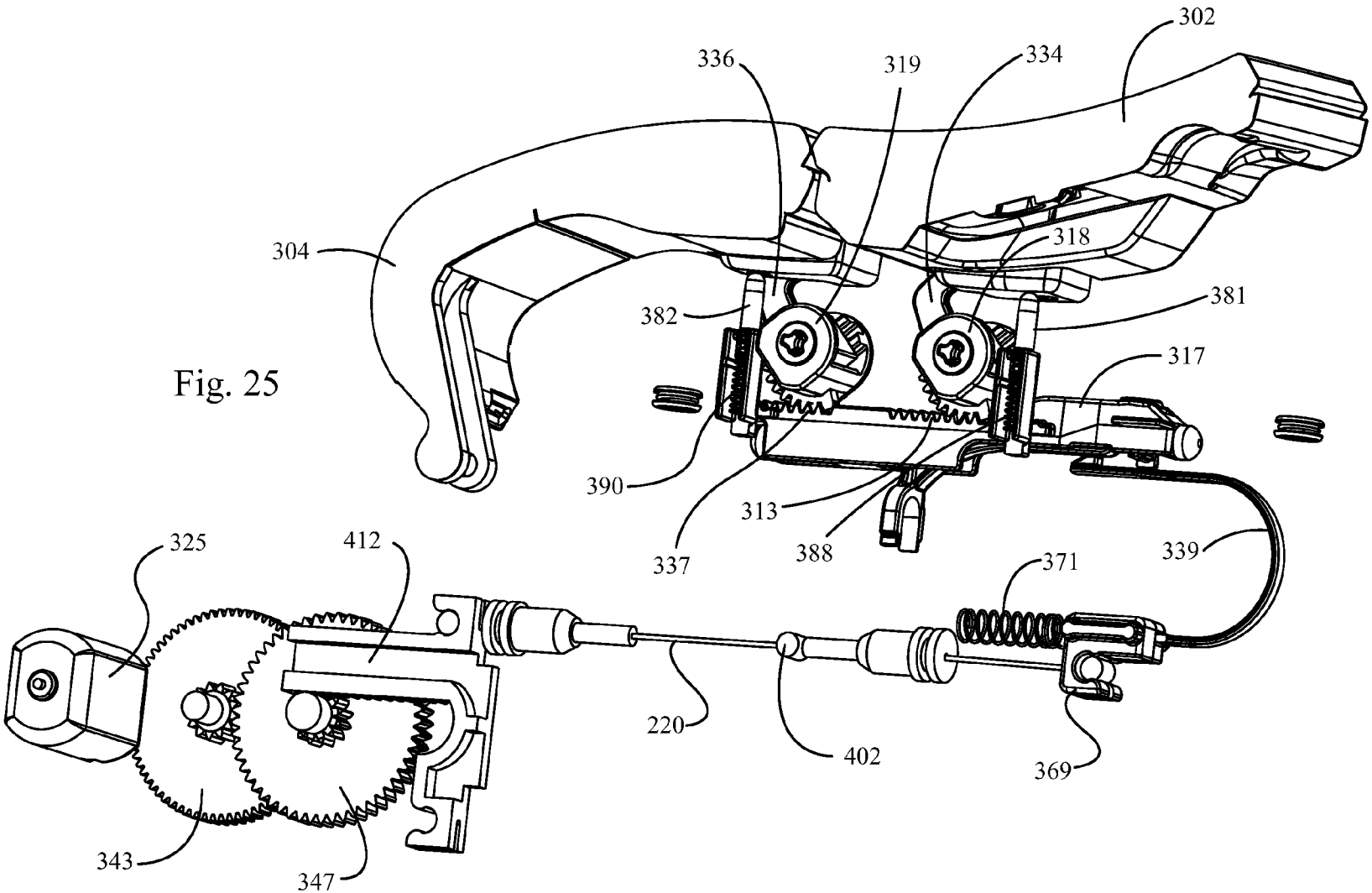
Figure 26:
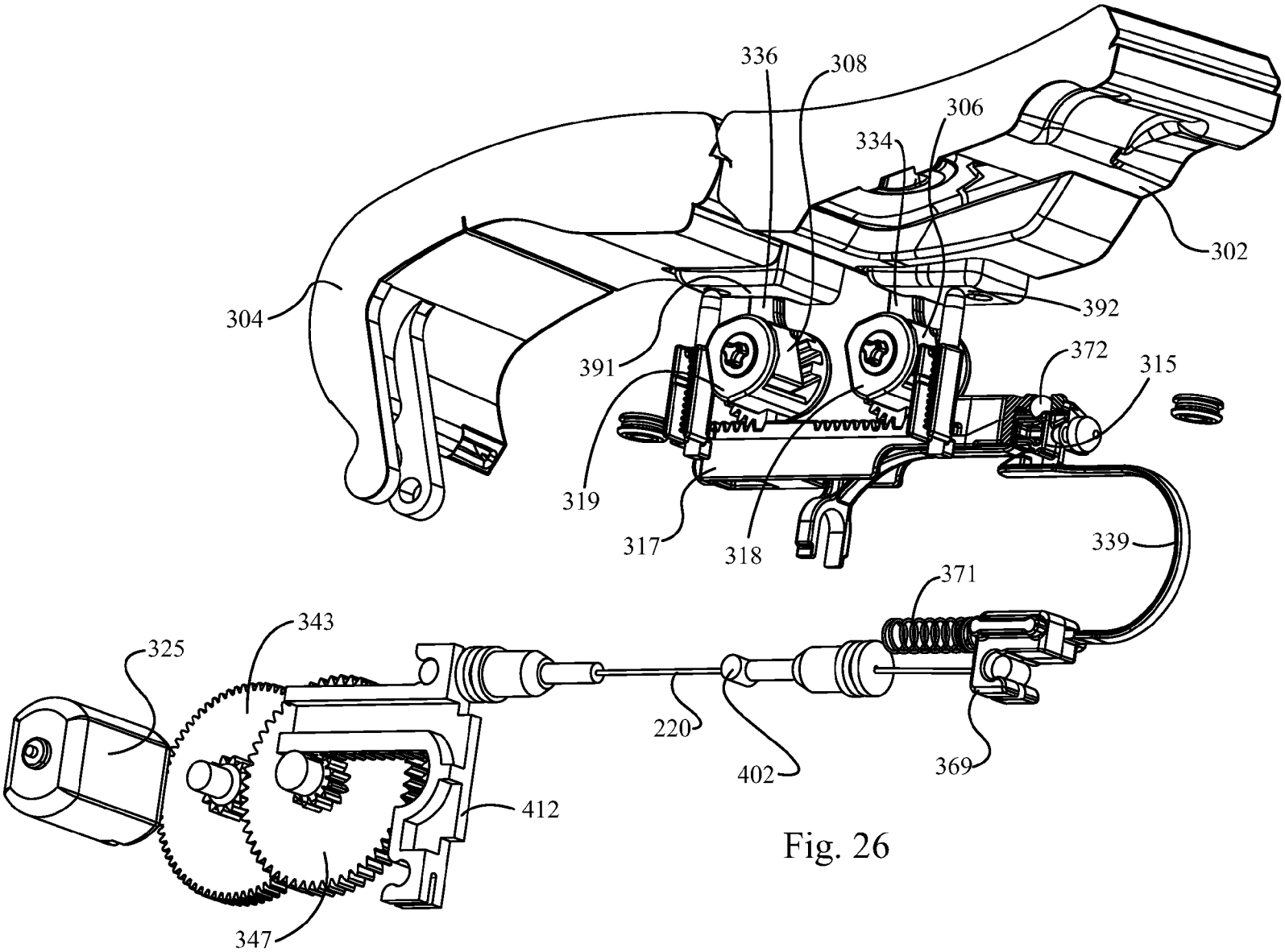
Figure 27:
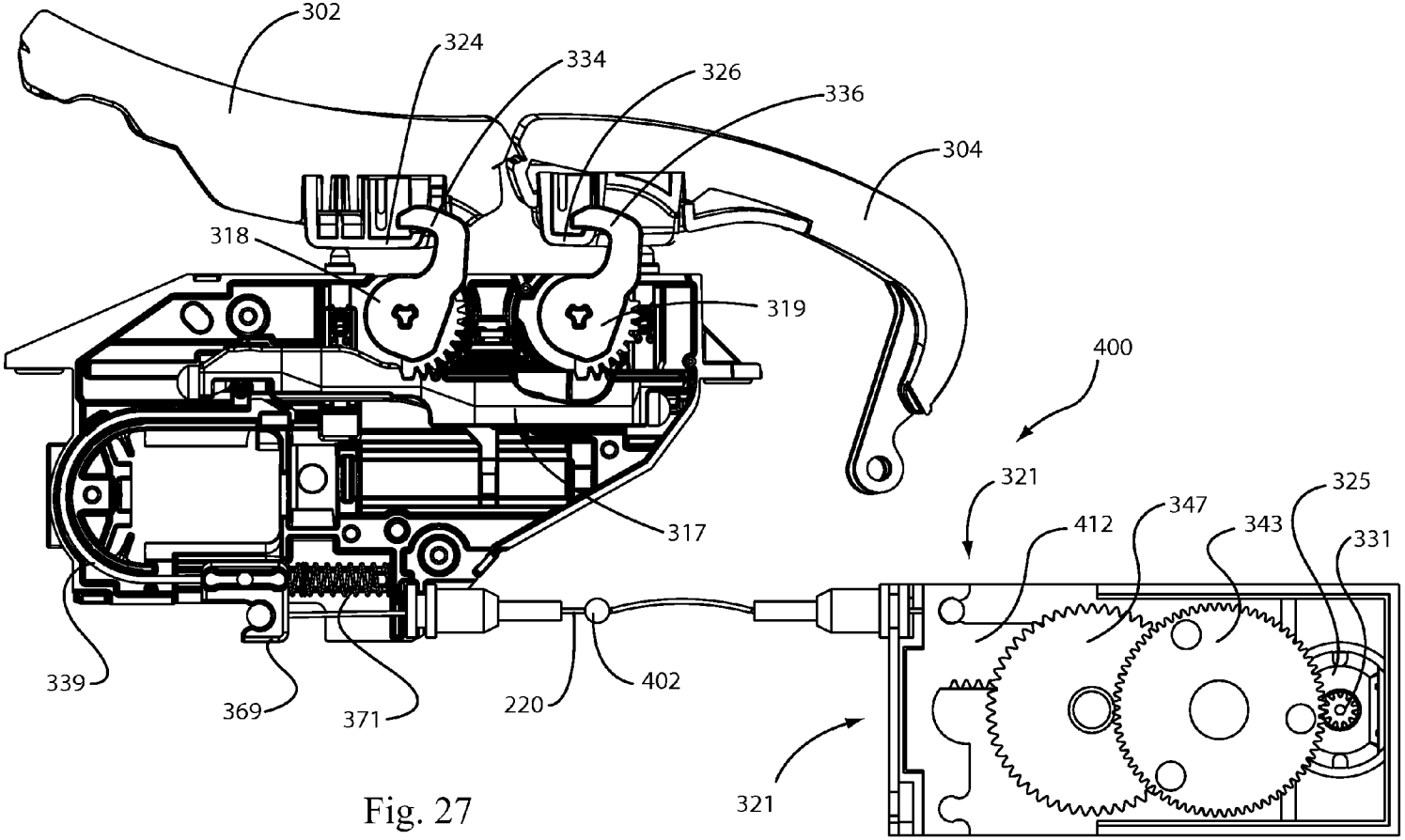
FIGS. 27-28 are views of an embodiment of the magnetic latch mechanism and its components according to the present invention shown after the initiation of the manual unlatching process.
Figure 28:
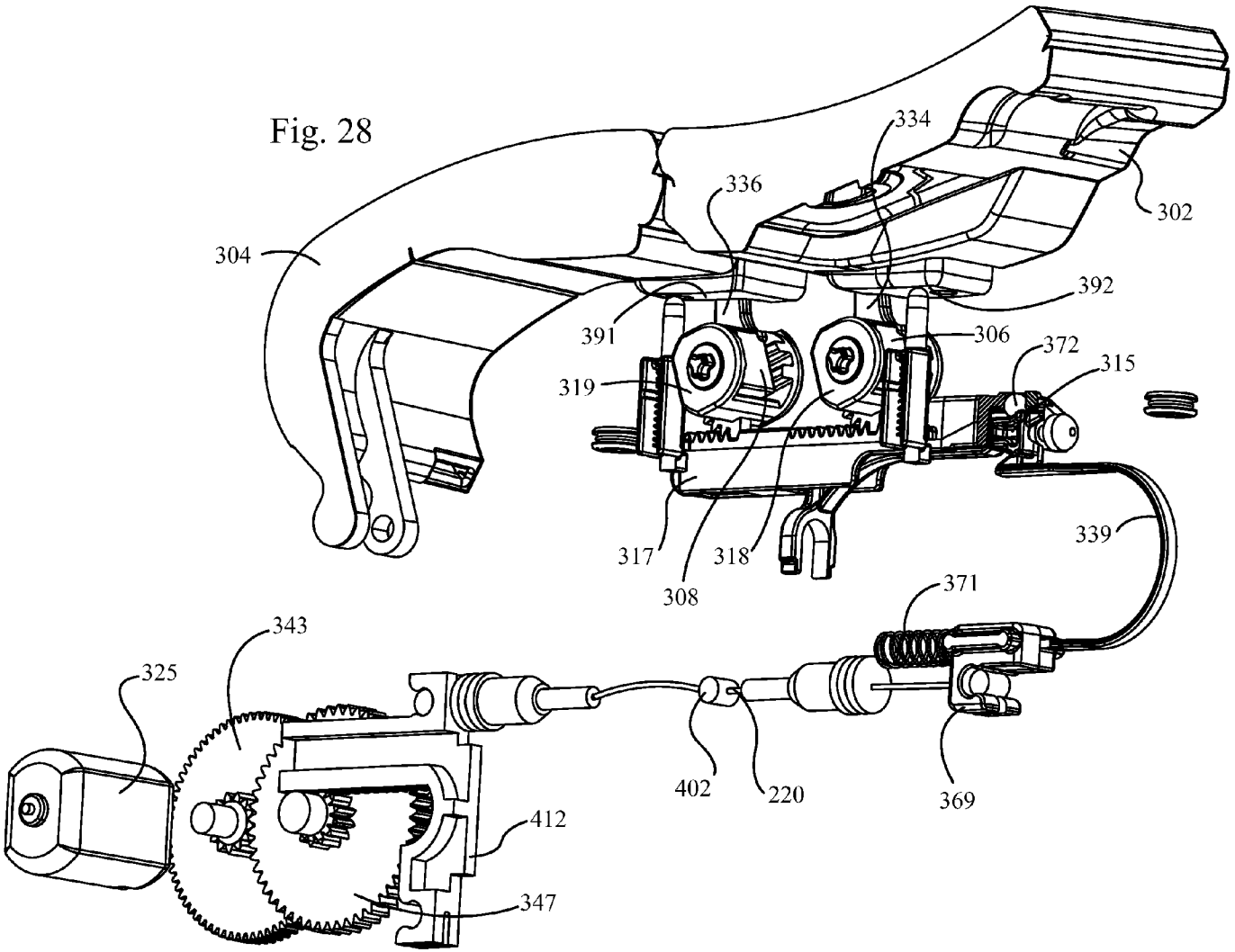
Figure 29:
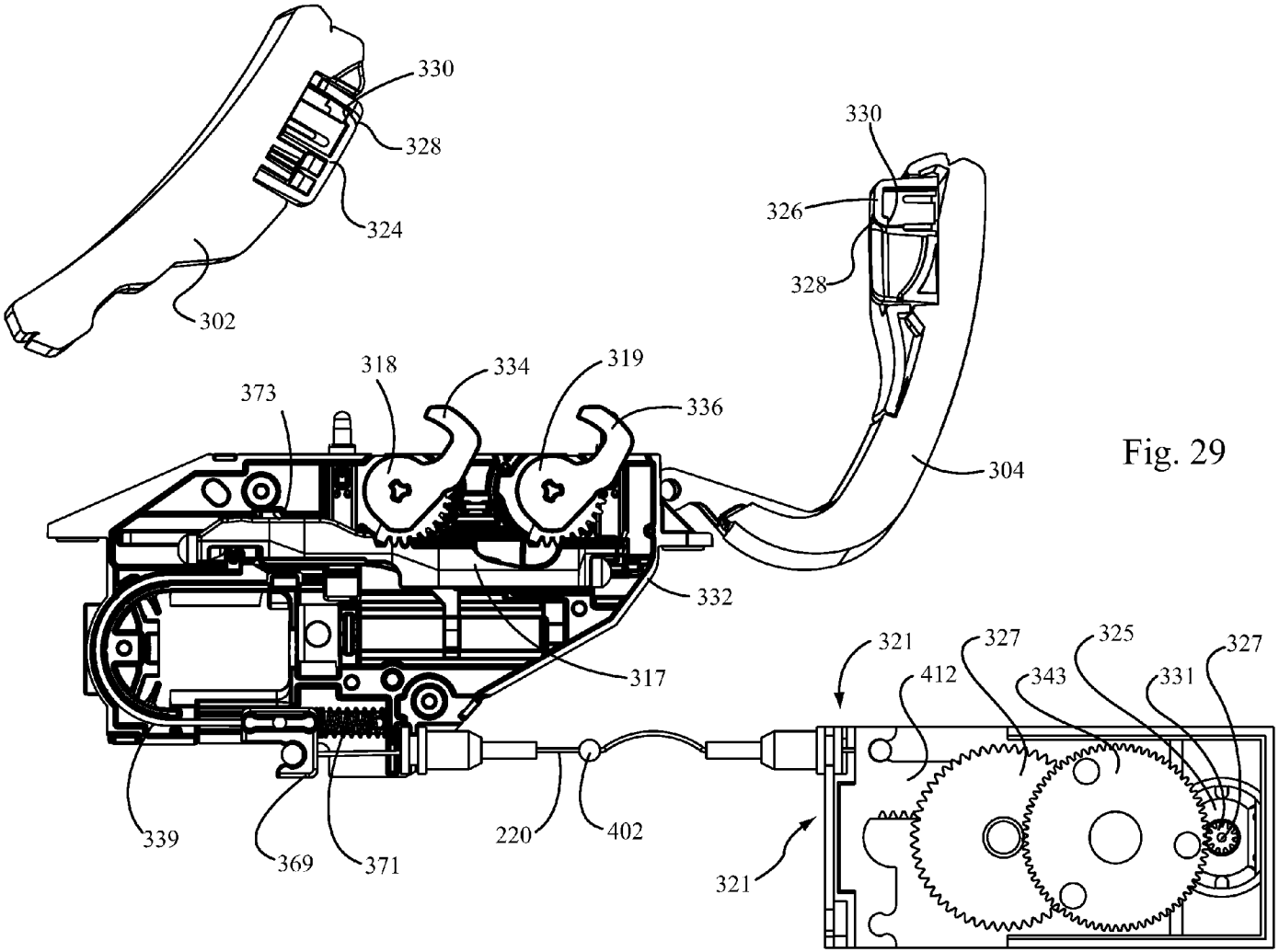
FIGS. 29-30 are views of an embodiment of the magnetic latch mechanism and its components according to the present invention showing the latch mechanism hooks disengaged from the doors initially secured by the latch during the manual unlatching process.
Figure 30:
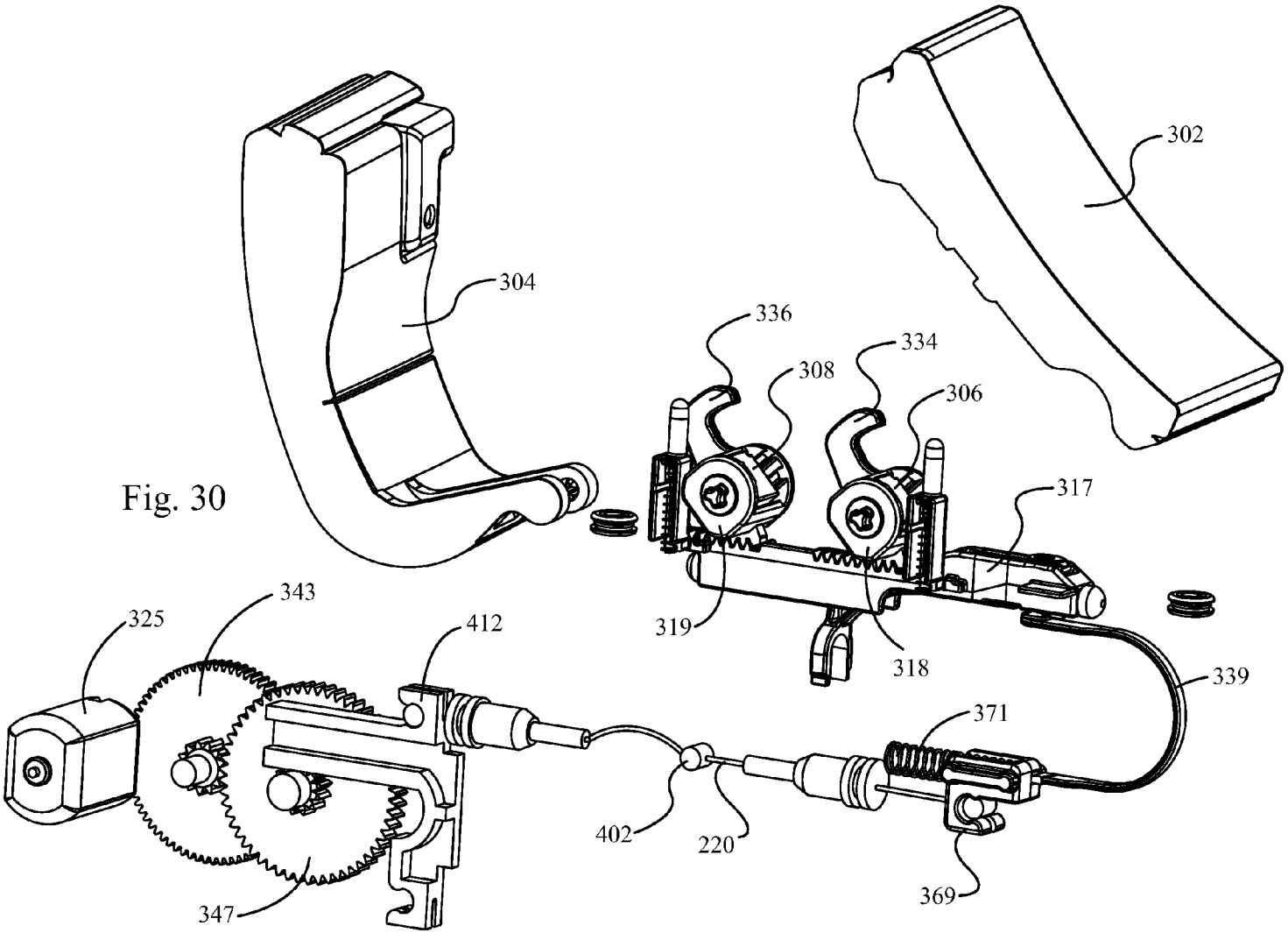

With the control pins 381, 382 in the retracted position, the rack bar 317 is free to move between the latched and unlatched positions. The rack bar 317 is provided with tabs 393 and 395 each of which is engaged by the lug 385 of a respective control pin 381, 382 when the rack bar 317 is in a second intermediate position corresponding to the partially closed configuration of the magnetic latch mechanism and the nearly latched position of the hook-shaped pawls 334, 336 shown in FIGS. 21-22. Each of the tabs 393, 395 has a side that is perpendicular to the direction of the rectilinear motion of the rack bar 317. When either control pin 381, 382 is in the extended position its respective lug 385 is positioned to block the respective tab 393, 395 such that it prevents movement of the rack bar 317 from the second intermediate position, which is near the latched position, to the latched position by engagement of the lug 385 with the side of the tab that is perpendicular to the direction of rectilinear motion of the rack bar 317. Therefore, when either one or both of the doors 302, 304 is out of the fully closed position its respective control pin will prevent movement of the rack bar 317 to the latched position where it can be locked in place by the engagement of the ball bearing 372 with the recess 373, and the situation wherein the striker of the lagging door 302, 304 collides with the corresponding hook-shaped pawl 334, 336 with the rack bar 317 locked in the latched position will be avoided.

In the nearly latched or the second intermediate position the hook-shaped pawls 334, 336 can be pushed out of the way of the strikers 324, 326 as previously described and allow the lagging door to move to the closed position whereupon the control pins 381, 382 will both be in the retracted position and both hook-shaped pawls and rotary magnets can move to their latched positions to secure both doors in the closed position. The leading door will remain closed due to magnetic attraction until the lagging door is fully closed. It should be evident from the relative proportions of the hook-shaped pawls and their respective strikers, that the movement, if any, of the rotary magnets during the closing of the lagging door will be slight enough such that a strong enough attraction exists at all times during the closing of the lagging door between the striker of the lagging door and the respective rotary magnet to accomplish the closing of the lagging door as just described.

Resilient bumpers 434 can be provided at the ends of the rack bar 317 to cushion the impact of the rack bar 317 on the housing 332 to reduce noise and wear resulting from the operation of the magnetic latch mechanism 300.

The magnetic latch mechanism 300 is part of a latching system 400 that also includes a motor drive 321 for selectively pulling the Bowden cable 220 in order to pull the flexible link 339 in order to move the rack bar 317 in the direction of its longitudinal axis from the latched position to the unlatched position. The motor drive 321 includes a housing 401 that has a motor compartment 341. The motor drive 321 is provided to allow the magnetic latch mechanism 300 to be electrically actuated. In some applications it is desirable to provide a manual backup or a manual override to operate the latch mechanism 300 manually, for example, in the event of power failure. For such applications, a cylindrical enlargement 402 is provided intermediate the ends of the Bowden cable 220 such that it can be engaged by a receptacle (not shown) that is similar to receptacle 369 and that can be pulled to release or unlatch the latch mechanism 300 by some manually operated mechanism. It is also possible to arrange for the motor drive to pull on a block supported for rectilinear movement via a separate Bowden cable, while the block has receptacles that engage the remote end of the Bowden cable 220 and one end of a separate manually actuated Bowden cable to thereby allow for both manual and electrical actuation of the latch mechanism 300.

The motor drive 321 includes a motor 325 that has an output shaft 327 that is coupled to and drives the pinion gear 331. The motor drive 321 includes a torque reduction gear train that in turn includes a first gear wheel 343 and a second gear wheel 347. The gear wheels 343 and 347 are rotationally supported by the housing 401. The gear wheel 343 has a large diameter gear 404 and a concentric small diameter gear 406 that rotate together as a unit about a common rotational axis. Similarly, the gear wheel 347 has a large diameter gear 408 and a concentric small diameter gear 410 that rotate together as a unit about a common rotational axis. The axis of rotation of gear wheel 343 is parallel to and spaced apart from the axis of rotation of gear wheel 347. A motor drive bar such as a sliding rack 412 is supported for rectilinear motion by the housing 401 in response to the rotation of the small diameter gear 410. The sliding rack 412 is provided with a set of gear teeth 420 distributed along at least a portion of the length of the sliding rack 412. The set of gear teeth 420 are in constant mesh with the teeth 422 of the small diameter gear 410 of the gear wheel 347. The teeth 424 of the large diameter gear 408 of the gear wheel 347 are in constant mesh with the teeth 426 of the small diameter gear 406 of the gear wheel 343. The teeth 428 of the large diameter gear 404 of the gear wheel 343 are in constant mesh with the teeth 430 of the pinion gear 331. Thus, the sliding rack 412 moves rectilinearly between an extended position and a retracted position relative to the housing 401 in response to the rotation of the pinion gear 331. The torque reduction gear train reduces the torque output required of the motor 325.

The sliding rack 412 is provided with, for example, two receptacles 414, 416 each of which is adapted for engagement with the cylindrical enlargement at an end of a Bowden cable such as enlargement 418. This feature allows multiple latch mechanisms 300 to be operated by a single motor drive 321. In the illustrated example, two identical magnetic latch mechanisms 300 and 300*a* are operated by a single motor drive 321. Multiple latch mechanisms are desirable in certain applications where the doors secured by the latch mechanisms should be secured at multiple points. For example, in an automotive glove box that is secured by double doors, two magnetic latch mechanisms can be provided on either side of the glove box compartment.

Similar to the receptacle 369, each of the receptacles 414, 416 has an opening 432 at one end and a slot 433 extending down one side and at least partway through the bottom of each receptacle 414, 416. The slot 433 extends along the length of the receptacle 369 from the open end 432 of each receptacle 414, 416 to the bottom of each receptacle 414, 416 and along at least a substantial portion of the bottom of the receptacle opposite the opening 432. The slot 433 is wide enough to allow a Bowden cable, for example Bowden cable 220, to extend through the slot 433, but the slot 433 is not large enough for the cylindrical enlargement, such as for example cylindrical enlargement 418, to be pulled through the slot 433. As with enlargement 209, the cylindrical enlargement 418 may have any other shape and size such that it will not fit through the slot 433 but that it will fit into the receptacle 414 or 416. In the illustrated embodiment, the opening 432 of each receptacle 414, 416 is smaller than the diameter of the cylindrical enlargement 418, such that the cylindrical enlargement 418 is securely held in the receptacle 414 or 416 after the cylindrical enlargement 418 is snapped into the receptacle 414 or 416.

With the rack bar 317 in the latched position and the sliding bar 315 in the locked position the sliding rack 412 will be positioned in the extended position illustrated in FIGS. 121-132. When the motor 325 is energized it causes rotation of the pinion gear 331 in a first direction. Rotation of the pinion gear 331 in this first direction causes rectilinear motion of the sliding rack 412 from the extended position toward the retracted position illustrated in FIGS. 109-120. Continued rotation of the pinion gear 331 will cause continued rectilinear motion of the sliding rack 412 toward the motor 325, which in turn will cause the rectilinear movement of the sliding bar 315 from the locked position to the unlocked position via the Bowden cable 220 and the flexible link 339. This initial movement of the sliding bar 315 frees the rack bar 317 for movement to the unlatched position. The range of motion of the sliding bar 315 from the locked position to the unlocked position is relatively limited, and further rotation of the pinion gear 331 will cause continued rectilinear motion of the sliding rack 412 toward the motor 325, which in turn will cause the rectilinear movement of both the sliding bar 315 and the rack bar 317 together such that the rack bar 317 is moved from the latched position to the unlatched position. Consequently, the rotary magnets 306, 308, magnet carriers 318, 319, and hook-shaped pawls 334, 336 are caused to rotate from their latched positions, assuming them to initially be in the latched position, to their unlatched positions. The sliding rack 412 will then be in its retracted position illustrated in FIGS. 109-120. Movement of the rack bar 317 and the magnet carriers 318, 319 to their unlatched positions in turn allows opening of the doors 302, 304.

Once the unlatching operation is complete, using appropriate control circuitry and software, the current to the motor 325 is reversed to rotate the pinion gear 331 in a second direction that is the reverse of the first direction and returns the sliding rack 412 to its extended position ready to repeat the unlatching cycle again after the doors 302, 304 are once again closed. Returning the sliding rack 412 to its extended position, disengages the flexible link 339 from the sliding bar 315, and the magnetic attraction of the north pole of one of the magnets 306, 308 for the south pole of the other one of the magnets 306, 308, or vice versa, will maintain the rotary magnets 306, 308, the magnet carriers 318, 319, and the hook-shaped pawls 334, 336 in the first intermediate positions shown in FIG. 20 ready for latching the doors 302, 304 as the doors 302, 304 move to the closed position.

Also as previously described, once the doors 302, 304 are opened, the attraction between the opposite poles of the magnets 306, 308 will maintain the magnet carriers 318, 319 near their unlatched positions, i.e. in their first intermediate positions, until the doors 302, 304 are once again moved toward their closed positions. The latch 300 will thus be ready to repeat its operating cycle the next time the doors 302, 304 are moved toward their closed positions.

A fin 397 is provided that projects from one side of the rack bar 317. In addition, sensors 399, 361 are provided on the circuit board 363 that is supported by the housing 332. The sensors 399, 361 may, for example, be of a type having a light emitting diode (LED) illuminating a photo-diode. When the rack bar 317 is in the second intermediate position, i.e. the position nearer the latched position where its movement toward the latched position may be prevented by one of the control pins 381, 382 being in the extended position, the fin 397 interrupts the illumination of the photo-diode of one of the sensors 399, 361 by the corresponding LED (not shown) such that a signal indicative of a fault condition corresponding to one of the control pins being in the extended position would be generated. This signal would in turn correspond to one of the doors 302, 304 not being properly closed, for example, due to the contents of the glove box obstructing the movement of one of the doors to the closed position. The signal is supplied to the control circuit or printed circuit board (PCB) 363 controlling the operation of the magnetic latch mechanism. The control circuit is microprocessor based and is programmable. The control circuit can be programmed such that if the signal indicating that one of the doors 302, 304 is ajar persists for a time period that equals or exceeds a predetermined time limit, then the control circuit energizes the motor 325 to open the doors 302, 304, thus prompting the user, i.e. the occupant of the vehicle, to close the doors again and ensure that this time the doors are closed properly.

Wires or other types of electrical connections (not shown), such as for example prongs that plug into the motor, can be provided in the motor drive housing 401 to supply power to the motor 325 under the control of circuit board 363. The circuit board 363 also carries a jack 367 for connection of power supply and signal lines.

When the rack bar 317 is in the latched position, the fin 397 interrupts the illumination of the photo-diode of both of the sensors 399, 361 by their corresponding LEDs such that a signal indicative of the doors 302, 304 being closed would be generated. This signal will cause the circuit board 363 to enter a sleep mode until receiving the next signal to open the doors.

When the rack bar 317 is in the unlatched position, the illumination of the photo-diode of neither of the sensors 399, 361 by their corresponding LEDs is interrupted by the fin 397, which generates a signal indicative of the doors 302, 304 being open. The circuit board 363 remains active and keeps the compartment light on until the doors are closed. After a power failure with the doors open, the circuit board 363 turns on the compartment light after powering on.

Figure 31:
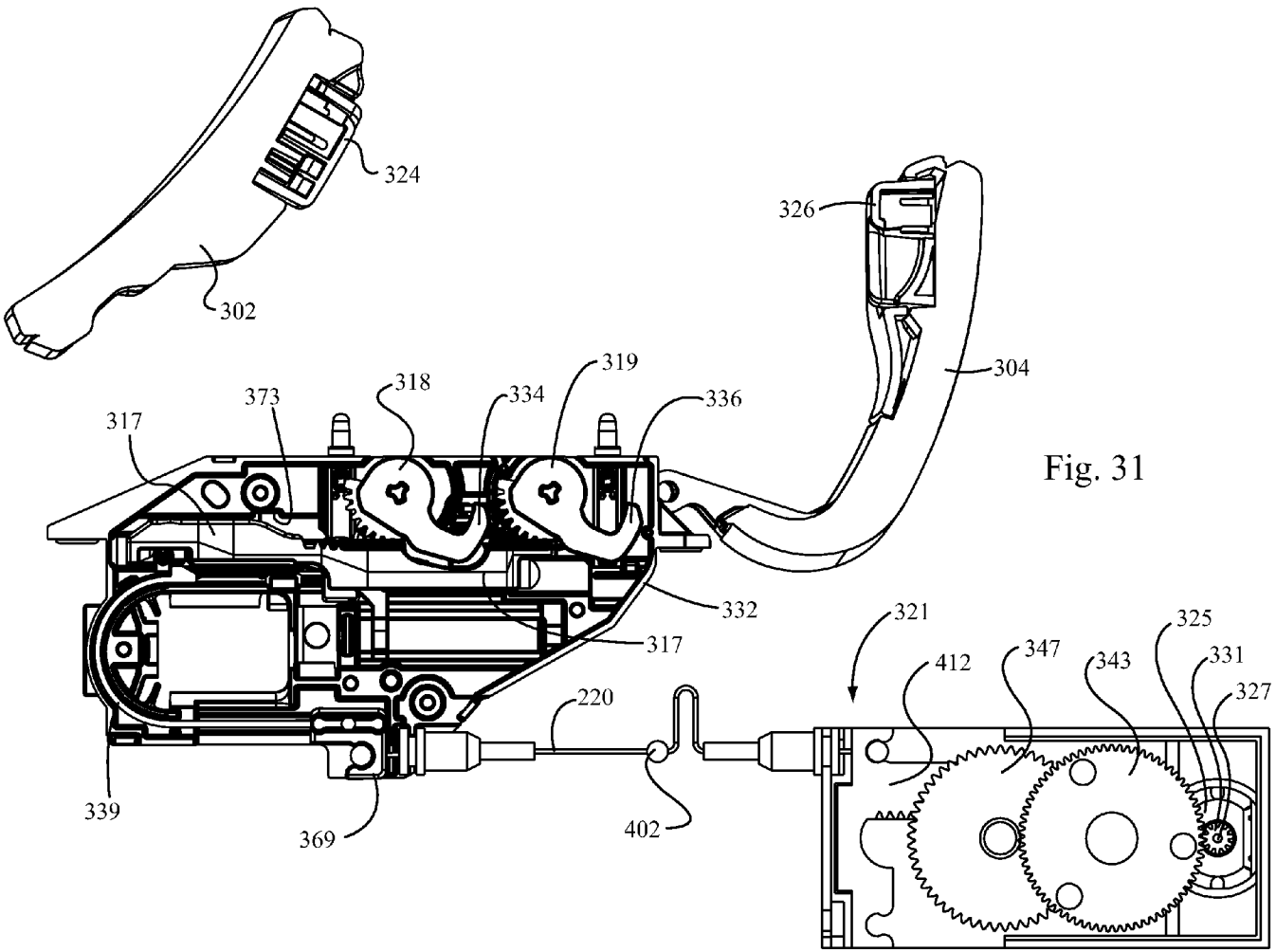
FIGS. 31-32 are views of an embodiment of the magnetic latch mechanism and its components according to the present invention shown in the unlatched configuration at the end of the manual unlatching process.
Figure 32:
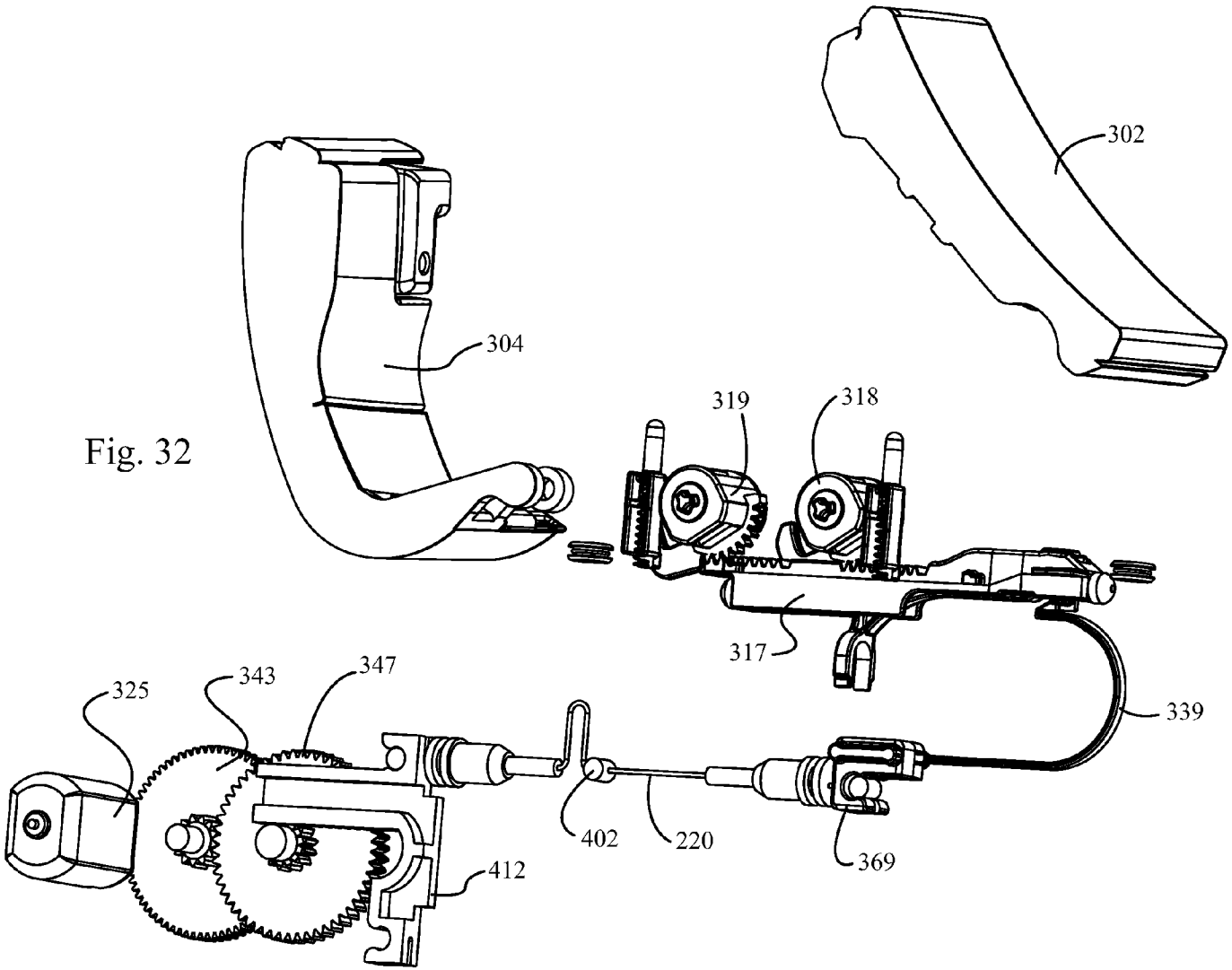
Figure 33:
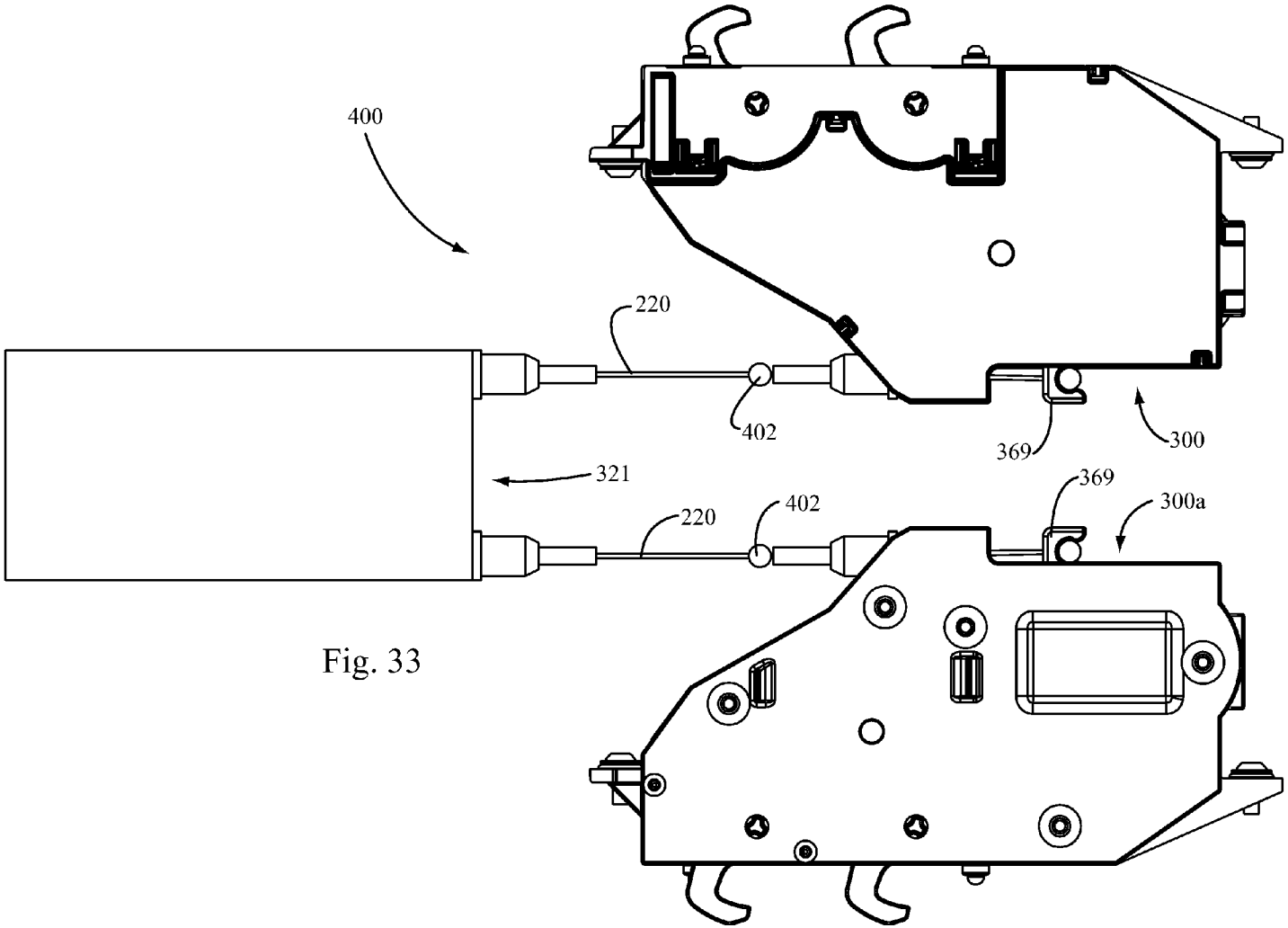
FIG. 33 shows a latching system of the present invention using two magnetic latch mechanisms according to the present invention actuated by a common remotely located motor drive.
Figure 34:
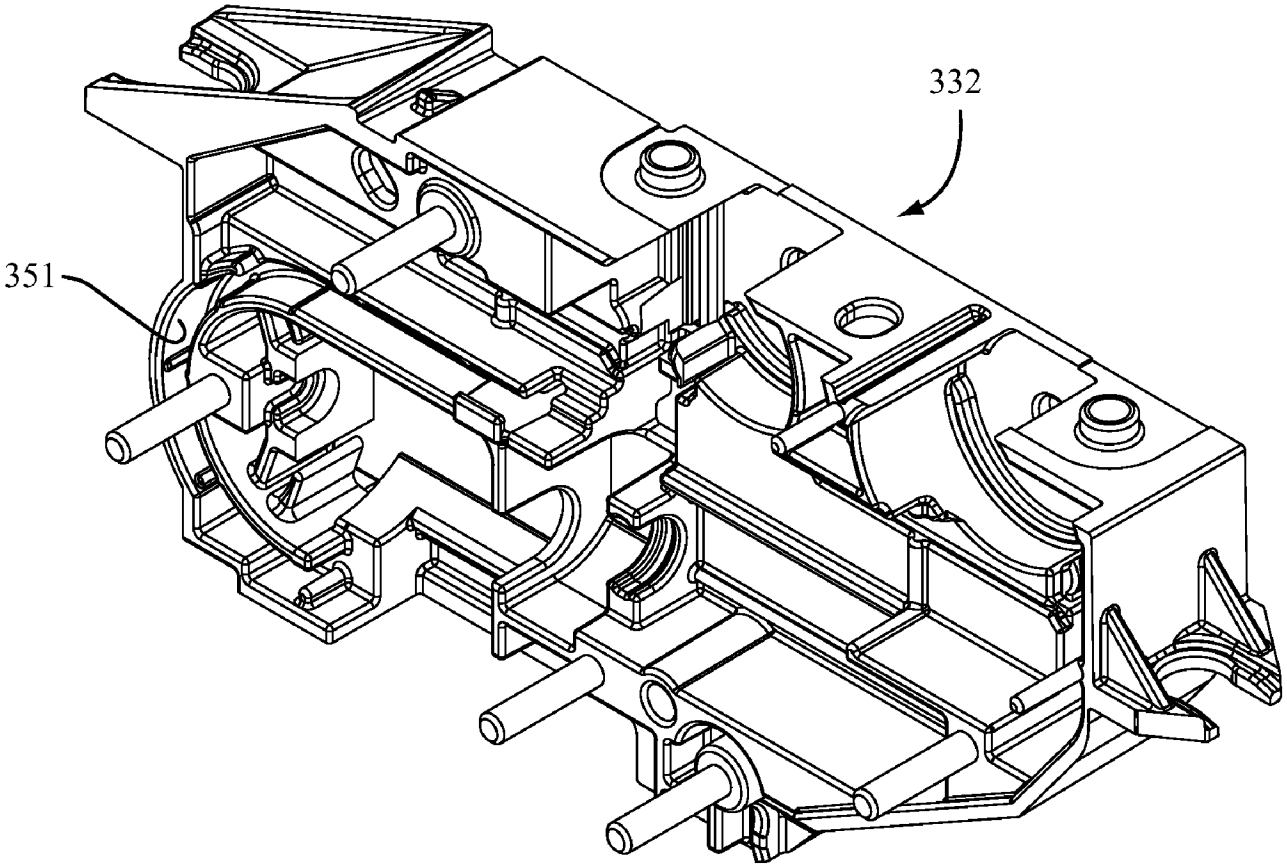
FIGS. 34-35 are views of the housing of an embodiment of the magnetic latch mechanism according to the present invention.
Figure 35:
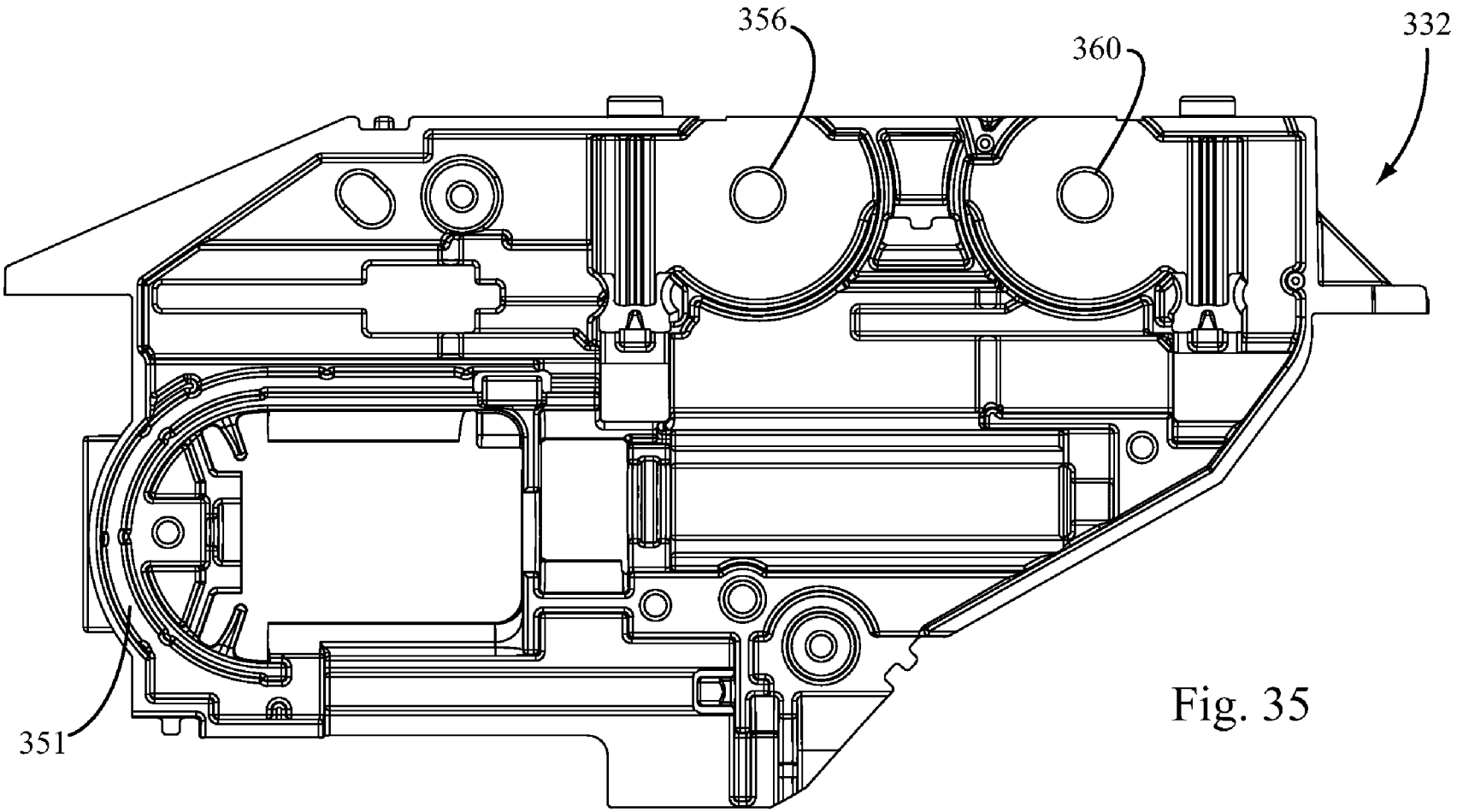
Figure 43:
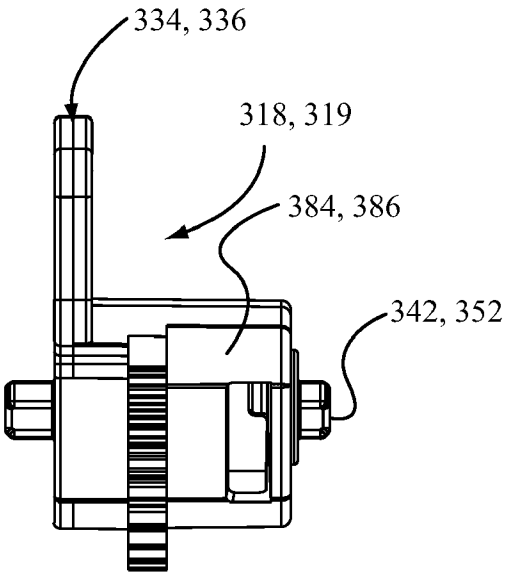
FIGS. 41-46 are views of the rotary magnet carriers and hooks of an embodiment of the magnetic latch mechanism of the present invention, shown in isolation.
Figure 42:
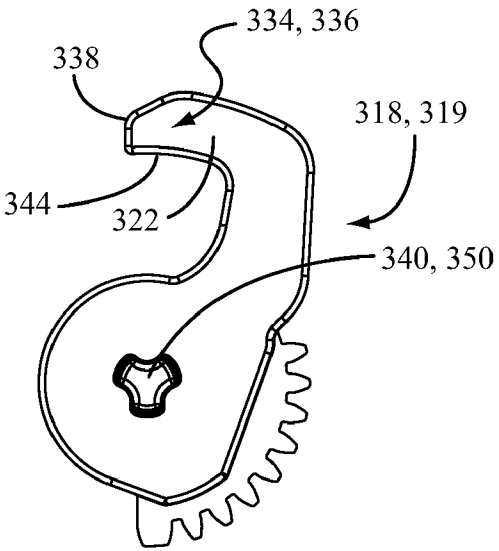
Figure 41:
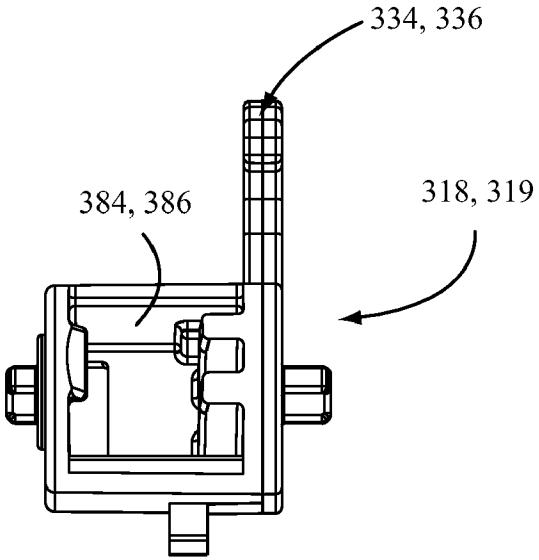
Figure 45:
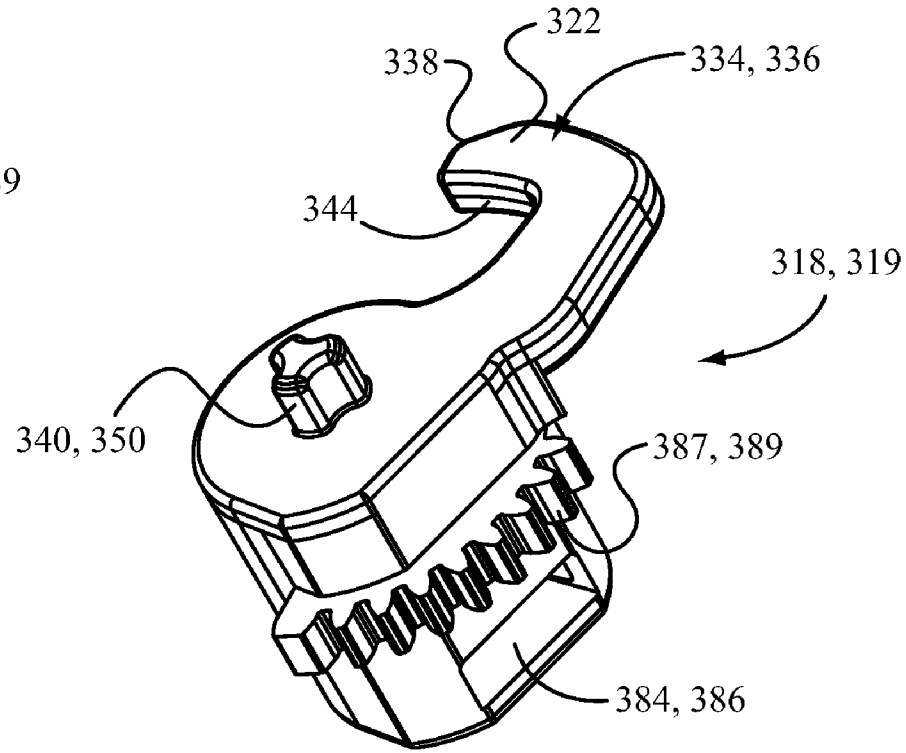
Figure 44:
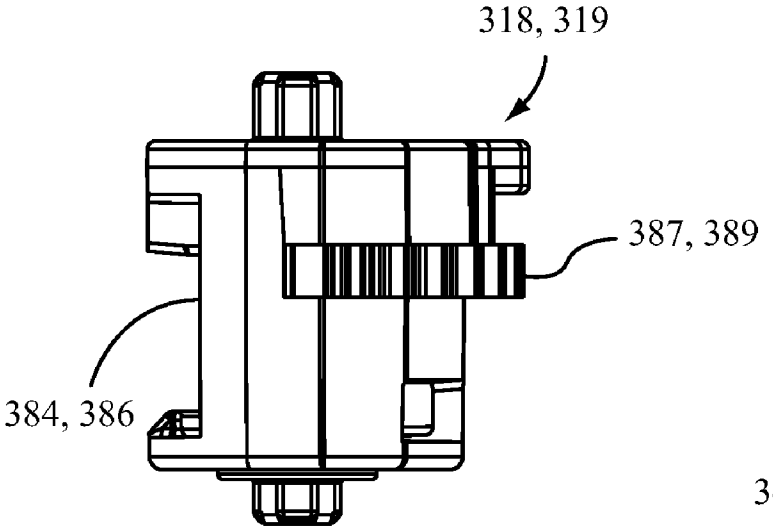
Figure 46:
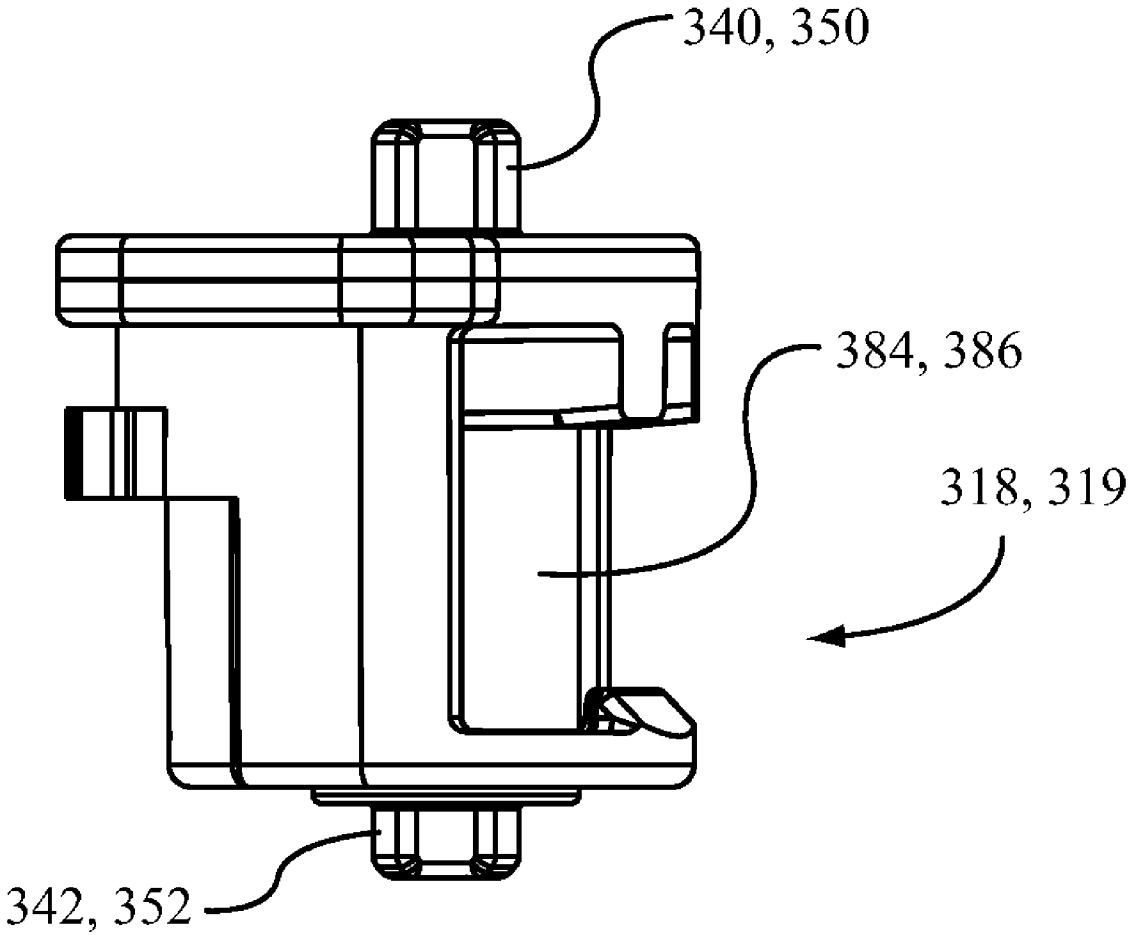
Figure 47:
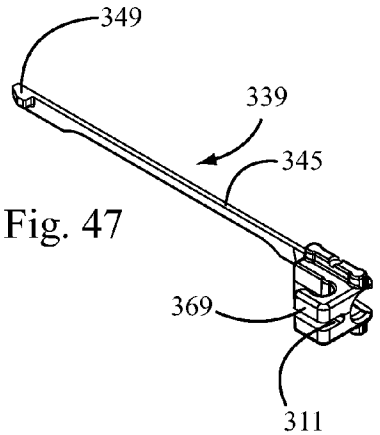
FIGS. 47-52 are views of the flexible link of an embodiment of the magnetic latch mechanism of the present invention, shown in isolation.
Figure 51:
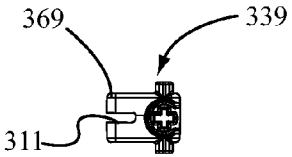
Figure 48:
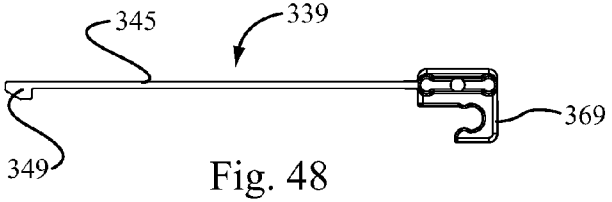
Figure 50:
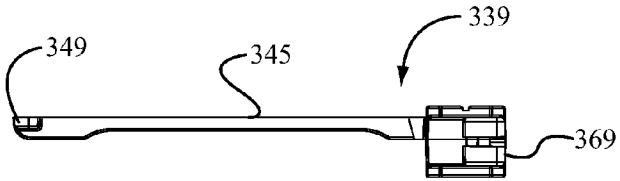
Figure 52:
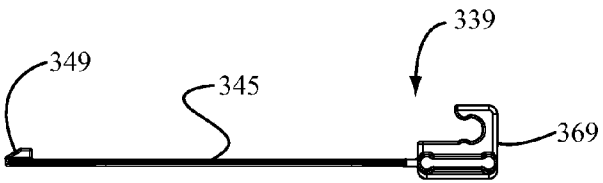
Figure 49:
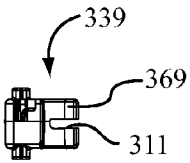
Figure 53:
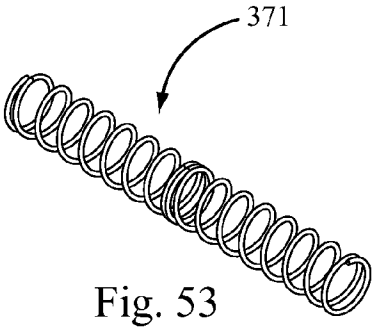
FIGS. 53-58 are views of the return spring of the flexible link of an embodiment of the magnetic latch mechanism of the present invention, shown in isolation.
Figure 57:
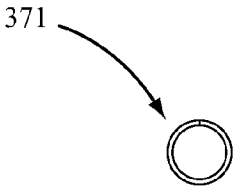
Figure 54:
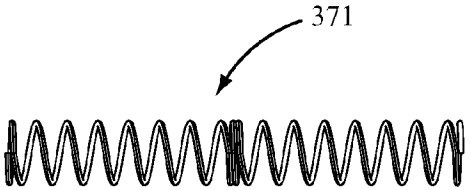
Figure 56:
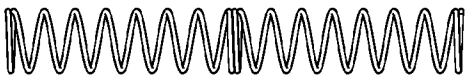
Figure 58:
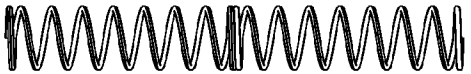
Figure 55:
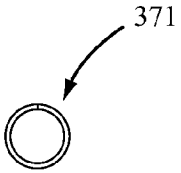
Figure 61:
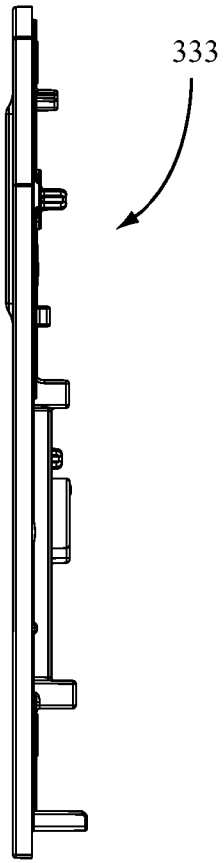
FIGS. 59-63 are views of the housing cover plate of an embodiment of the magnetic latch mechanism of the present invention, shown in isolation.
Figure 60:
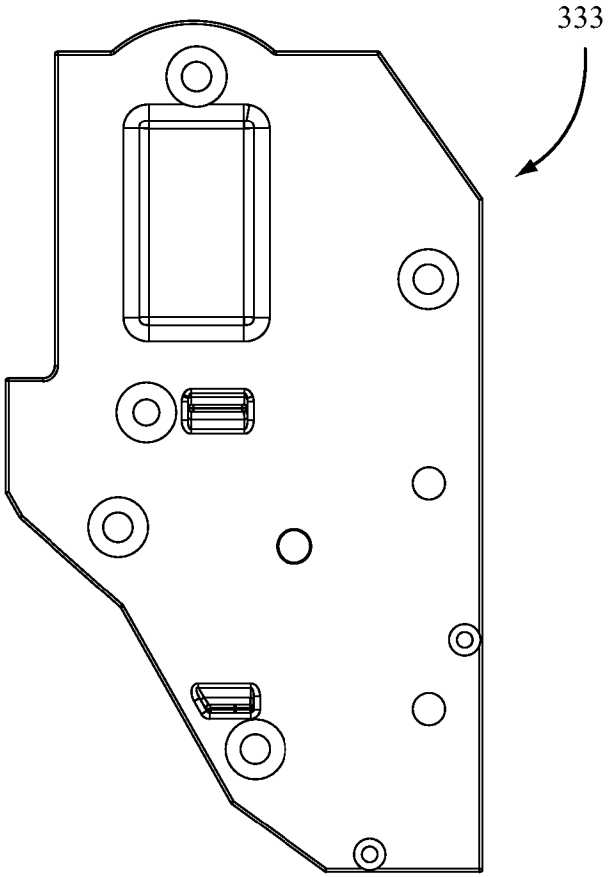
Figure 59:
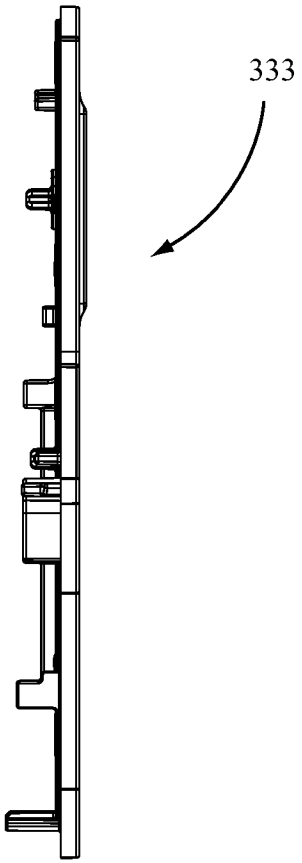
Figure 62:
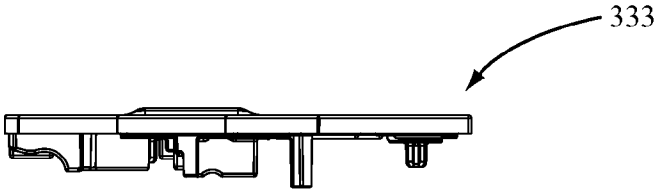
Figure 63:
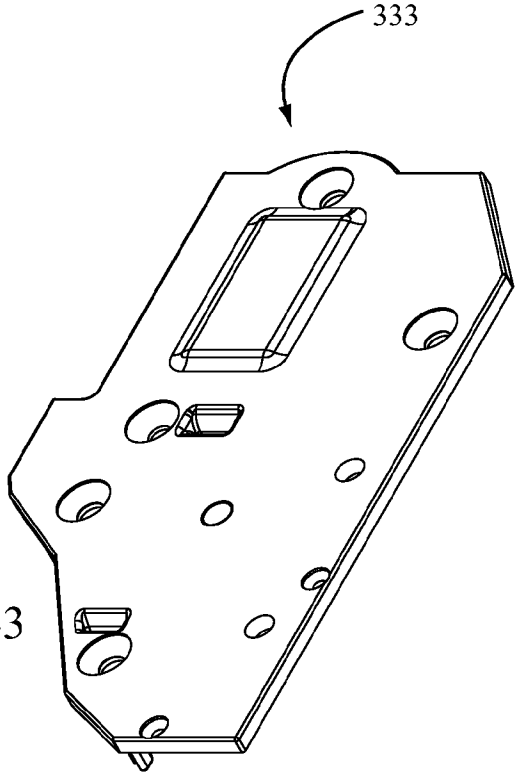
Figure 65:
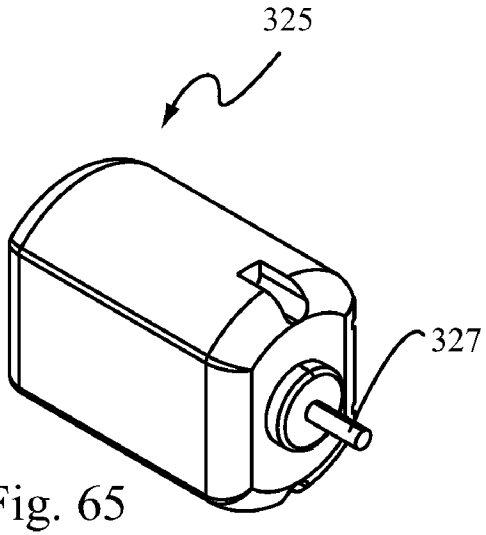
FIGS. 64-67 are views of the motor of an embodiment of the magnetic latch mechanism of the present invention, shown in isolation.
Figure 67:
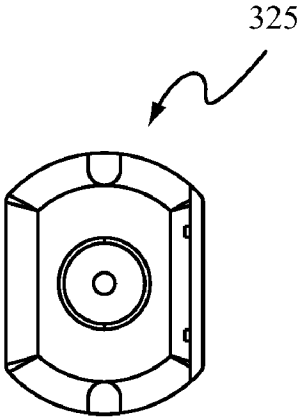
Figure 64:
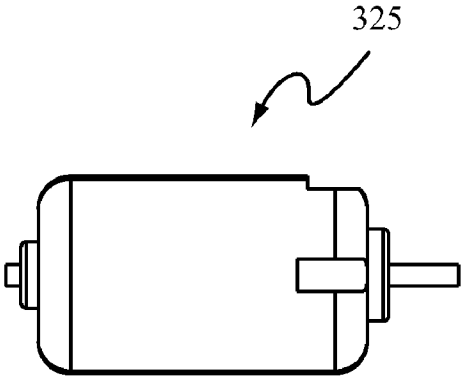
Figure 66:
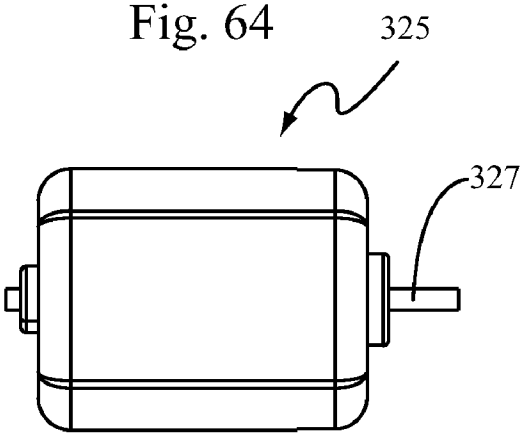
Figure 68:
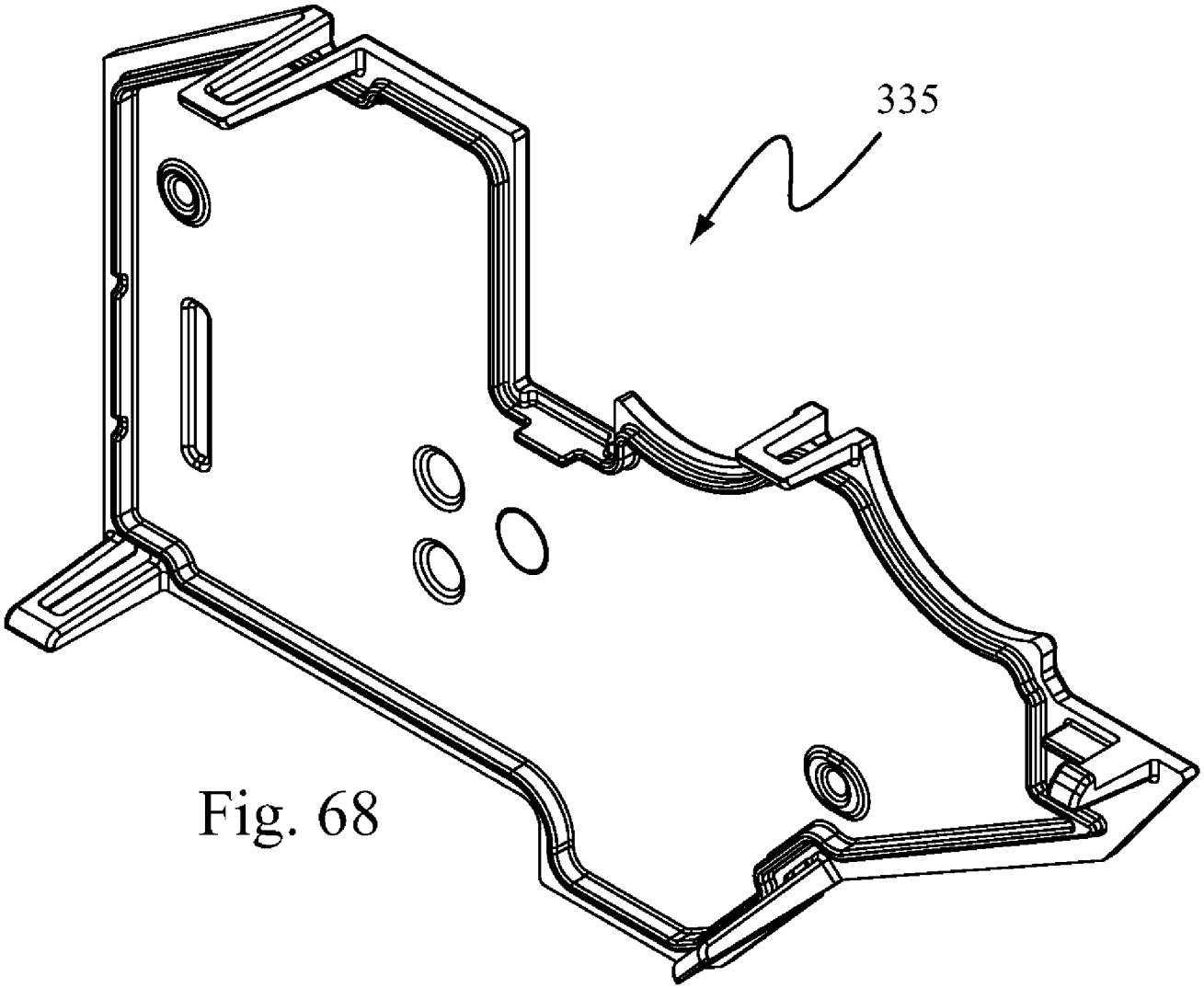
FIGS. 68-71 are views of the printed circuit board cover of an embodiment of the magnetic latch mechanism of the present invention, shown in isolation.
Figure 71:
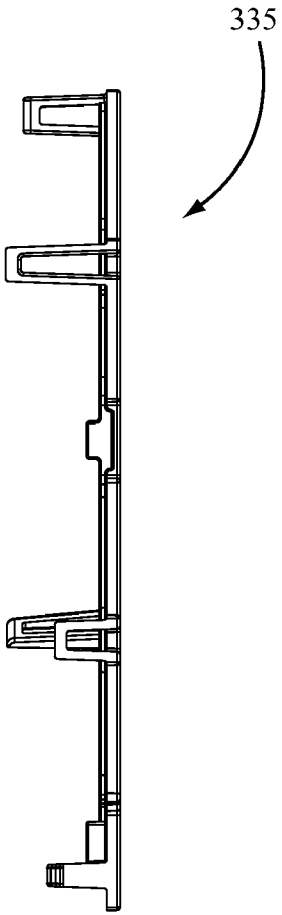
Figure 70:
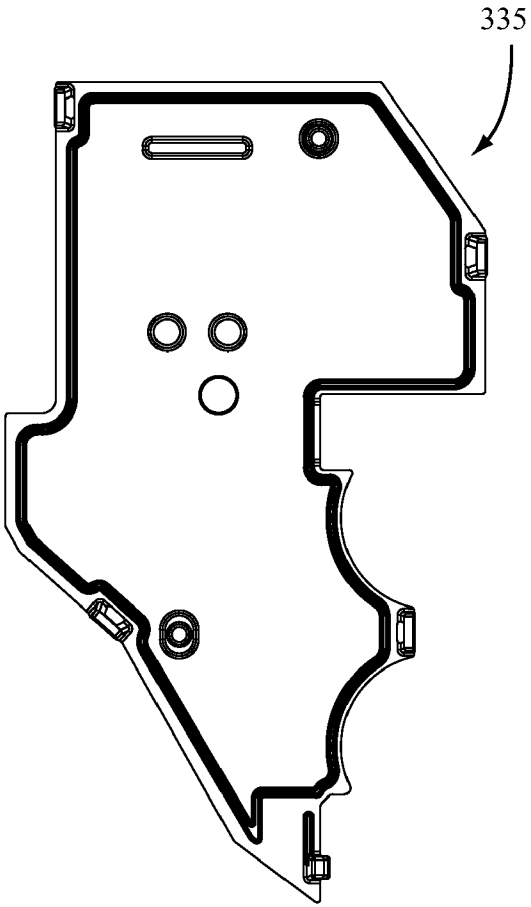
Figure 69:
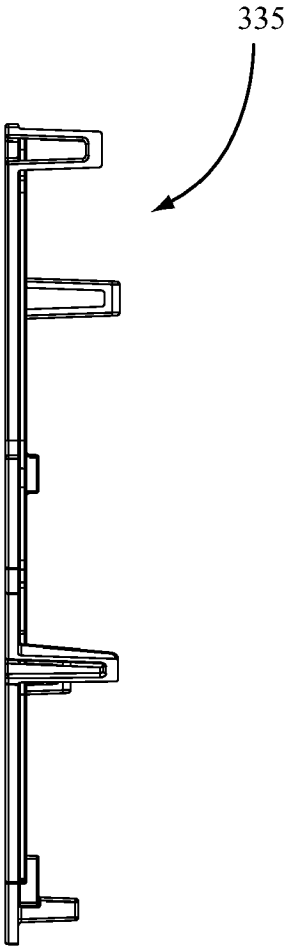
Figure 72:
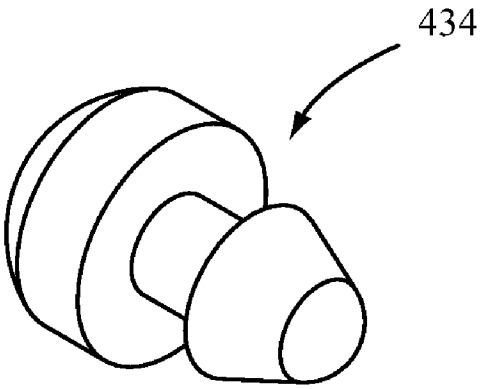
FIGS. 72-73 are views of the resilient bumpers provided at the ends of the rack bar of an embodiment of the magnetic latch mechanism of the present invention, shown in isolation.
Figure 73:
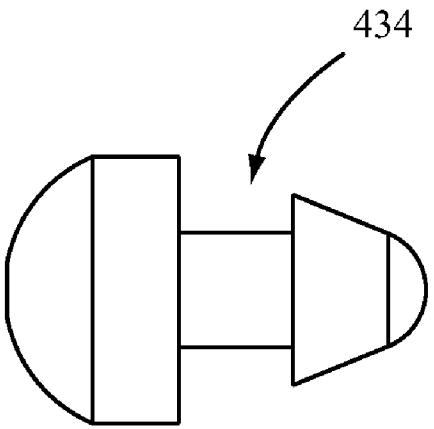
Figure 74:
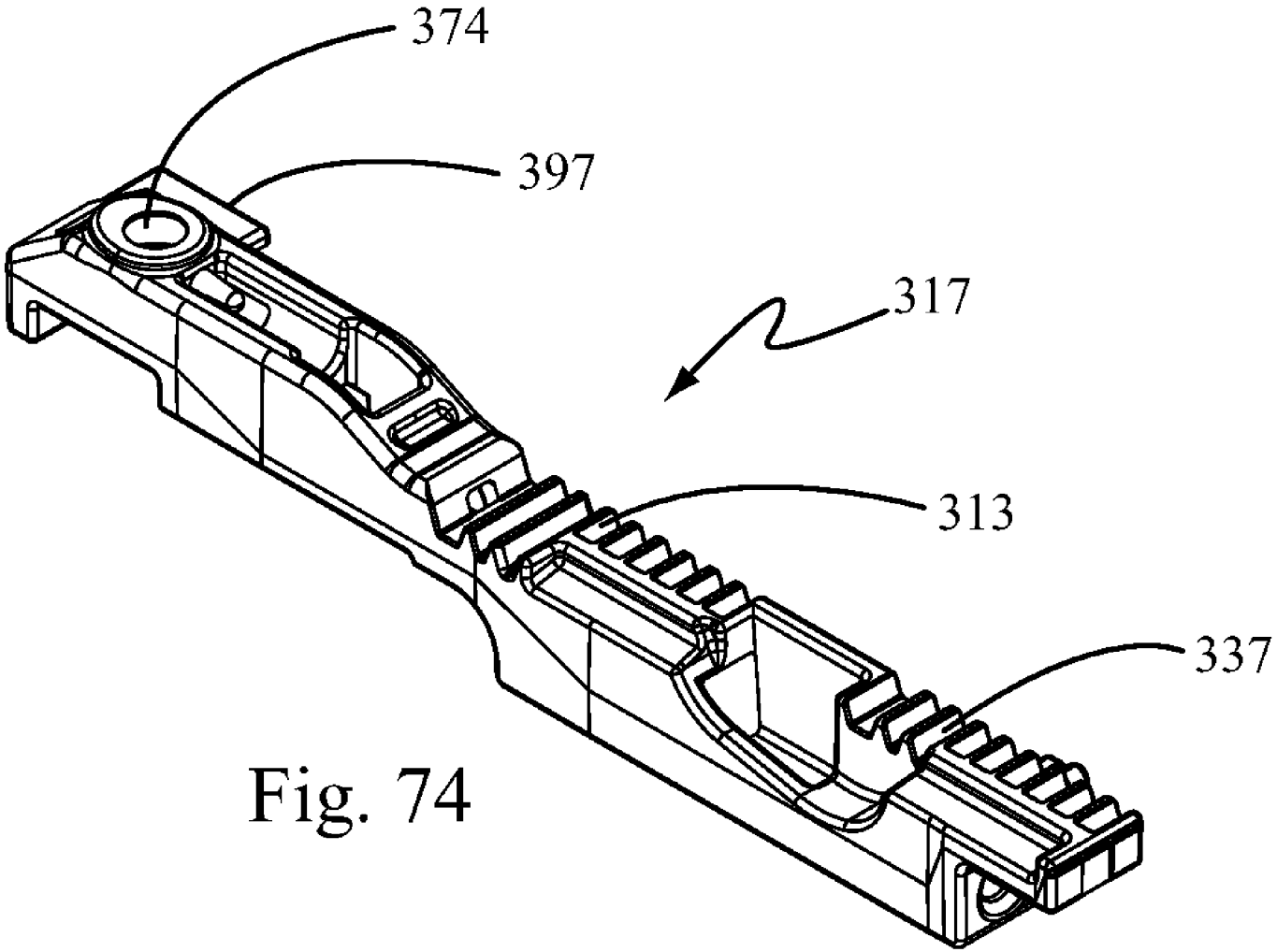
FIGS. 74-77 are views of the rack bar of an embodiment of the magnetic latch mechanism of the present invention, shown in isolation.
Figure 76:
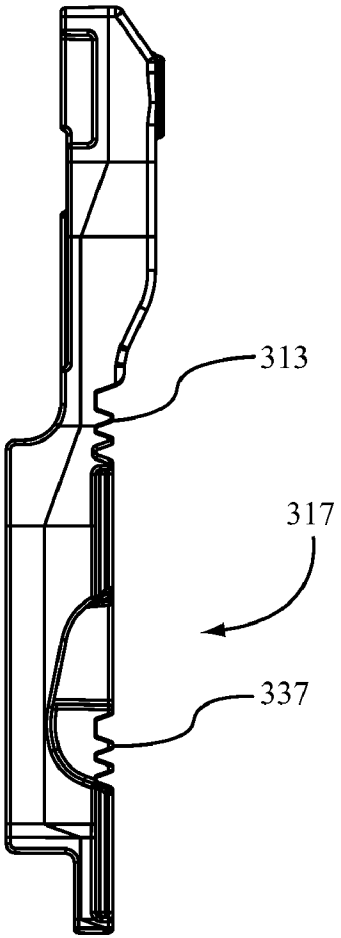
Figure 75:
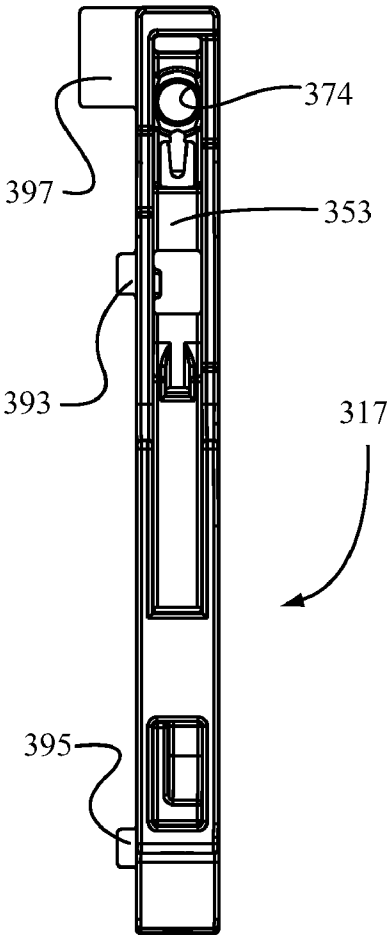
Figure 77:
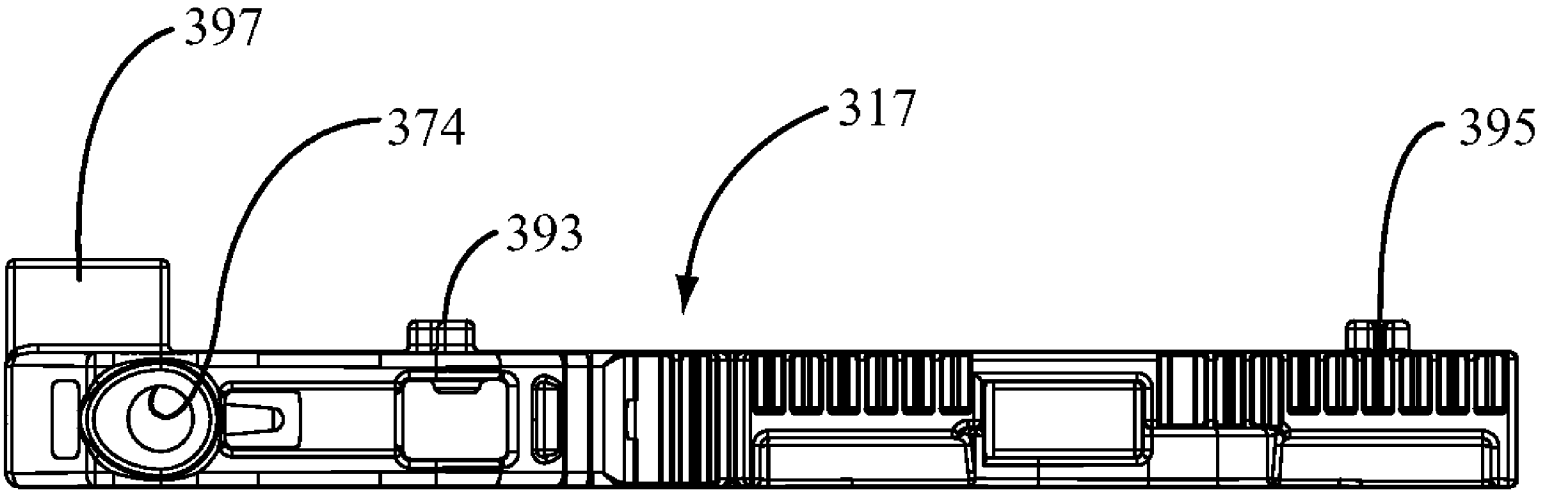
Figure 80:
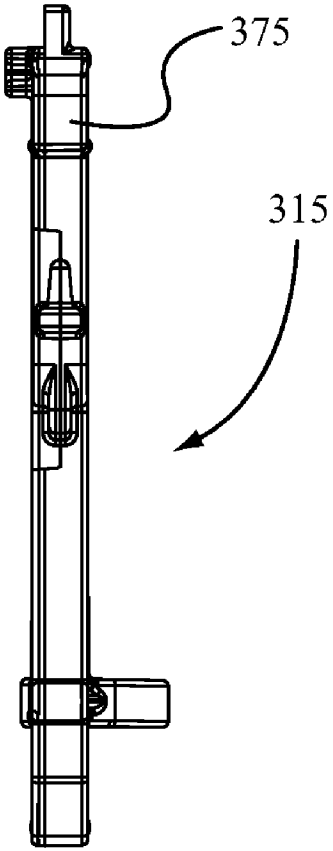
FIGS. 78-82 are views of the sliding bar of an embodiment of the magnetic latch mechanism of the present invention, shown in isolation.
Figure 79:
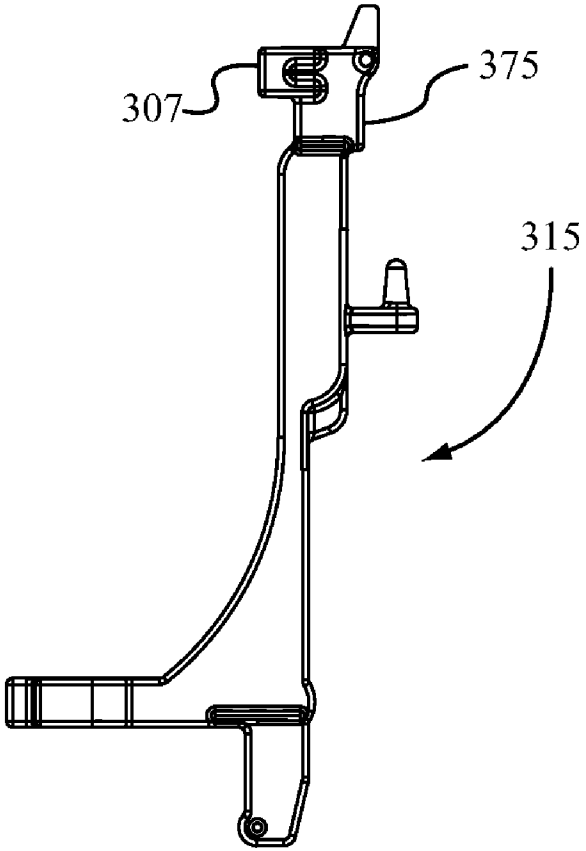
Figure 78:
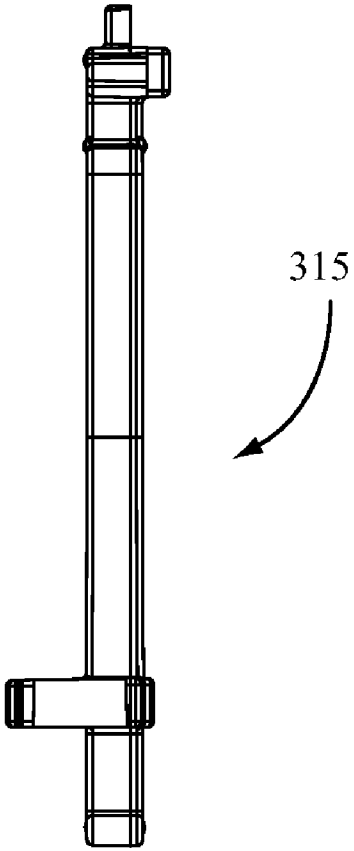
Figure 82:
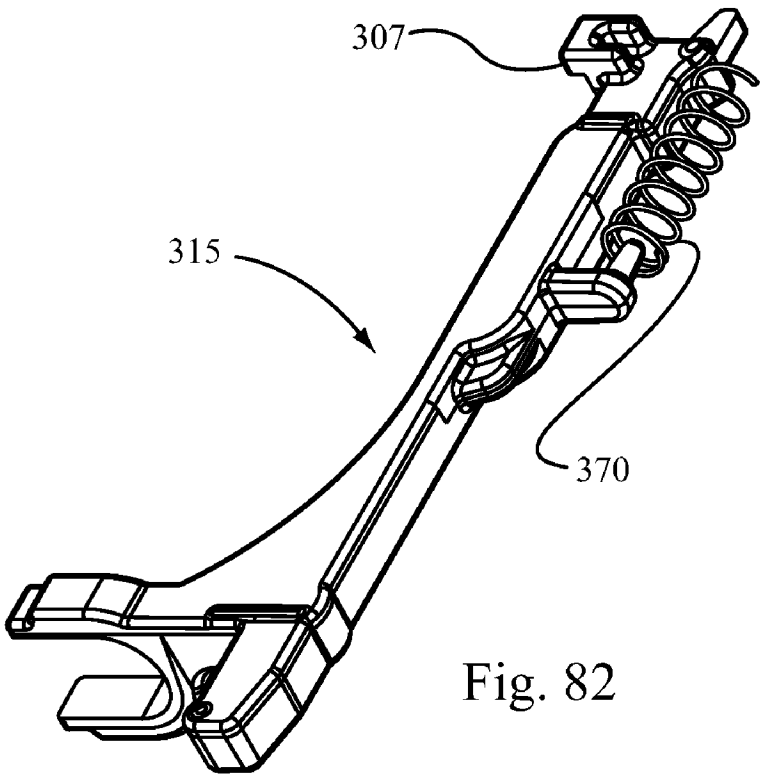
Figure 81:
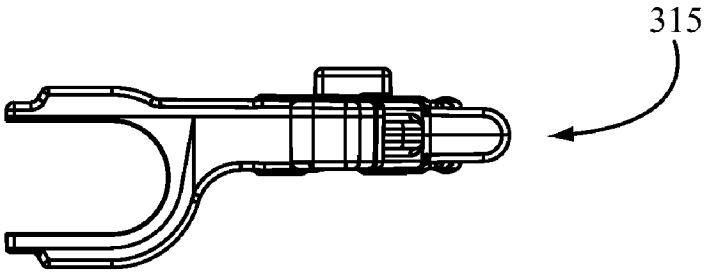
Figure 83:
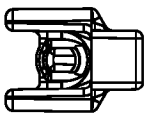
FIGS. 83-88 are views of the control pins of an embodiment of the magnetic latch mechanism of the present invention, shown in isolation.
Figure 84:
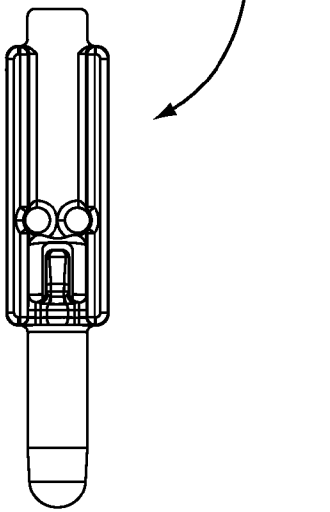
Figure 85:
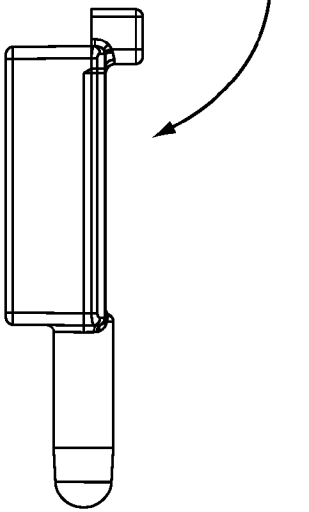
Figure 86:
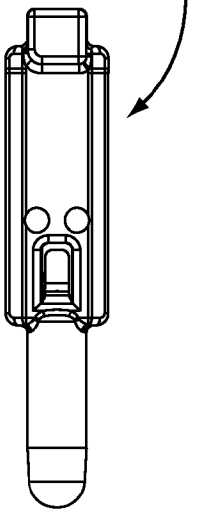
Figure 88:
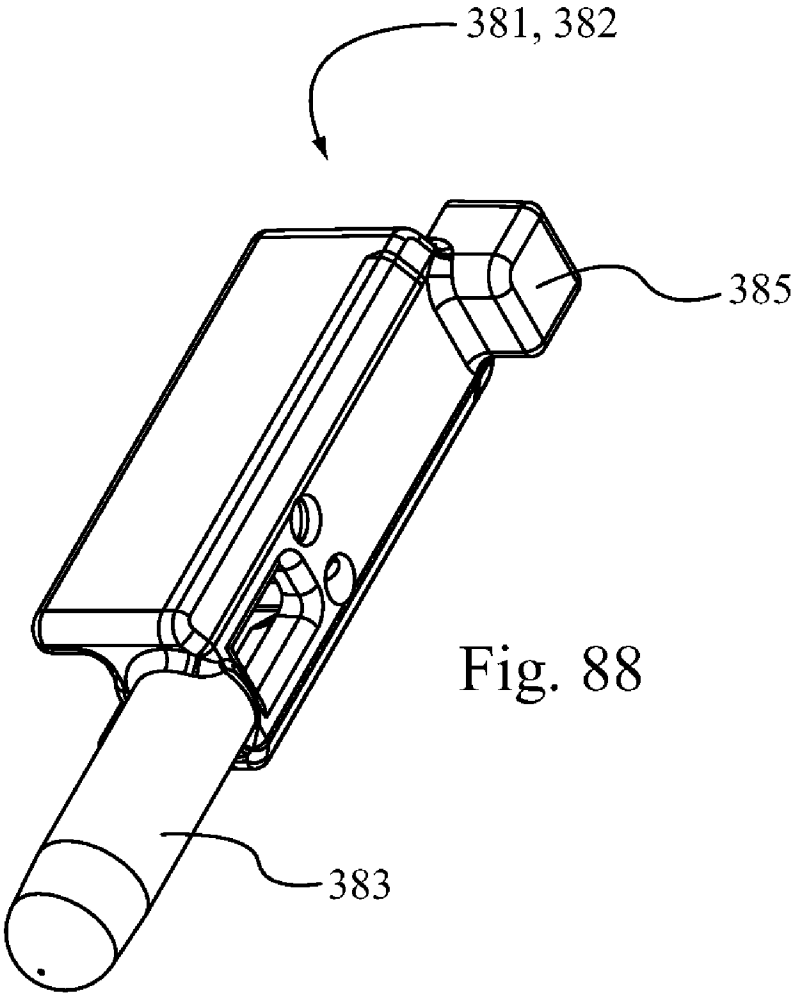
Figure 87:
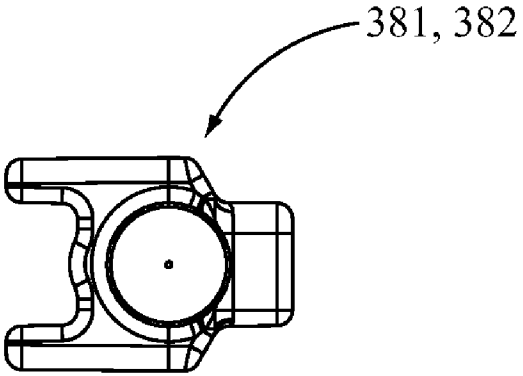
Figure 89:
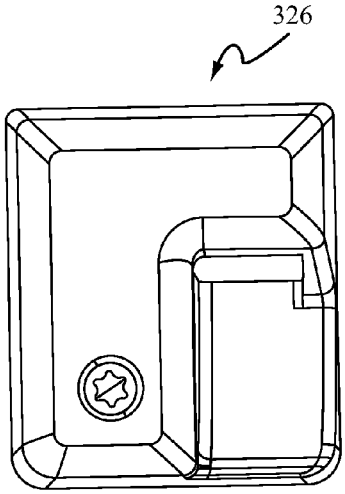
FIGS. 89-94 are views of one of the strikers of an embodiment of the magnetic latch mechanism of the present invention.
Figure 90:
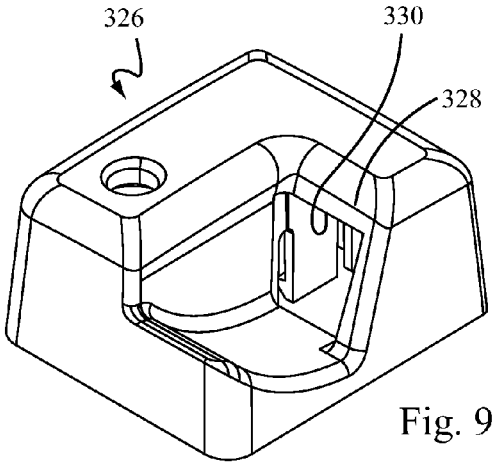
Figure 91:
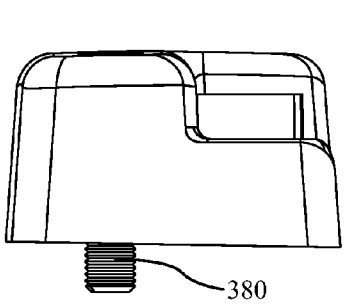
Figure 92:
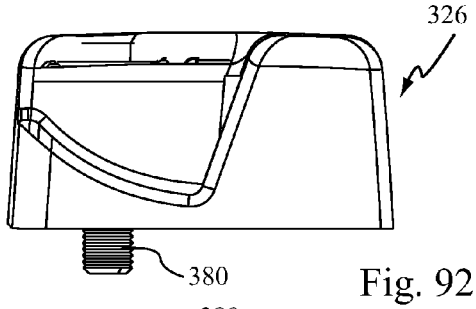
Figure 93:
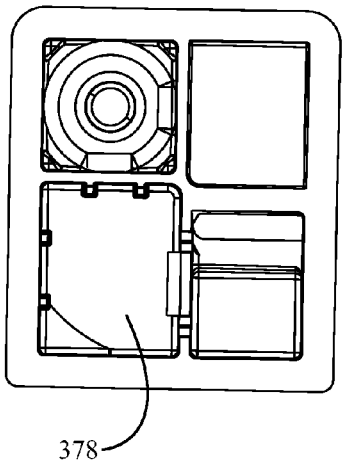
Figure 94:
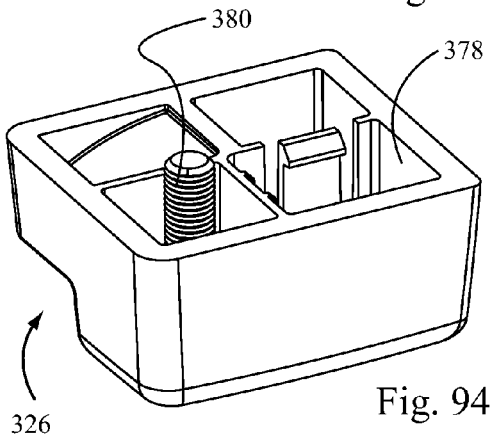
Figure 96:
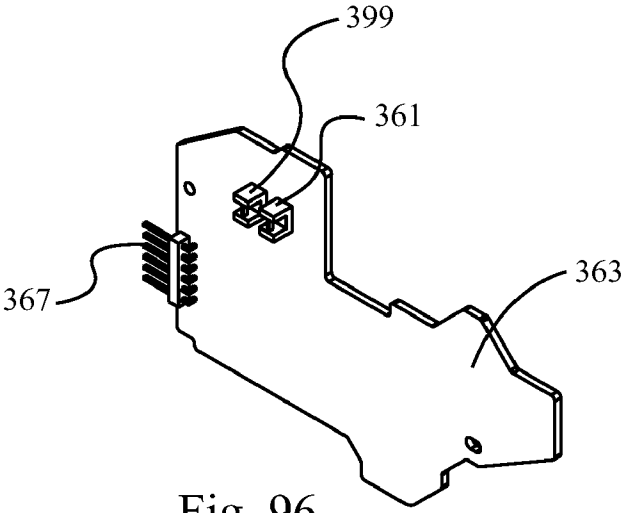
FIGS. 95-96 are views of the printed circuit board of an embodiment of the magnetic latch mechanism of the present invention, shown in isolation.
Figure 95:
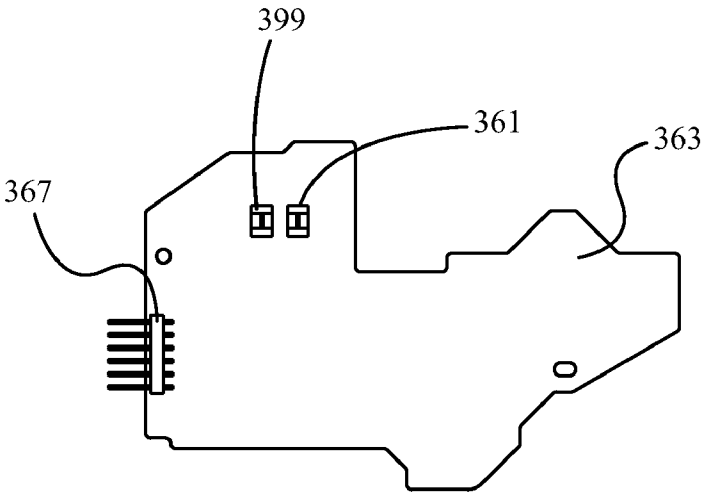
Figure 97:
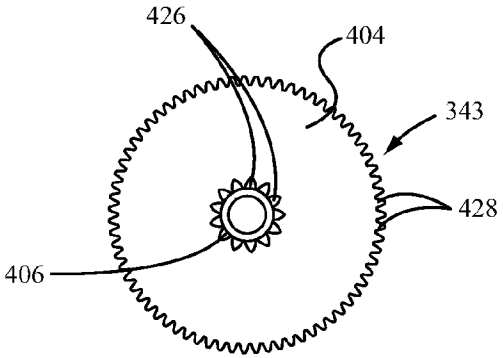
FIGS. 97-102 are views of the first gear wheel of the motor drive of an embodiment of the magnetic latch system of the present invention, shown in isolation.
Figure 98:
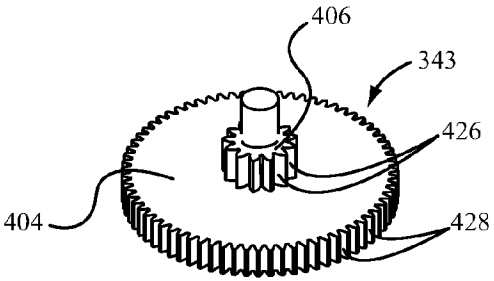
Figure 99:
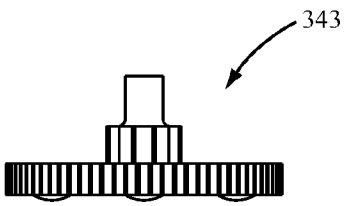
Figure 100:
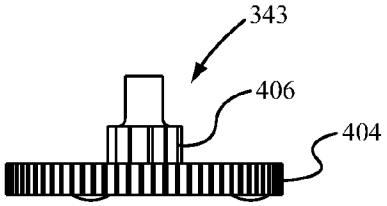
Figure 101:
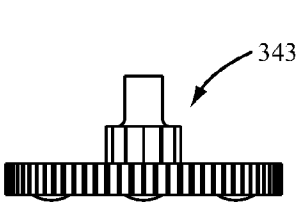
Figure 102:
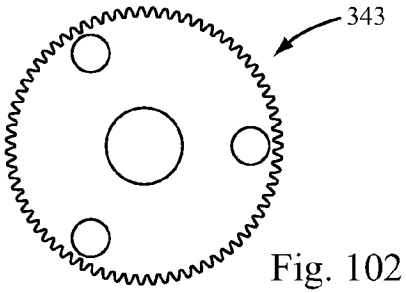
Figure 109:
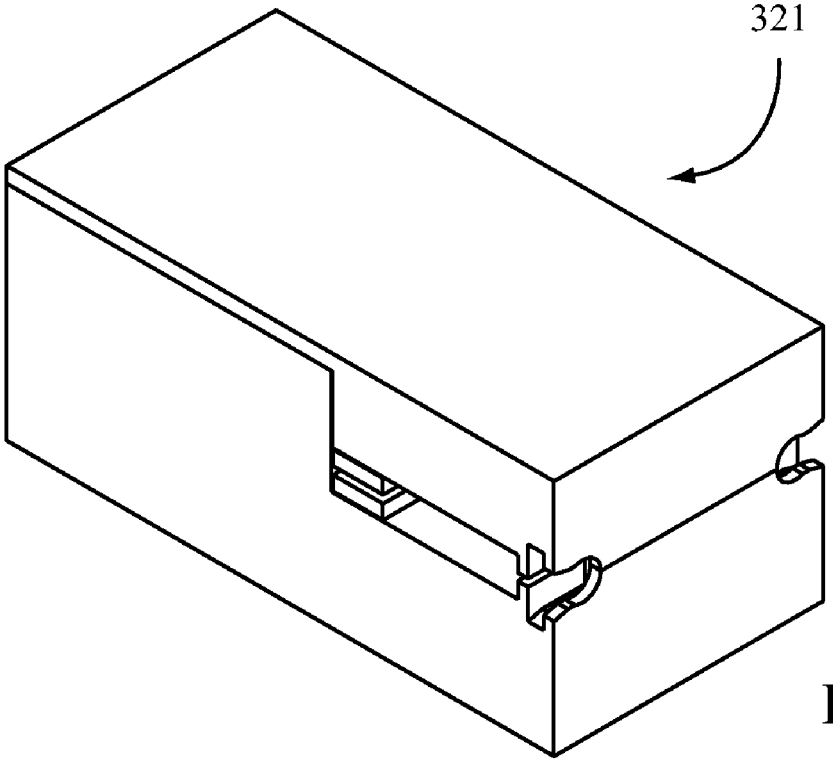
FIGS. 109-116 are views of the motor drive of an embodiment of the magnetic latch system of the present invention, showing the sliding rack in the retracted position.
Figure 110:
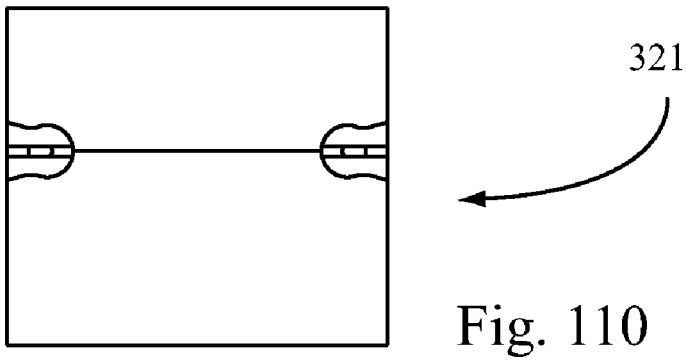
Figure 111:
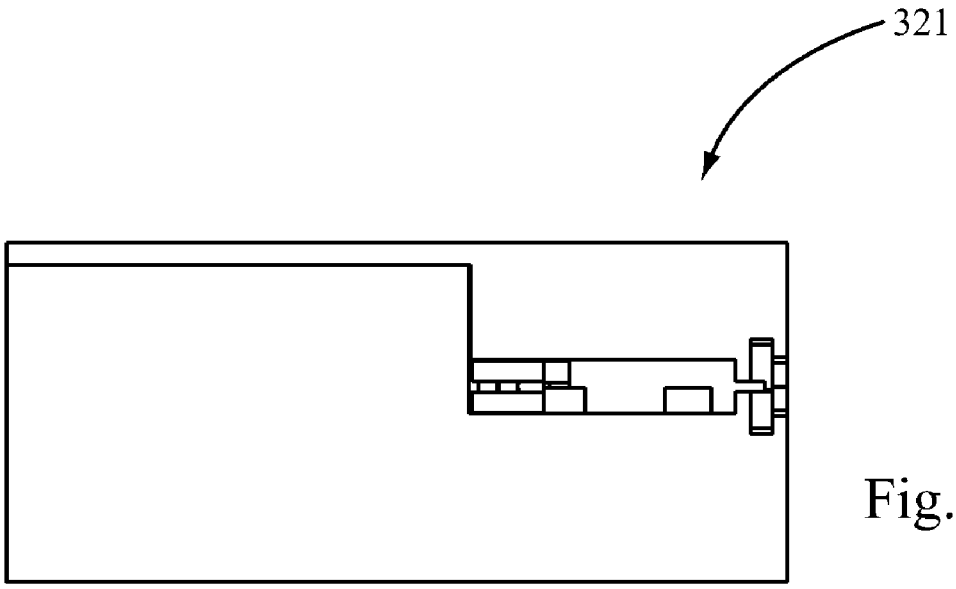
Figure 112:
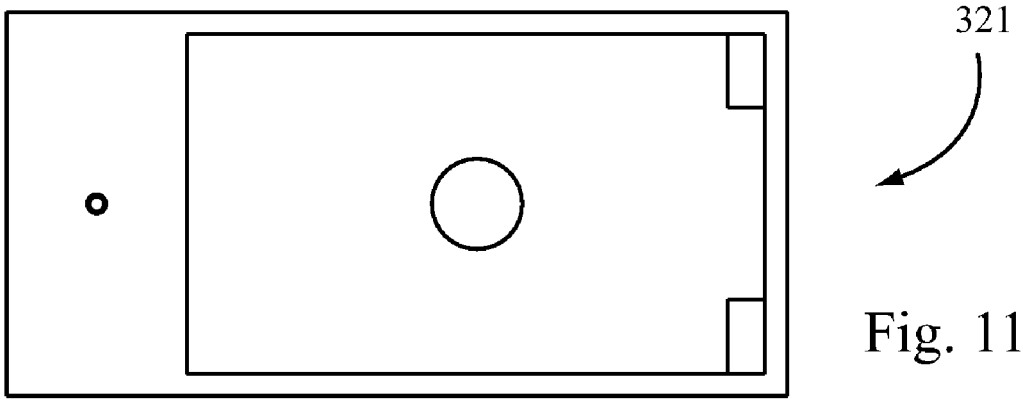
Figure 113:
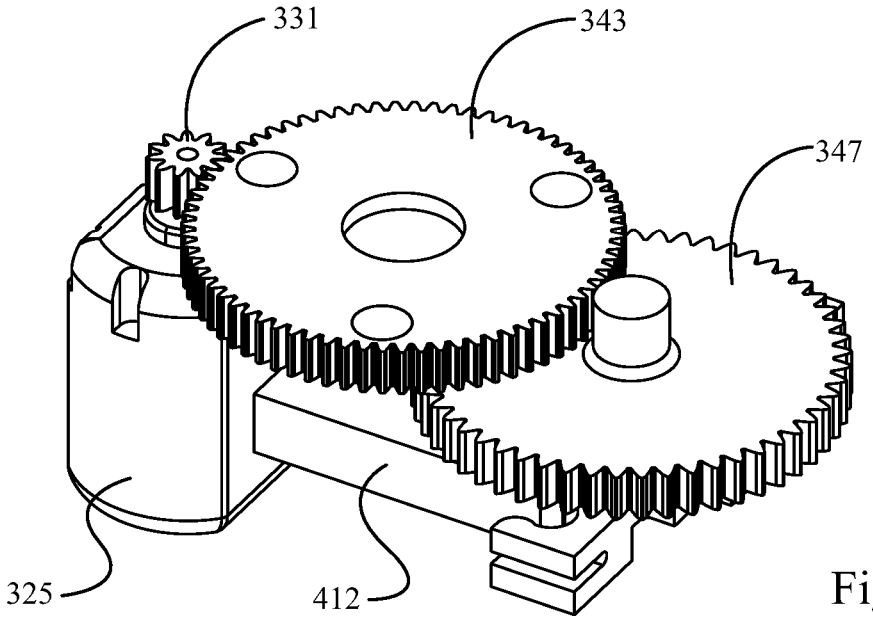
Figure 114:
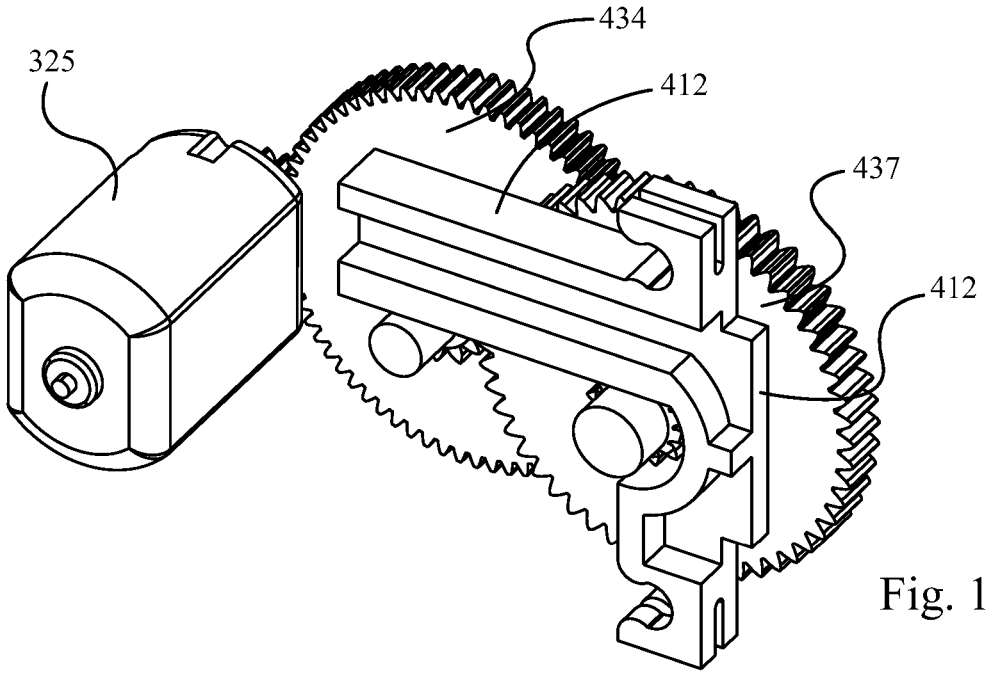
Figure 115:
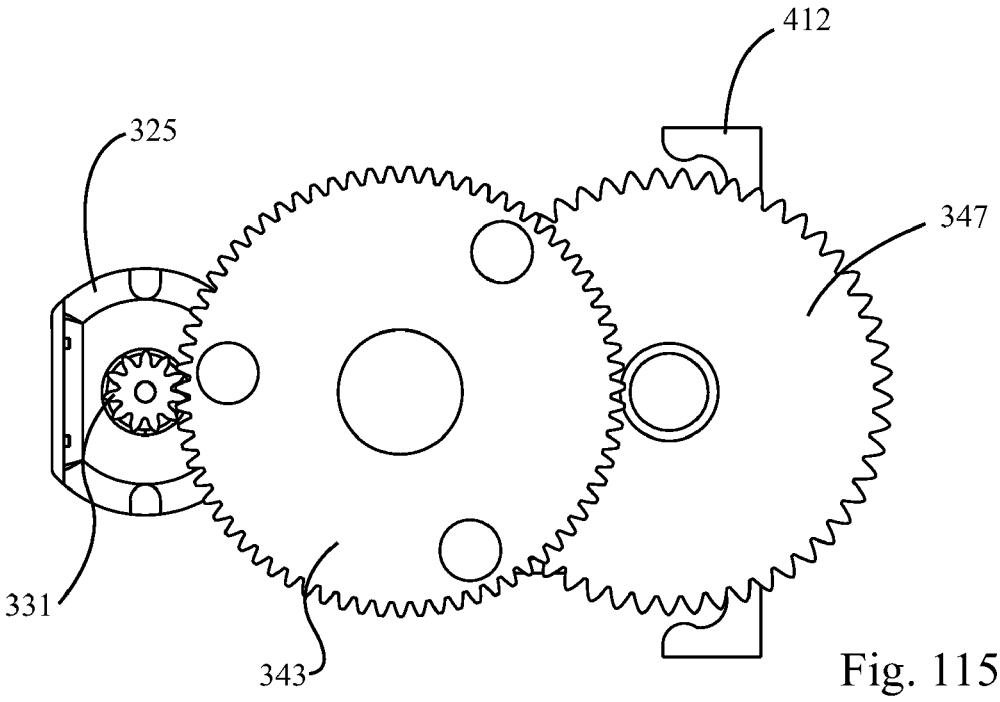
Figure 116:
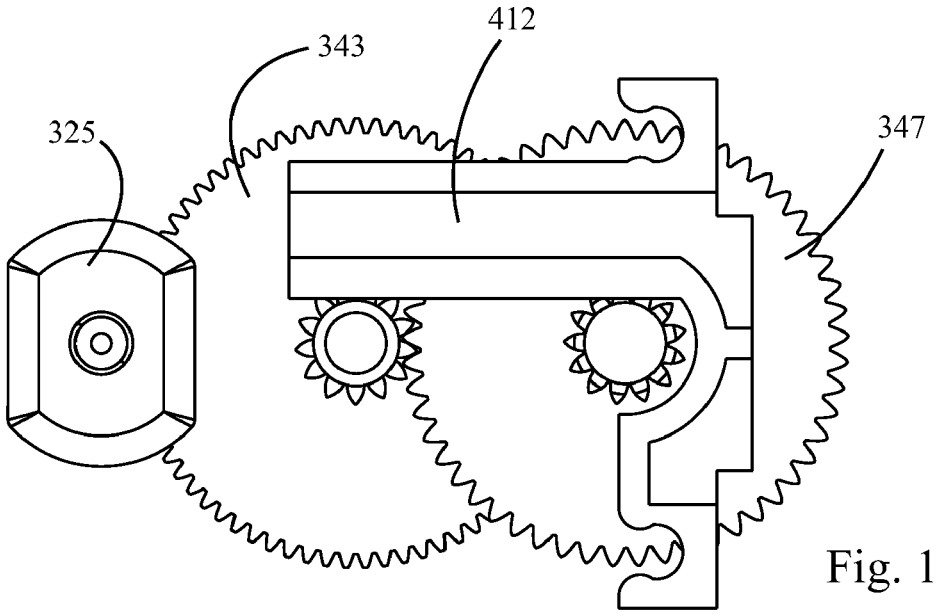
Figure 117:
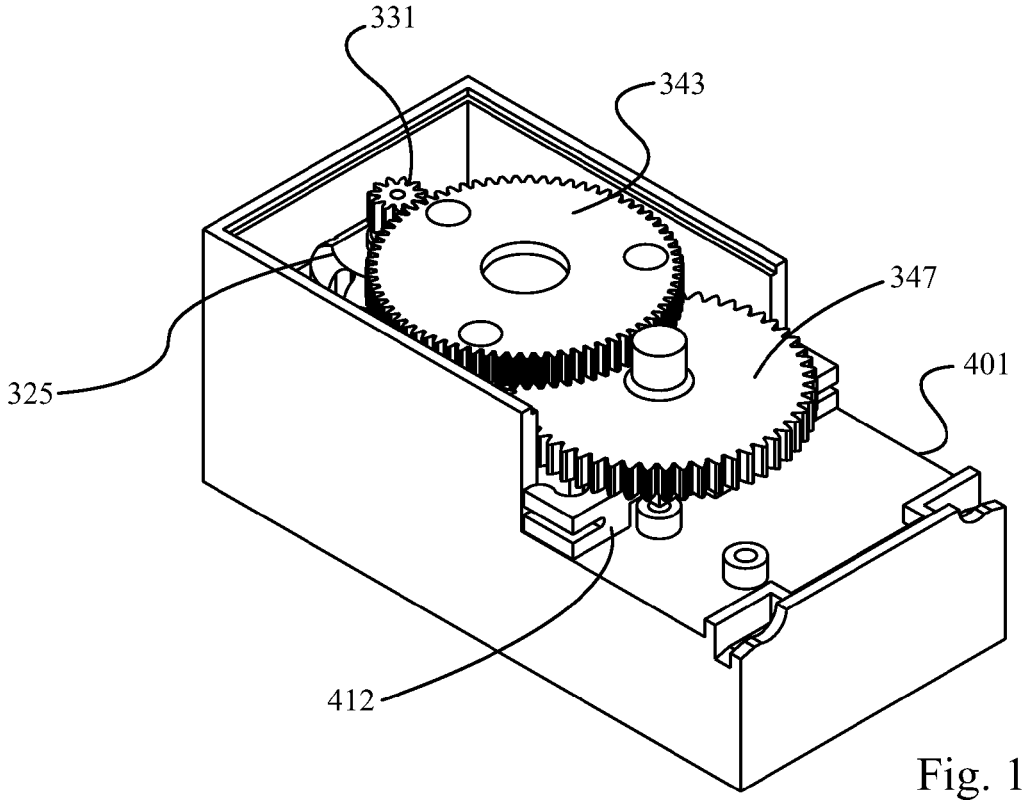
FIGS. 117-120 are views of the motor drive of an embodiment of the magnetic latch system of the present invention, showing the sliding rack in the retracted position with the motor drive cover removed.
Figure 118:
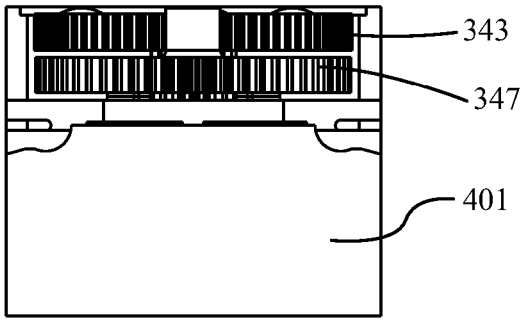
Figure 119:
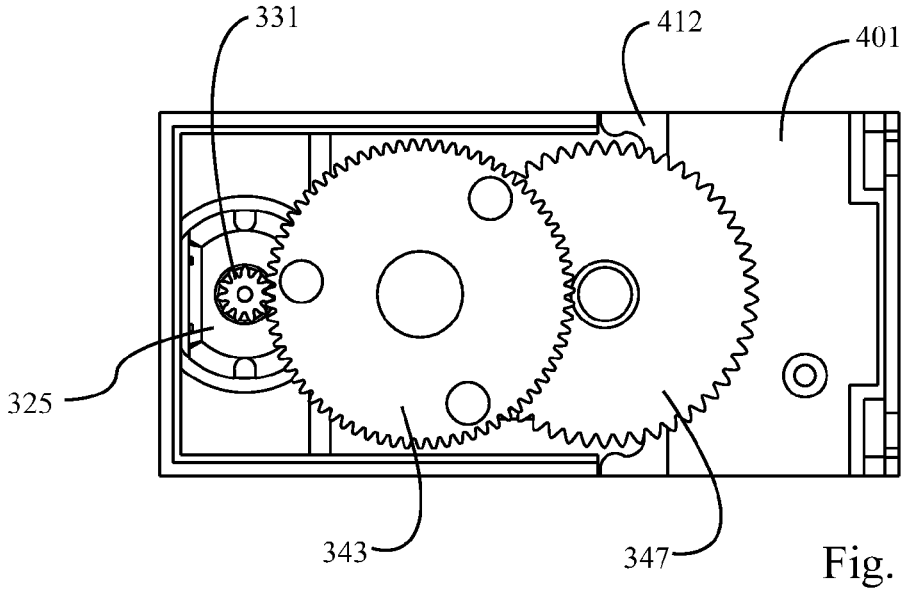
Figure 120:
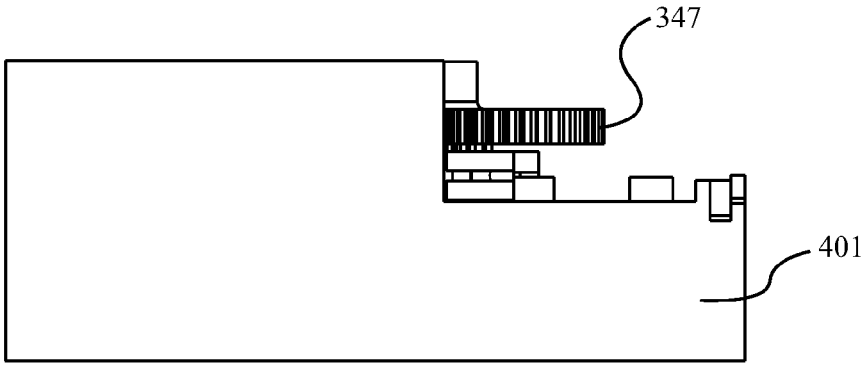
Figure 121:
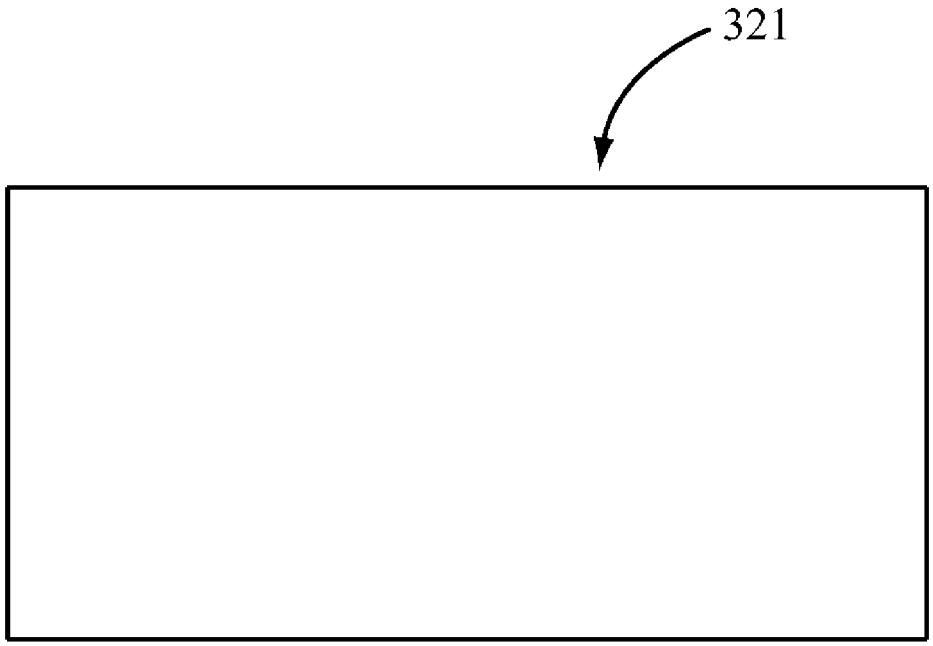
FIGS. 121-128 are views of the motor drive of an embodiment of the magnetic latch system of the present invention, showing the sliding rack in the extended position.
Figure 122:
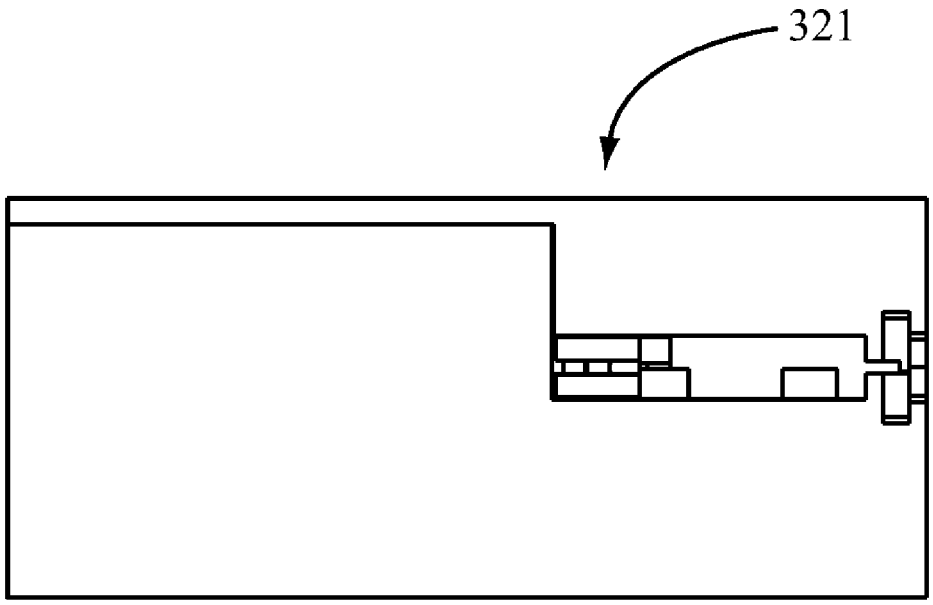
Figure 123:
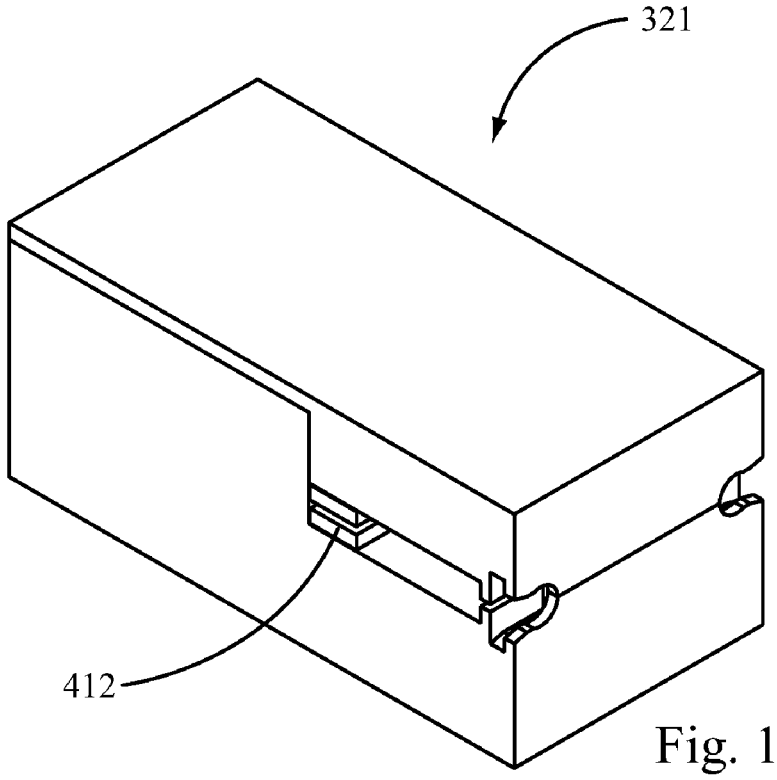
Figure 124:
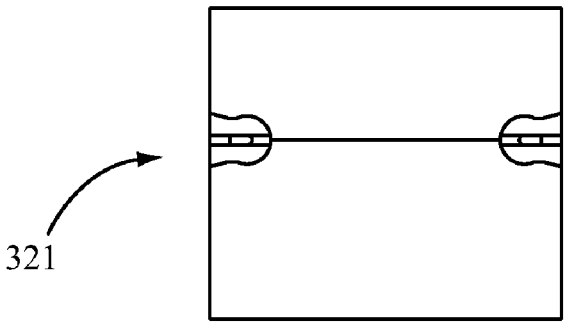
Figure 125:
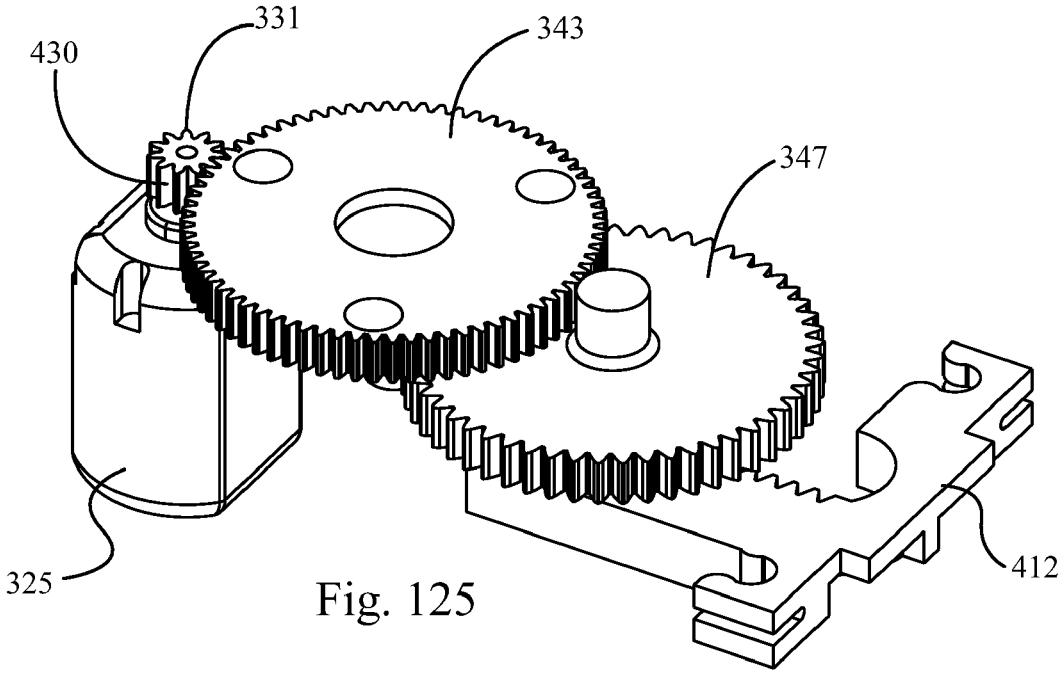
Figure 126:
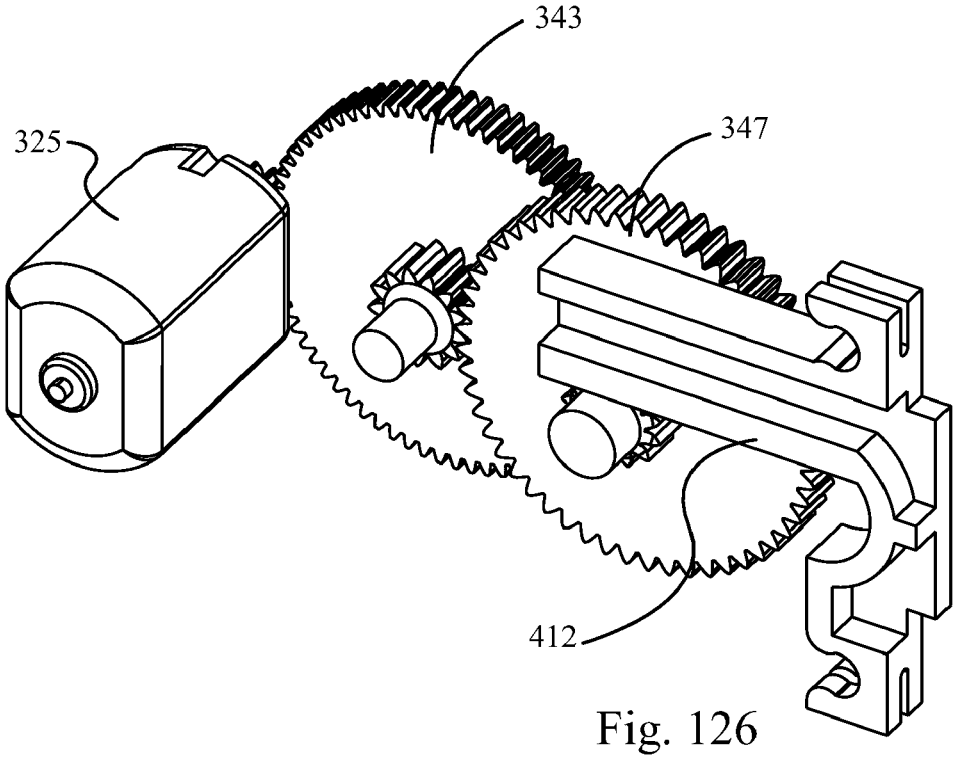
Figure 127:
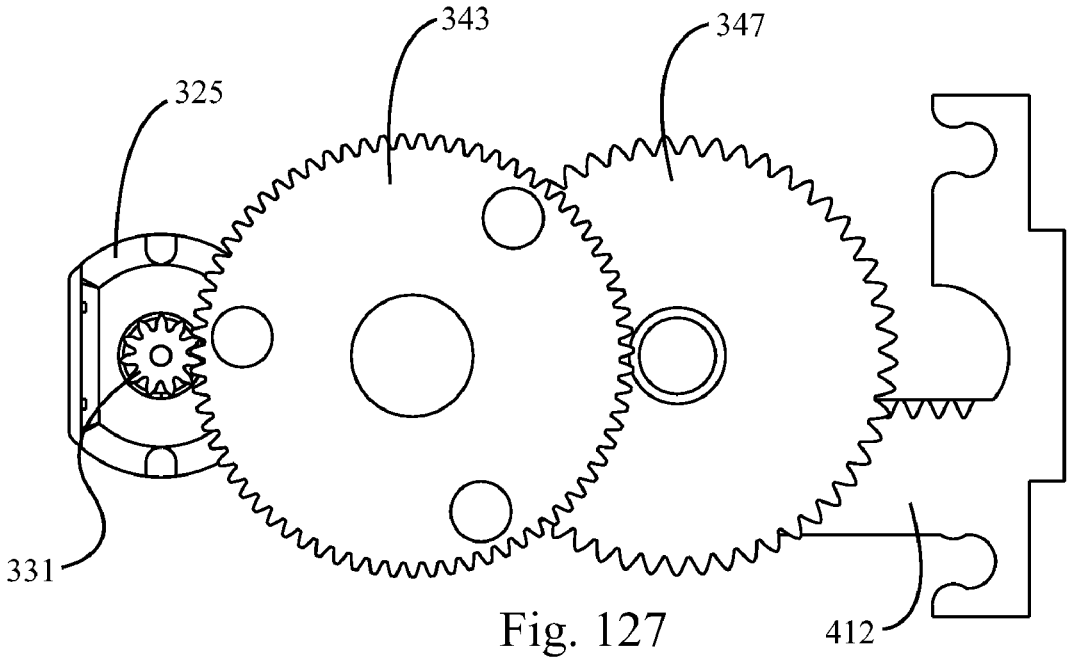
Figure 128:
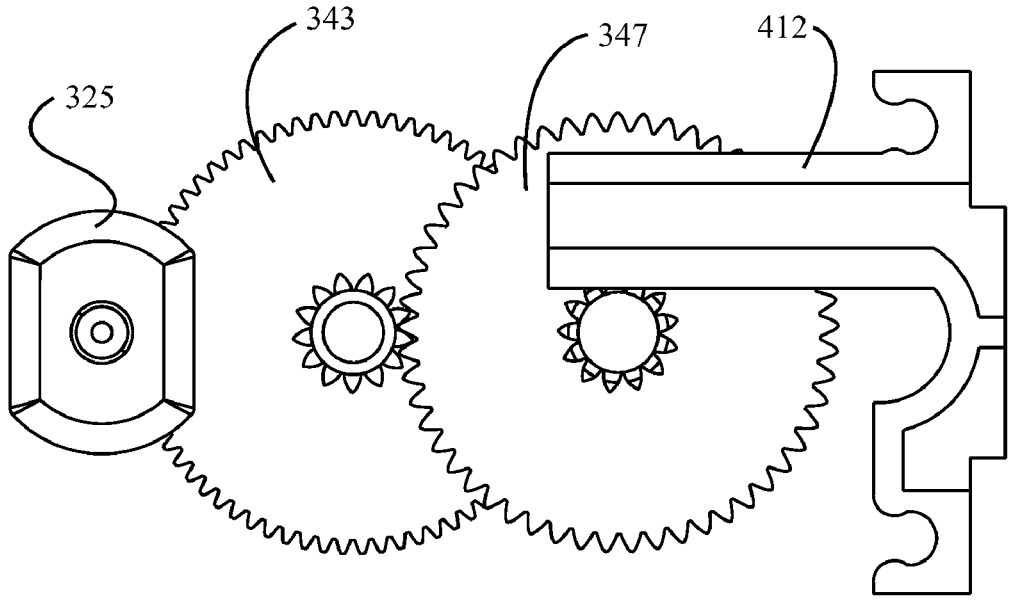
Figure 129:
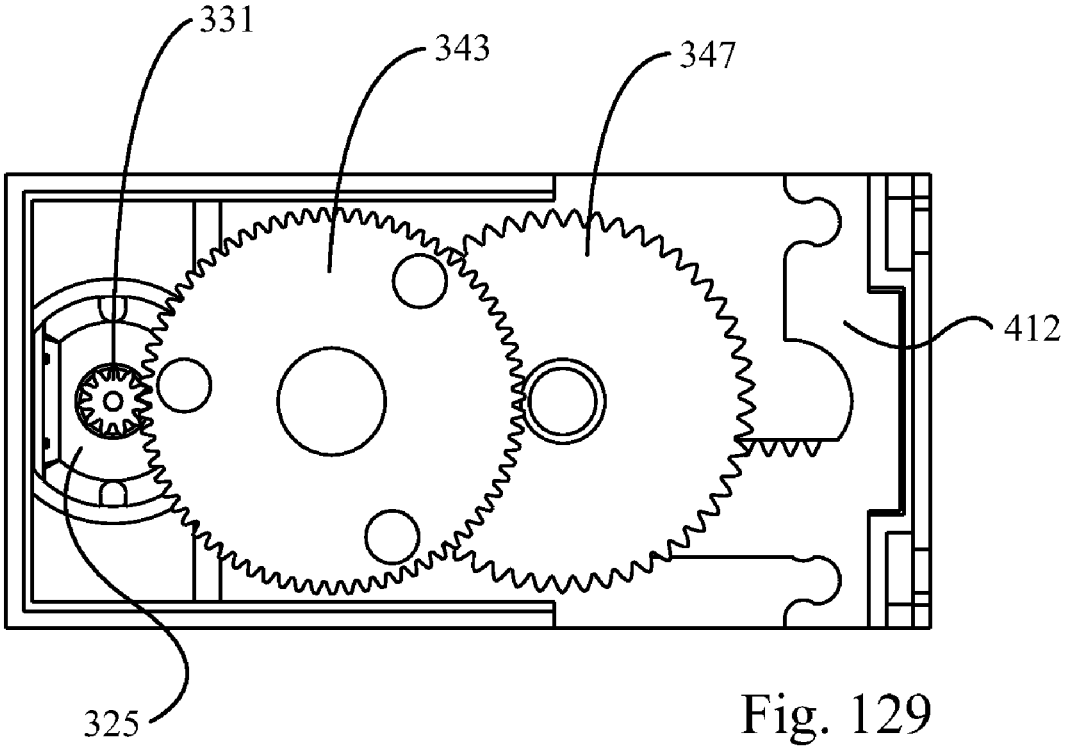
FIGS. 129-132 are views of the motor drive of an embodiment of the magnetic latch system of the present invention, showing the sliding rack in the extended position with the motor drive cover removed.
Figure 130:
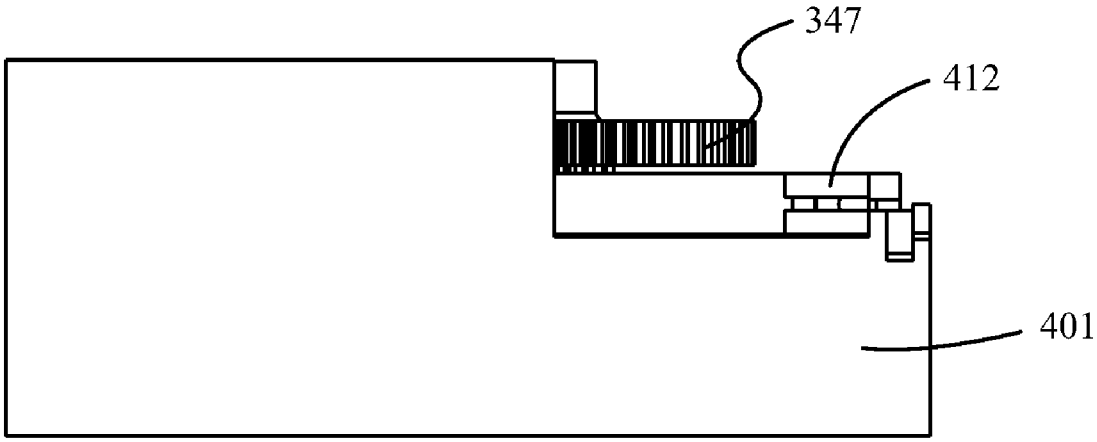
Figure 131:
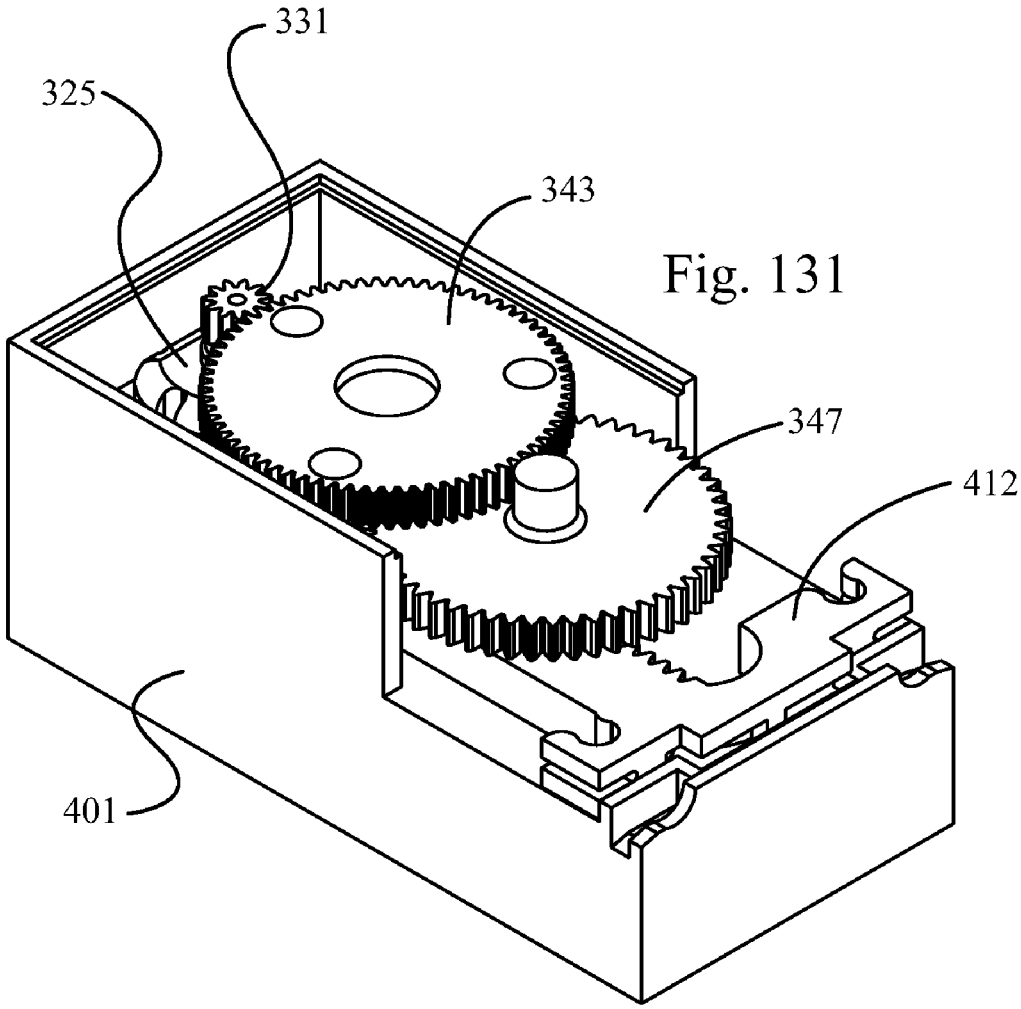
Figure 132:
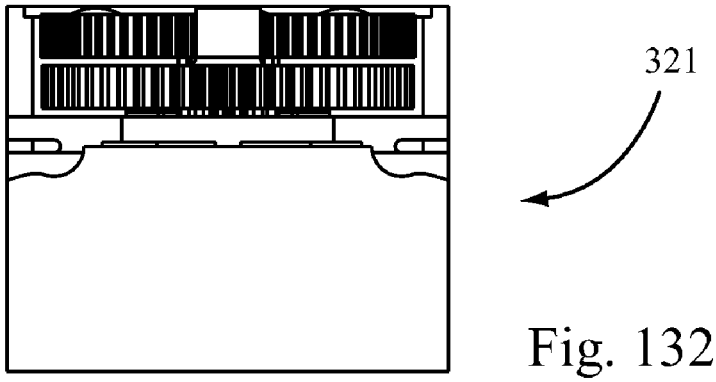
Figure 133:
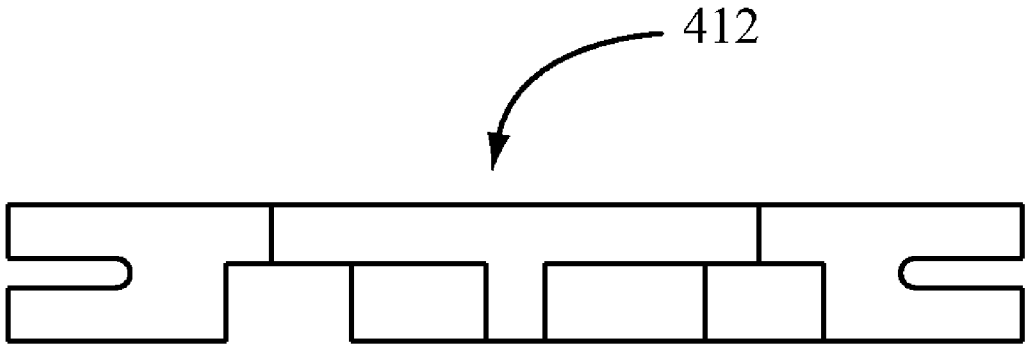
FIGS. 133-138 are views of the sliding rack of the motor drive of an embodiment of the magnetic latch system of the present invention, shown in isolation.
Figure 136:
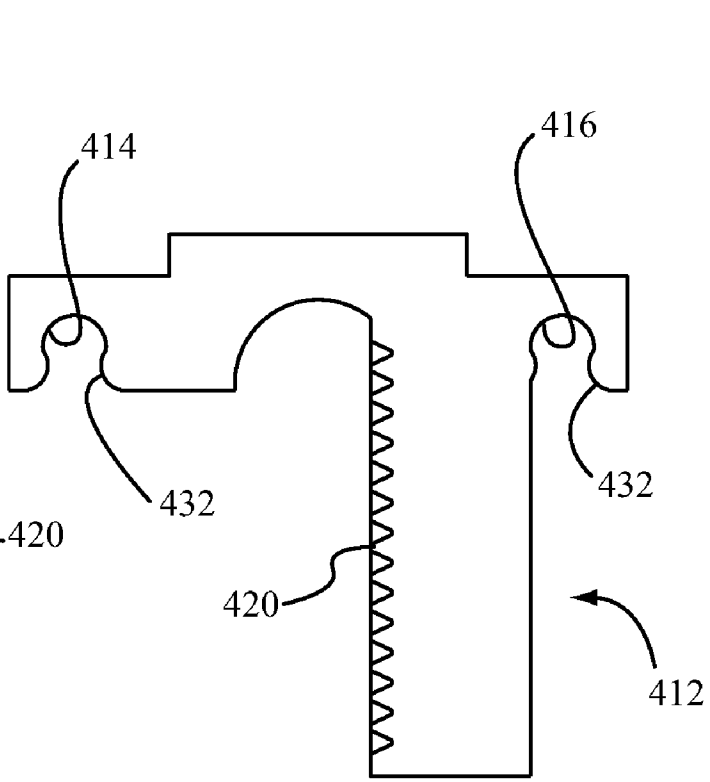
Figure 135:
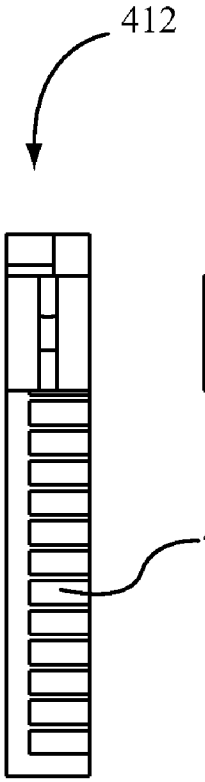
Figure 134:
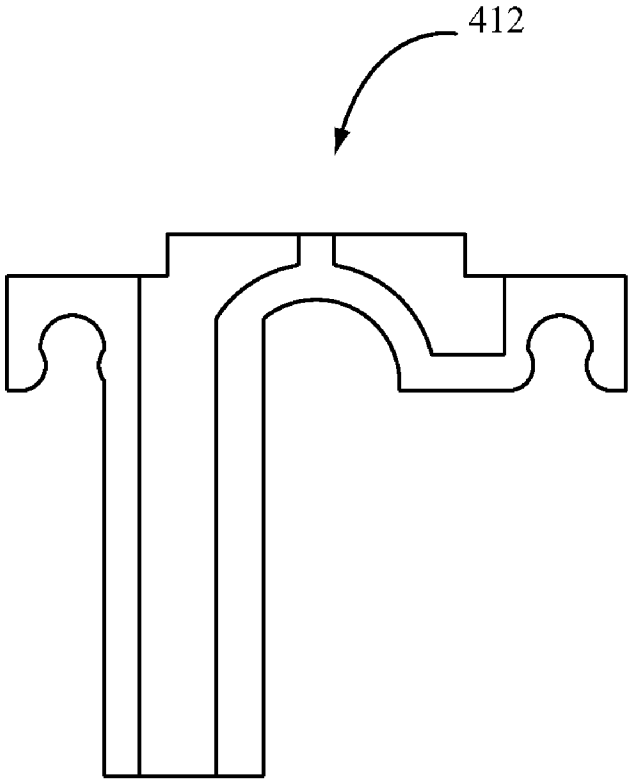
Figure 137:
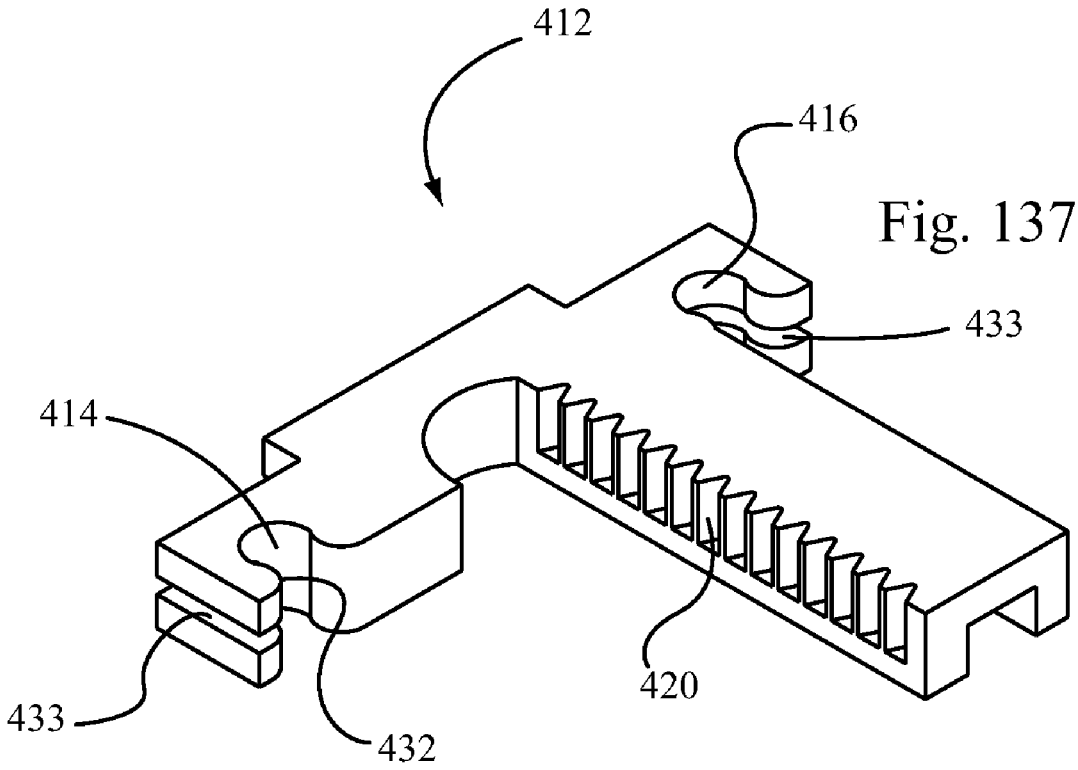
Figure 138:
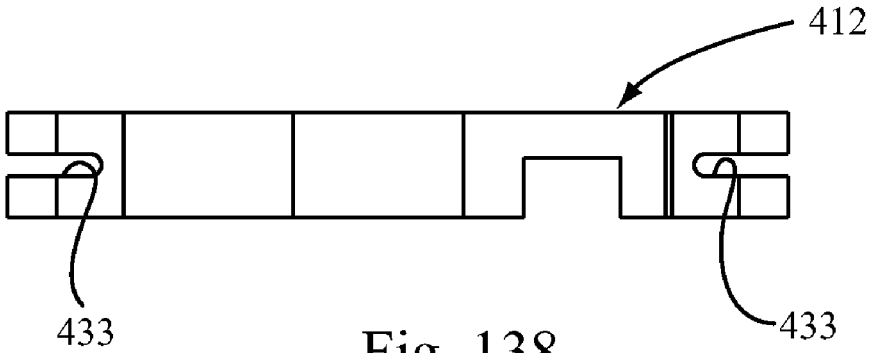
Figure 139:
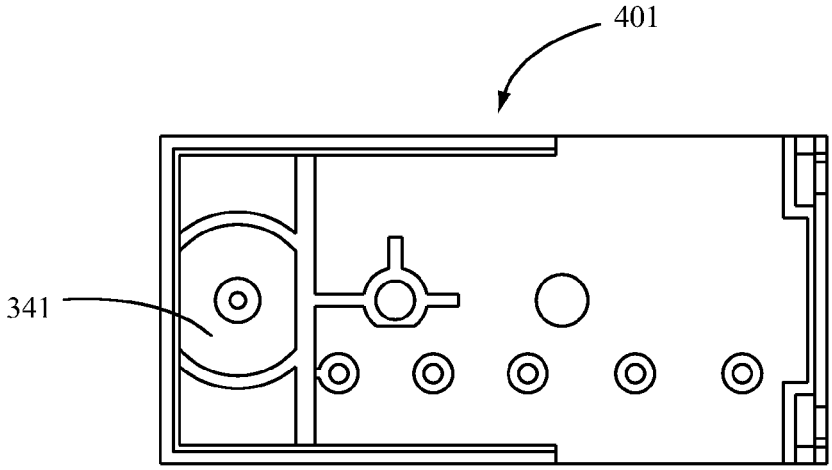
FIGS. 139-143 are views of the housing of the motor drive of an embodiment of the magnetic latch system of the present invention, shown in isolation.
Figure 140:
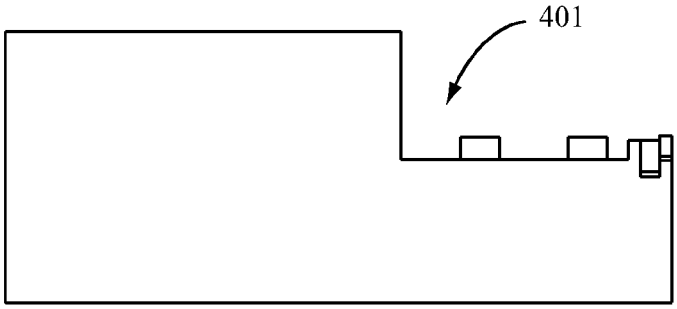
Figure 141:
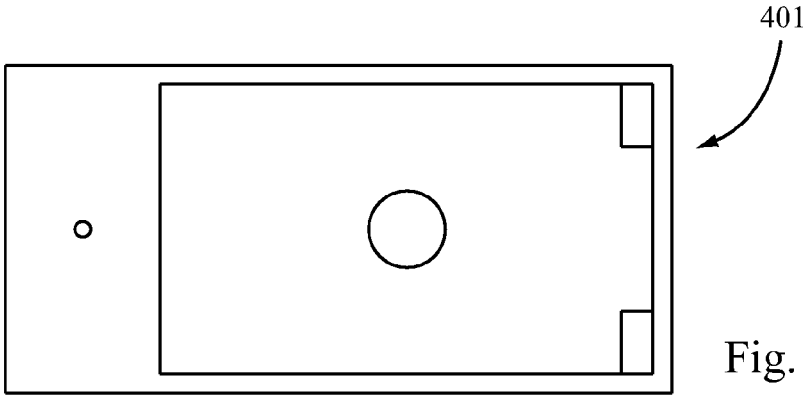
Figure 142:
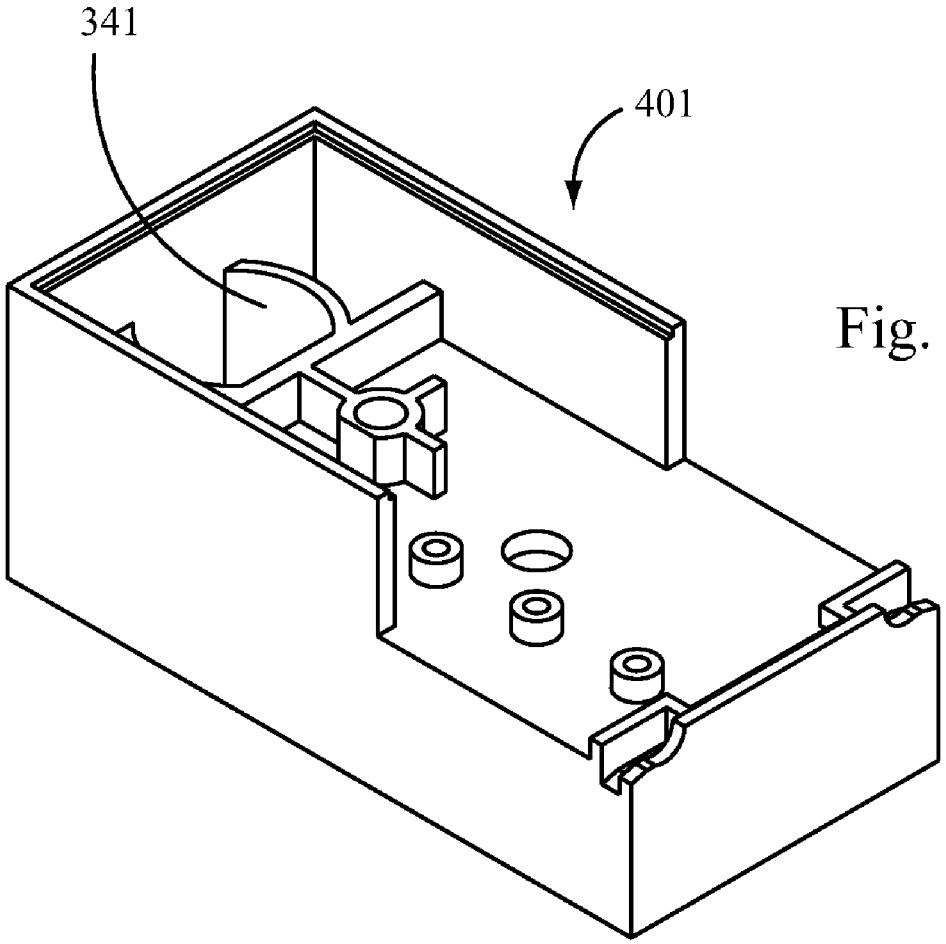
Figure 143:
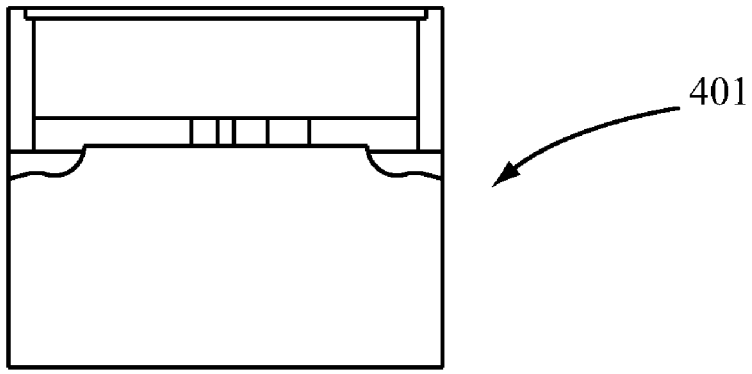
Figure 144:
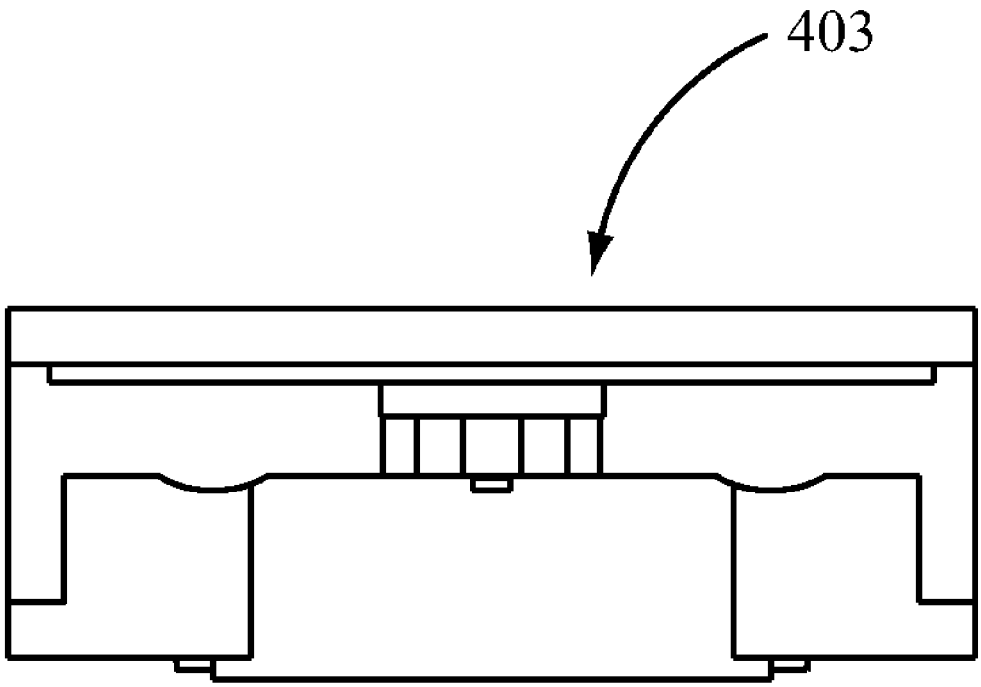
FIGS. 144-149 are views of the cover of the motor drive housing of an embodiment of the magnetic latch system of the present invention, shown in isolation.
Figure 145:
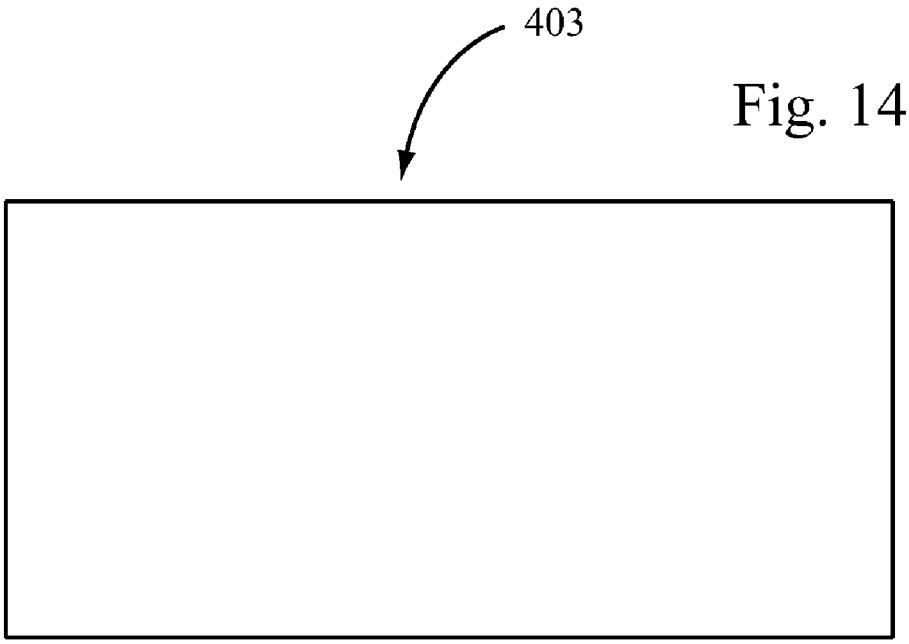
Figure 146:
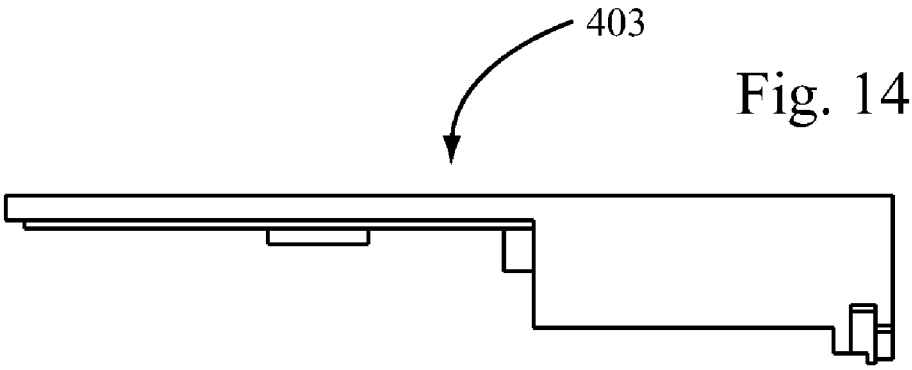
Figure 147:
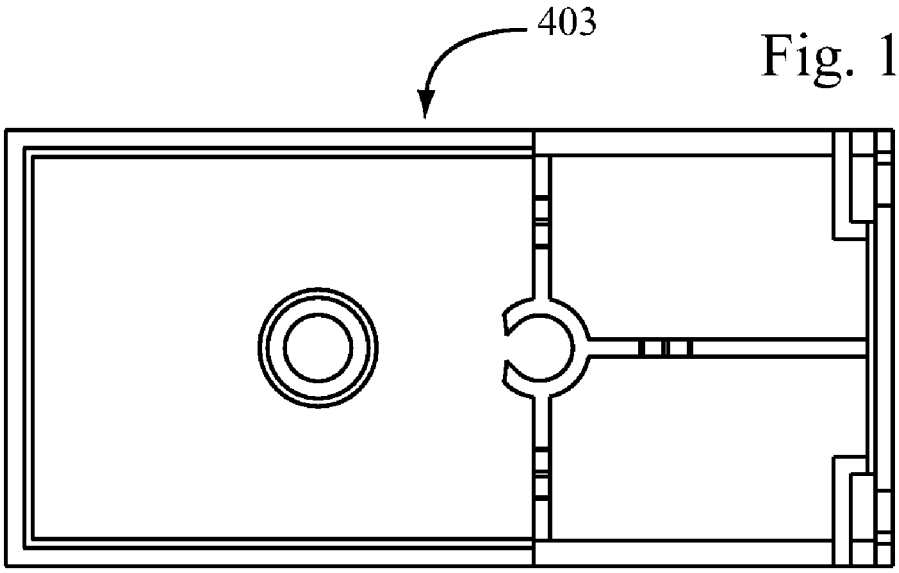
Figure 148:
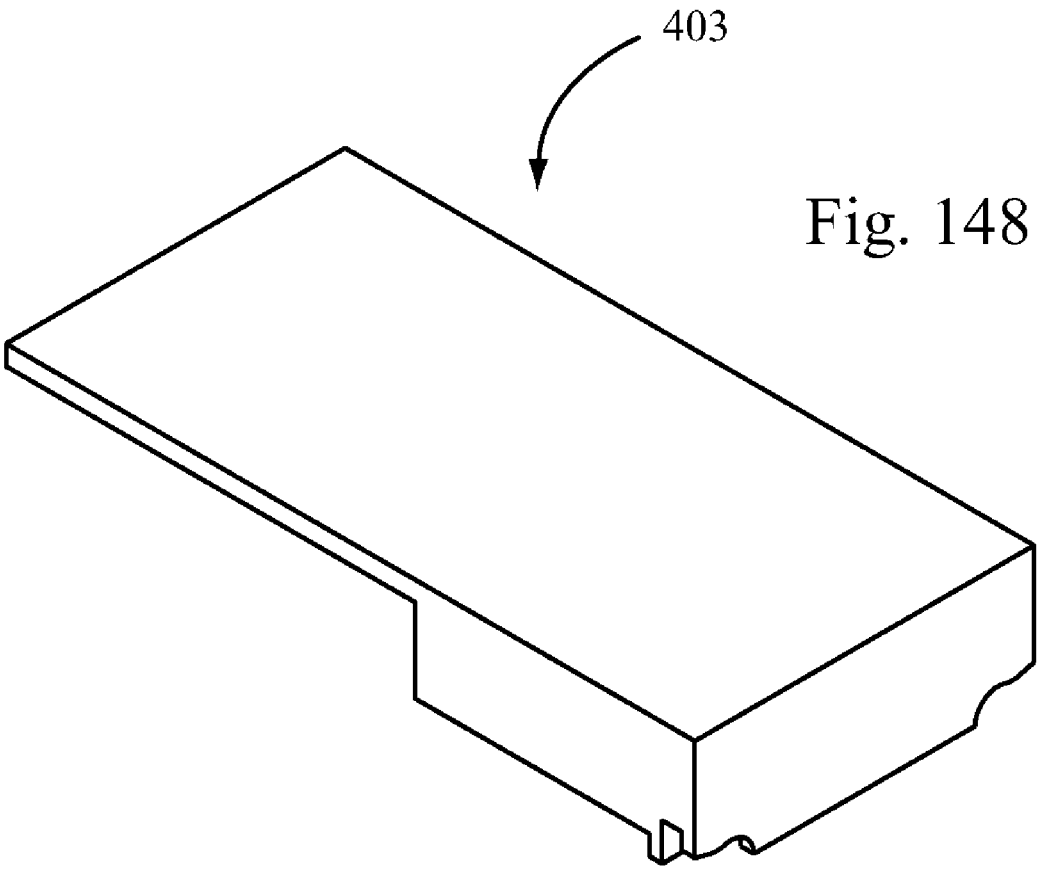
Figure 149:
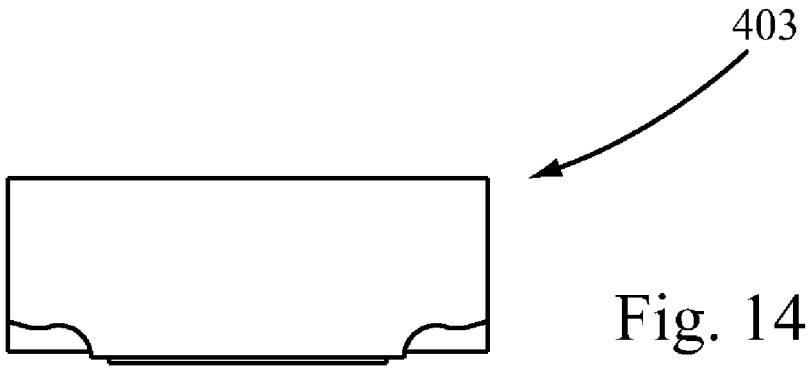

The motor drive housing 401 is of the clam-shell type having a removable or separate cover 403. When the latch mechanism 300 or **300*a* is operated manually, the Bowden cable 220 is pulled by pulling the cylindrical enlargement 402 toward the housing 401. This causes the actuation of the latch mechanisms 300 or 300*a* so as to release the doors 302, 304 from the closed position. When the latch mechanism 300 or 300*a* is operated manually by pulling the cylindrical enlargement 402 toward the housing 401, the portion of the Bowden cable 220 between the cylindrical enlargement 402 and the cylindrical enlargement 418 is folded over on itself as shown in FIGS. 31-32, because the cylindrical enlargement 418 is secured in the receptacle 414 and sliding rack 412 cannot be moved back to the retracted position due to the reactive torque that would be induced in the motor 325 and the mechanical disadvantage due to the gear train when the sliding rack 412 is to drive the pinion gear 331. As an alternative the opening 432 of the receptacles 414, 416 could be enlarged to allow the cylindrical enlargement 418 to move back into the housing 401 if the sides of the housing 401 were enclosed to prevent the end of the cable 220 from falling away from the receptacle 414 or 416, or the receptacles 414, 416 could be elongated to allow the cylindrical enlargement 418 to move back into the housing 401**.

It is to be understood that the present invention is not limited to the embodiments described above. Furthermore, it is to be understood that the embodiments of the present invention disclosed above are susceptible to various modifications, changes and adaptations by those skilled in the art, without departing from the spirit and scope of the invention.

The invention claimed is:

1. A latching system for securing a first member in a closed position relative to a second member, the first member being movable between the closed position and an open position relative to the second member, the latching system comprising:

a latch mechanism capable of being selectively placed in a latched configuration and an unlatched configuration;

a motor drive located remotely from said latch mechanism;

a Bowden cable connecting said motor drive to said latch mechanism, wherein said motor drive is capable of selectively operating said latch mechanism via said cable so as to place said latch mechanism in said unlatched configuration and thereby allow the first member to move from the closed position toward an open position relative to the second member, and wherein said motor drive comprises:

a motor drive housing;

a motor supported by said motor drive housing;

a motor drive bar supported for rectilinear motion by said motor drive housing, said cable being attached to said motor drive bar at an end of said cable distal from said latch mechanism;

transmission means for transmitting motive force from said motor to said motor drive bar, wherein energizing said motor causes said motor drive bar to move toward a retracted position and thereby pull said cable.

2. The latching system according to claim 1, wherein said latch mechanism comprises:

a magnetic insert capable of attachment to the first member;

a latch housing adapted for attachment to the second member;

at least one magnet rotationally supported by said latch housing, said at least one magnet being rotationally movable between latched and unlatched positions, said at least one magnet being positioned when in said latched position such that with the first member in the closed position relative to the second member said at least one magnet holds the first member with said magnetic insert attached thereto in the closed position through magnetic attraction between said at least one magnet and said magnetic insert, and said at least one magnet being positioned when in said unlatched position such that with the first member in the closed position relative to the second member said at least one magnet repels said magnetic insert that is attached to the first member so as to cause the first member to move from the closed position toward an open position relative to the second member; and an actuation mechanism capable of selectively moving said at least one magnet from said latched position to said unlatched position responsive to activation of said motor drive.

3. The latching system according to claim 2, wherein said latch mechanism further comprises:

a striker capable of attachment to the first member;

a hook-shaped pawl supported for rotation with said at least one magnet between latched and unlatched positions, said pawl engaging said striker to mechanically prevent the first member from being moved to the open position when said at least one magnet is in said latched position.

4. The latching system according to claim 3, wherein said latch mechanism further comprises gear teeth supported for rotation with said at least one magnet, and wherein said actuation mechanism comprises:

a rack bar supported for rectilinear movement by said latch housing, said rack bar having a plurality of gear teeth that are capable of engaging said gear teeth that rotate with said magnet such that said magnet and said hook-shaped pawl rotate together between said latched and unlatched positions as said rack bar moves rectilinearly between its latched and unlatched positions, respectively, relative to said latch housing.

5. The latching system according to claim 4, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said latch housing in order to prevent movement of said rack bar from said latched position to said unlatched position when said rack bar is in said latched position relative to said latch housing and said sliding bar is in said locked position relative to said rack bar, said ball bearing being capable of disengagement from said latch housing when said sliding bar is in said unlocked position relative to said rack bar, said rack bar moving from its latched position to its unlatched position relative to said latch housing in response to further rectilinear movement of said sliding bar relative to said latch housing.

6. The latching system according to claim 5, wherein said latch mechanism further comprises:

at least one control pin supported by said latch housing for rectilinear movement between extended and retracted positions, said control pin being spring biased toward said extended position, said control pin engaging said rack bar to prevent movement of said rack bar to said latched position when said control pin is in said extended position, said control pin being moved to said retracted position when the first member is moved to the closed position such that said hook-shaped pawl will not rotated to said latched position until the first member is in the closed position.

7. The latching system according to claim 6, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of said cable, said ribbon portion extending at least in part along said U-shaped track, said receptacle of said flexible link being engaged by said cable such that, when said cable is pulled, said sliding bar is moved to said unlocked position relative to said rack bar and said rack bar is moved toward said unlatched position as pulling of said cable is continued.

8. The latching system according to claim 1, wherein said latch mechanism comprises:

a magnetic insert capable of attachment to the first member;

a latch housing adapted for attachment to the second member;

at least one magnet rotationally supported by said latch housing, said at least one magnet being rotationally movable between latched and unlatched positions;

a striker capable of attachment to the first member;

a hook-shaped pawl supported for rotation with said at least one magnet between latched and unlatched positions, said pawl engaging said striker to mechanically prevent the first member from being moved to the open position when said at least one magnet is in said latched position; and an actuation mechanism capable of selectively moving said at least one magnet from said latched position to said unlatched position responsive to activation of said motor drive, wherein when the first member moves to the closed position relative to the second member, magnetic attraction between said at least one magnet and said magnetic insert moves said at least one magnet and said hook-shaped pawl to said latched position.

9. The latching system according to claim 8, wherein said latch mechanism further comprises gear teeth supported for rotation with said at least one magnet, and wherein said actuation mechanism comprises:

a rack bar supported for rectilinear movement by said latch housing, said rack bar having a plurality of gear teeth that are capable of engaging said gear teeth that rotate with said magnet such that said magnet and said hook-shaped pawl rotate together between said latched and unlatched positions as said rack bar moves rectilinearly between its latched and unlatched positions, respectively, relative to said latch housing.

10. The latching system according to claim 9, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said latch housing in order to prevent movement of said rack bar from said latched position to said unlatched position when said rack bar is in said latched position relative to said latch housing and said sliding bar is in said locked position relative to said rack bar, said ball bearing being capable of disengagement from said latch housing when said sliding bar is in said unlocked position relative to said rack bar, said rack bar moving from its latched position to its unlatched position relative to said latch housing in response to further rectilinear movement of said sliding bar relative to said latch housing.

11. The latching system according to claim 10, wherein said latch mechanism further comprises:

at least one control pin supported by said latch housing for rectilinear movement between extended and retracted positions, said control pin being spring biased toward said extended position, said control pin engaging said rack bar to prevent movement of said rack bar to said latched position when said control pin is in said extended position, said control pin being moved to said retracted position when the first member is moved to the closed position such that said hook-shaped pawl will not rotated to said latched position until the first member is in the closed position.

12. The latching system according to claim 11, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of said cable, said ribbon portion extending at least in part along said U-shaped track, said receptacle of said flexible link being engaged by said cable such that, when said cable is pulled, said sliding bar is moved to said unlocked position relative to said rack bar and said rack bar is moved toward said unlatched position as pulling of said cable is continued.

13. The latching system according to claim 1, wherein said motor drive bar has a length and wherein said transmission means comprises:

a set of gear teeth distributed along at least a portion of said length of said motor drive bar; and a torque reduction gear train provided in said motor drive housing, said torque reduction gear train engaging said set of gear teeth of said motor drive bar to transmit motive force from said motor to said motor drive bar.

14. The latching system according to claim 4, wherein said latch mechanism further comprises:

at least one control pin supported by said latch housing for rectilinear movement between extended and retracted positions, said control pin being spring biased toward said extended position, said control pin engaging said rack bar to prevent movement of said rack bar to said latched position when said control pin is in said extended position, said control pin being moved to said retracted position when the first member is moved to the closed position such that said hook-shaped pawl will not rotated to said latched position until the first member is in the closed position.

15. A latching system for securing a first door and a second door in closed positions relative to a third member, the first and second doors each being movable between the respective closed position and a respective open position relative to the third member, the latching system comprising:

a first latch mechanism capable of being selectively placed in a latched configuration and an unlatched configuration;

a second latch mechanism capable of being selectively placed in a latched configuration and an unlatched configuration;

a motor drive located remotely from said first and second latch mechanisms;

a first Bowden cable connecting said motor drive to said first latch mechanism; and a second Bowden cable connecting said motor drive to said second latch mechanism, wherein said motor drive is capable of selectively operating said first and second latch mechanisms via said first and second cables, respectively, so as to simultaneously place said first and second latch mechanisms in their unlatched configurations and thereby allow the first and second doors to move from their closed positions toward their open positions relative to the third member, and wherein said motor drive comprises:

a motor drive housing;

a motor supported by said motor drive housing;

a motor drive bar supported for rectilinear motion by said motor drive housing, each of said first and second cables being attached to said motor drive bar at an end of each of said first and second cables that is distal from a respective one of said first and second latch mechanisms;

transmission means for transmitting motive force from said motor to said motor drive bar, wherein energizing said motor causes said motor drive bar to move toward a retracted position and thereby pull both said first and second cables.

16. The latching system according to claim 15, wherein each of said first and second latch mechanisms is a latch mechanism comprising:

a first magnetic insert capable of attachment to the first door;

a second magnetic insert capable of attachment to the second door;

a housing adapted for attachment to the third member;

a first magnet rotationally supported by said housing, said first magnet being rotationally movable between latched and unlatched positions, said first magnet being positioned when in said latched position such that with the first door in the closed position relative to the third member said first magnet holds the first door with said first magnetic insert attached thereto in the closed position through magnetic attraction between said first magnet and said first magnetic insert, and when said first magnet is in said unlatched position with the first door being in the closed position relative to the third member said first magnet is positioned such that said first magnet repels said first magnetic insert that is attached to the first door so as to cause the first door to move from the closed position toward the open position relative to the third member;

a second magnet rotationally supported by said housing, said second magnet being rotationally movable between latched and unlatched positions, said second magnet being positioned when in said latched position such that with the second door in the closed position relative to the third member said second magnet holds the second door with said second magnetic insert attached thereto in the closed position through magnetic attraction between said second magnet and said second magnetic insert, and when said second magnet is in said unlatched position with the second door being in the closed position relative to the third member said second magnet is positioned such that said second magnet repels said second magnetic insert that is attached to the second door so as to cause the second door to move from the closed position toward the open position relative to the third member; and an actuation mechanism capable of selectively moving said first magnet and said second magnet from their latched positions to their unlatched positions responsive to activation of said motor drive.

17. The latching system according to claim 16, wherein said latch mechanism further comprises:

a first striker capable of attachment to the first door;

a first hook-shaped pawl supported for rotation with said first magnet between latched and unlatched positions, said first pawl engaging said first striker to mechanically prevent the first door from being moved to the open position when said first magnet is in its latched position;

a second striker capable of attachment to the second door; and a second hook-shaped pawl supported for rotation with said second magnet between latched and unlatched positions, said second pawl engaging said second striker to mechanically prevent the second door from being moved to the open position when said second magnet is in its latched position.

18. The latching system according to claim 17, wherein said latch mechanism further comprises a first set of gear teeth supported for rotation with said first magnet, a second set of gear teeth supported for rotation with said second magnet, and wherein said actuation mechanism comprises:

a rack bar supported for rectilinear movement by said housing, said rack bar having a first plurality of gear teeth that are capable of engaging said first set gear teeth that rotate with said first magnet such that said first magnet and said first hook-shaped pawl rotate together between their latched and unlatched positions as said rack bar moves rectilinearly between its latched and unlatched positions, respectively, relative to said housing, said rack bar having a second plurality of gear teeth that are capable of engaging said second set gear teeth that rotate with said second magnet such that said second magnet and said second hook-shaped pawl rotate together between their latched and unlatched positions as said rack bar moves rectilinearly between its latched and unlatched positions, respectively, relative to said housing.

19. The latching system according to claim 18, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said housing in order to prevent movement of said rack bar from said latched position to said unlatched position when said rack bar is in said latched position relative to said housing and said sliding bar is in said locked position relative to said rack bar, said ball bearing being capable of disengagement from said housing when said sliding bar is in said unlocked position relative to said rack bar, said rack bar moving from its latched position to its unlatched position relative to said housing in response to further rectilinear movement of said sliding bar relative to said housing.

20. The latching system according to claim 19, wherein said latch mechanism further comprises:

first and second control pins each being supported by said latch housing for rectilinear movement between extended and retracted positions, each of said first and second control pins being spring biased toward said respective extended position thereof, each of said first and second control pins engaging said rack bar to prevent movement of said rack bar to said latched position when each of said first and second control pins is in said respective extended position thereof, said first control pin being moved to its respective retracted position when the first door is moved to the closed position, said second control pin being moved to its respective retracted position when the second door is moved to the closed position, such that said first and second hook-shaped pawls will not rotated to their latched positions until both the first door and the second door are in their closed positions.

21. The latching system according to claim 20, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of a respective one of said first and second cables, said ribbon portion extending at least in part along said U-shaped track, said receptacle of said flexible link being engaged by said respective one of said first and second cables such that, when said respective one of said first and second cables is pulled, said sliding bar is moved to said unlocked position relative to said rack bar and said rack bar is moved toward said unlatched position as pulling of said respective one of said first and second cables is continued.

22. The latching system according to claim 15, wherein each of said first and second latch mechanisms is a latch mechanism comprising:

a first magnetic insert capable of attachment to the first door;

a second magnetic insert capable of attachment to the second door;

a housing adapted for attachment to the third member;

a first magnet rotationally supported by said housing, said first magnet being rotationally movable between latched and unlatched positions;

a second magnet rotationally supported by said housing, said second magnet being rotationally movable between latched and unlatched positions;

a first striker capable of attachment to the first door;

a first hook-shaped pawl supported for rotation with said first magnet between latched and unlatched positions, said first pawl engaging said first striker to mechanically prevent the first door from being moved to the open position when said first magnet is in its latched position;

a second striker capable of attachment to the second door; and a second hook-shaped pawl supported for rotation with said second magnet between latched and unlatched positions, said second pawl engaging said second striker to mechanically prevent the second door from being moved to the open position when said second magnet is in its latched position; and an actuation mechanism capable of selectively moving said first magnet and said second magnet from their latched positions to their unlatched positions responsive to activation of said motor drive, wherein when the first and second doors move to their closed positions relative to the third member, magnetic attraction between said first and second magnets and said first and second magnetic inserts moves said first and second magnets and said first and second hook-shaped pawls to their latched positions.

23. The latching system according to claim 22, wherein said latch mechanism further comprises a first set of gear teeth supported for rotation with said first magnet, a second set of gear teeth supported for rotation with said second magnet, and wherein said actuation mechanism comprises:

a rack bar supported for rectilinear movement by said housing, said rack bar having a first plurality of gear teeth that are capable of engaging said first set gear teeth that rotate with said first magnet such that said first magnet and said first hook-shaped pawl rotate together between their latched and unlatched positions as said rack bar moves rectilinearly between its latched and unlatched positions, respectively, relative to said housing, said rack bar having a second plurality of gear teeth that are capable of engaging said second set gear teeth that rotate with said second magnet such that said second magnet and said second hook-shaped pawl rotate together between their latched and unlatched positions as said rack bar moves rectilinearly between its latched and unlatched positions, respectively, relative to said housing.

24. The latching system according to claim 23, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said housing in order to prevent movement of said rack bar from said latched position to said unlatched position when said rack bar is in said latched position relative to said housing and said sliding bar is in said locked position relative to said rack bar, said ball bearing being capable of disengagement from said housing when said sliding bar is in said unlocked position relative to said rack bar, said rack bar moving from its latched position to its unlatched position relative to said housing in response to further rectilinear movement of said sliding bar relative to said housing.

25. The latching system according to claim 24, wherein said latch mechanism further comprises:

first and second control pins each being supported by said latch housing for rectilinear movement between extended and retracted positions, each of said first and second control pins being spring biased toward said respective extended position thereof, each of said first and second control pins engaging said rack bar to prevent movement of said rack bar to said latched position when each of said first and second control pins is in said respective extended position thereof, said first control pin being moved to its respective retracted position when the first door is moved to the closed position, said second control pin being moved to its respective retracted position when the second door is moved to the closed position, such that said first and second hook-shaped pawls will not rotated to their latched positions until both the first door and the second door are in their closed positions.

26. The latching system according to claim 25, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of a respective one of said first and second cables, said ribbon portion extending at least in part along said U-shaped track, said receptacle of said flexible link being engaged by said respective one of said first and second cables such that, when said respective one of said first and second cables is pulled, said sliding bar is moved to said unlocked position relative to said rack bar and said rack bar is moved toward said unlatched position as pulling of said respective one of said first and second cables is continued.

27. The latching system according to claim 15, wherein said motor drive bar has a length and wherein said transmission means comprises:

a set of gear teeth distributed along at least a portion of said length of said motor drive bar; and a torque reduction gear train provided in said motor drive housing, said torque reduction gear train engaging said set of gear teeth of said motor drive bar to transmit motive force from said motor to said motor drive bar.

28. The latching system according to claim 27, wherein said motor drive bar has a first receptacle for the attachment of said first Bowden cable and a second receptacle for attachment of said second Bowden cable such that movement of said motor drive bar toward said retracted position pulls both said first and second cables to simultaneously place said first and second latch mechanisms in their unlatched configurations.

29. The latching system according to claim 18, wherein said latch mechanism further comprises:

first and second control pins each being supported by said latch housing for rectilinear movement between extended and retracted positions, each of said first and second control pins being spring biased toward said respective extended position thereof, each of said first and second control pins engaging said rack bar to prevent movement of said rack bar to said latched position when each of said first and second control pins is in said respective extended position thereof, said first control pin being moved to its respective retracted position when the first door is moved to the closed position, said second control pin being moved to its respective retracted position when the second door is moved to the closed position, such that said first and second hook-shaped pawls will not rotated to their latched positions until both the first door and the second door are in their closed positions.

30. A latching system for securing a first member in a closed position relative to a second member, the first member being movable between the closed position and an open position relative to the second member, the latching system comprising:

a latch mechanism capable of being selectively placed in a latched configuration and an unlatched configuration;

a motor drive located remotely from said latch mechanism;

a Bowden cable connecting said motor drive to said latch mechanism, wherein said motor drive is capable of selectively operating said latch mechanism via said cable so as to place said latch mechanism in said unlatched configuration and thereby allow the first member to move from the closed position toward an open position relative to the second member, and wherein said motor drive comprises:

a motor drive housing;

a motor supported by said motor drive housing;

a sliding rack supported for rectilinear motion by said motor drive housing, said cable being attached to said sliding rack at an end of said cable distal from said latch mechanism;

transmission means for transmitting motive force from said motor to said sliding rack, wherein energizing said motor causes said sliding rack to move toward a retracted position and thereby pull said cable.

31. The latching system according to claim 30, wherein said latch mechanism comprises:

a magnetic insert capable of attachment to the first member;

a latch housing adapted for attachment to the second member;

at least one magnet rotationally supported by said latch housing, said at least one magnet being rotationally movable between latched and unlatched positions, said at least one magnet being positioned when in said latched position such that with the first member in the closed position relative to the second member said at least one magnet holds the first member with said magnetic insert attached thereto in the closed position through magnetic attraction between said at least one magnet and said magnetic insert, and said at least one magnet being positioned when in said unlatched position such that with the first member in the closed position relative to the second member said at least one magnet repels said magnetic insert that is attached to the first member so as to cause the first member to move from the closed position toward an open position relative to the second member; and an actuation mechanism capable of selectively moving said at least one magnet from said latched position to said unlatched position responsive to activation of said motor drive.

32. The latching system according to claim 31, wherein said latch mechanism further comprises:

a striker capable of attachment to the first member;

a hook-shaped pawl supported for rotation with said at least one magnet between latched and unlatched positions, said pawl engaging said striker to mechanically prevent the first member from being moved to the open position when said at least one magnet is in said latched position.

33. The latching system according to claim 32, wherein said latch mechanism further comprises gear teeth supported for rotation with said at least one magnet, and wherein said actuation mechanism comprises:

a rack bar supported for rectilinear movement by said latch housing, said rack bar having a plurality of gear teeth that are capable of engaging said gear teeth that rotate with said magnet such that said magnet and said hook-shaped pawl rotate together between said latched and unlatched positions as said rack bar moves rectilinearly between its latched and unlatched positions, respectively, relative to said latch housing.

34. The latching system according to claim 33, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said latch housing in order to prevent movement of said rack bar from said latched position to said unlatched position when said rack bar is in said latched position relative to said latch housing and said sliding bar is in said locked position relative to said rack bar, said ball bearing being capable of disengagement from said latch housing when said sliding bar is in said unlocked position relative to said rack bar, said rack bar moving from its latched position to its unlatched position relative to said latch housing in response to further rectilinear movement of said sliding bar relative to said latch housing.

35. The latching system according to claim 34, wherein said latch mechanism further comprises:

at least one control pin supported by said latch housing for rectilinear movement between extended and retracted positions, said control pin being spring biased toward said extended position, said control pin engaging said rack bar to prevent movement of said rack bar to said latched position when said control pin is in said extended position, said control pin being moved to said retracted position when the first member is moved to the closed position such that said hook-shaped pawl will not rotated to said latched position until the first member is in the closed position.

36. The latching system according to claim 35, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of said cable, said ribbon portion extending at least in part along said U-shaped track, said receptacle of said flexible link being engaged by said cable such that, when said cable is pulled, said sliding bar is moved to said unlocked position relative to said rack bar and said rack bar is moved toward said unlatched position as pulling of said cable is continued.

37. The latching system according to claim 30, wherein said latch mechanism comprises:

a magnetic insert capable of attachment to the first member;

a latch housing adapted for attachment to the second member;

at least one magnet rotationally supported by said latch housing, said at least one magnet being rotationally movable between latched and unlatched positions;

a striker capable of attachment to the first member;

a hook-shaped pawl supported for rotation with said at least one magnet between latched and unlatched positions, said pawl engaging said striker to mechanically prevent the first member from being moved to the open position when said at least one magnet is in said latched position; and an actuation mechanism capable of selectively moving said at least one magnet from said latched position to said unlatched position responsive to activation of said motor drive, wherein when the first member moves to the closed position relative to the second member, magnetic attraction between said at least one magnet and said magnetic insert moves said at least one magnet and said hook-shaped pawl to said latched position.

38. The latching system according to claim 37, wherein said latch mechanism further comprises gear teeth supported for rotation with said at least one magnet, and wherein said actuation mechanism comprises:

a rack bar supported for rectilinear movement by said latch housing, said rack bar having a plurality of gear teeth that are capable of engaging said gear teeth that rotate with said magnet such that said magnet and said hook-shaped pawl rotate together between said latched and unlatched positions as said rack bar moves rectilinearly between its latched and unlatched positions, respectively, relative to said latch housing.

39. The latching system according to claim 38, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said latch housing in order to prevent movement of said rack bar from said latched position to said unlatched position when said rack bar is in said latched position relative to said latch housing and said sliding bar is in said locked position relative to said rack bar, said ball bearing being capable of disengagement from said latch housing when said sliding bar is in said unlocked position relative to said rack bar, said rack bar moving from its latched position to its unlatched position relative to said latch housing in response to further rectilinear movement of said sliding bar relative to said latch housing.

40. The latching system according to claim 39, wherein said latch mechanism further comprises:

at least one control pin supported by said latch housing for rectilinear movement between extended and retracted positions, said control pin being spring biased toward said extended position, said control pin engaging said rack bar to prevent movement of said rack bar to said latched position when said control pin is in said extended position, said control pin being moved to said retracted position when the first member is moved to the closed position such that said hook-shaped pawl will not rotated to said latched position until the first member is in the closed position.

41. The latching system according to claim 40, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of said cable, said ribbon portion extending at least in part along said U-shaped track, said receptacle of said flexible link being engaged by said cable such that, when said cable is pulled, said sliding bar is moved to said unlocked position relative to said rack bar and said rack bar is moved toward said unlatched position as pulling of said cable is continued.

42. The latching system according to claim 30, wherein said sliding rack has a length and wherein said transmission means comprises:

a set of gear teeth distributed along at least a portion of said length of said sliding rack;

and a torque reduction gear train provided in said motor drive housing, said torque reduction gear train engaging said set of gear teeth of said sliding rack to transmit motive force from said motor to said sliding rack.

43. The latching system according to claim 33, wherein said latch mechanism further comprises:

at least one control pin supported by said latch housing for rectilinear movement between extended and retracted positions, said control pin being spring biased toward said extended position, said control pin engaging said rack bar to prevent movement of said rack bar to said latched position when said control pin is in said extended position, said control pin being moved to said retracted position when the first member is moved to the closed position such that said hook-shaped pawl will not rotated to said latched position until the first member is in the closed position.

44. A latching system for securing a first door and a second door in closed positions relative to a third member, the first and second doors each being movable between the respective closed position and a respective open position relative to the third member, the latching system comprising:

a first latch mechanism capable of being selectively placed in a latched configuration and an unlatched configuration;

a second latch mechanism capable of being selectively placed in a latched configuration and an unlatched configuration;

a motor drive located remotely from said first and second latch mechanisms;

a first Bowden cable connecting said motor drive to said first latch mechanism; and a second Bowden cable connecting said motor drive to said second latch mechanism, wherein said motor drive is capable of selectively operating said first and second latch mechanisms via said first and second cables, respectively, so as to simultaneously place said first and second latch mechanisms in their unlatched configurations and thereby allow the first and second doors to move from their closed positions toward their open positions relative to the third member, and wherein said motor drive comprises:

a motor drive housing;

a motor supported by said motor drive housing;

a sliding rack supported for rectilinear motion by said motor drive housing, each of said first and second cables being attached to said sliding rack at an end of each of said first and second cables that is distal from a respective one of said first and second latch mechanisms;

transmission means for transmitting motive force from said motor to said sliding rack, wherein energizing said motor causes said sliding rack to move toward a retracted position and thereby pull both said first and second cables.

45. The latching system according to claim 44, wherein each of said first and second latch mechanisms is a latch mechanism comprising:

a first magnetic insert capable of attachment to the first door;

a second magnetic insert capable of attachment to the second door;

a housing adapted for attachment to the third member;

a first magnet rotationally supported by said housing, said first magnet being rotationally movable between latched and unlatched positions, said first magnet being positioned when in said latched position such that with the first door in the closed position relative to the third member said first magnet holds the first door with said first magnetic insert attached thereto in the closed position through magnetic attraction between said first magnet and said first magnetic insert, and when said first magnet is in said unlatched position with the first door being in the closed position relative to the third member said first magnet is positioned such that said first magnet repels said first magnetic insert that is attached to the first door so as to cause the first door to move from the closed position toward the open position relative to the third member;

a second magnet rotationally supported by said housing, said second magnet being rotationally movable between latched and unlatched positions, said second magnet being positioned when in said latched position such that with the second door in the closed position relative to the third member said second magnet holds the second door with said second magnetic insert attached thereto in the closed position through magnetic attraction between said second magnet and said second magnetic insert, and when said second magnet is in said unlatched position with the second door being in the closed position relative to the third member said second magnet is positioned such that said second magnet repels said second magnetic insert that is attached to the second door so as to cause the second door to move from the closed position toward the open position relative to the third member; and an actuation mechanism capable of selectively moving said first magnet and said second magnet from their latched positions to their unlatched positions responsive to activation of said motor drive.

46. The latching system according to claim 45, wherein said latch mechanism further comprises:

a first striker capable of attachment to the first door;

a first hook-shaped pawl supported for rotation with said first magnet between latched and unlatched positions, said first pawl engaging said first striker to mechanically prevent the first door from being moved to the open position when said first magnet is in its latched position;

a second striker capable of attachment to the second door; and a second hook-shaped pawl supported for rotation with said second magnet between latched and unlatched positions, said second pawl engaging said second striker to mechanically prevent the second door from being moved to the open position when said second magnet is in its latched position.

47. The latching system according to claim 46, wherein said latch mechanism further comprises a first set of gear teeth supported for rotation with said first magnet, a second set of gear teeth supported for rotation with said second magnet, and wherein said actuation mechanism comprises:

a rack bar supported for rectilinear movement by said housing, said rack bar having a first plurality of gear teeth that are capable of engaging said first set gear teeth that rotate with said first magnet such that said first magnet and said first hook-shaped pawl rotate together between their latched and unlatched positions as said rack bar moves rectilinearly between its latched and unlatched positions, respectively, relative to said housing, said rack bar having a second plurality of gear teeth that are capable of engaging said second set gear teeth that rotate with said second magnet such that said second magnet and said second hook-shaped pawl rotate together between their latched and unlatched positions as said rack bar moves rectilinearly between its latched and unlatched positions, respectively, relative to said housing.

48. The latching system according to claim 47, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said housing in order to prevent movement of said rack bar from said latched position to said unlatched position when said rack bar is in said latched position relative to said housing and said sliding bar is in said locked position relative to said rack bar, said ball bearing being capable of disengagement from said housing when said sliding bar is in said unlocked position relative to said rack bar, said rack bar moving from its latched position to its unlatched position relative to said housing in response to further rectilinear movement of said sliding bar relative to said housing.

49. The latching system according to claim 48, wherein said latch mechanism further comprises:

first and second control pins each being supported by said latch housing for rectilinear movement between extended and retracted positions, each of said first and second control pins being spring biased toward said respective extended position thereof, each of said first and second control pins engaging said rack bar to prevent movement of said rack bar to said latched position when each of said first and second control pins is in said respective extended position thereof, said first control pin being moved to its respective retracted position when the first door is moved to the closed position, said second control pin being moved to its respective retracted position when the second door is moved to the closed position, such that said first and second hook-shaped pawls will not rotated to their latched positions until both the first door and the second door are in their closed positions.

50. The latching system according to claim 49, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of a respective one of said first and second cables, said ribbon portion extending at least in part along said U-shaped track, said receptacle of said flexible link being engaged by said respective one of said first and second cables such that, when said respective one of said first and second cables is pulled, said sliding bar is moved to said unlocked position relative to said rack bar and said rack bar is moved toward said unlatched position as pulling of said respective one of said first and second cables is continued.

51. The latching system according to claim 44, wherein each of said first and second latch mechanisms is a latch mechanism comprising:

a first magnetic insert capable of attachment to the first door;

a second magnetic insert capable of attachment to the second door;

a housing adapted for attachment to the third member;

a first magnet rotationally supported by said housing, said first magnet being rotationally movable between latched and unlatched positions;

a second magnet rotationally supported by said housing, said second magnet being rotationally movable between latched and unlatched positions;

a first striker capable of attachment to the first door;

a first hook-shaped pawl supported for rotation with said first magnet between latched and unlatched positions, said first pawl engaging said first striker to mechanically prevent the first door from being moved to the open position when said first magnet is in its latched position;

a second striker capable of attachment to the second door; and a second hook-shaped pawl supported for rotation with said second magnet between latched and unlatched positions, said second pawl engaging said second striker to mechanically prevent the second door from being moved to the open position when said second magnet is in its latched position; and an actuation mechanism capable of selectively moving said first magnet and said second magnet from their latched positions to their unlatched positions responsive to activation of said motor drive, wherein when the first and second doors move to their closed positions relative to the third member, magnetic attraction between said first and second magnets and said first and second magnetic inserts moves said first and second magnets and said first and second hookshaped pawls to their latched positions.

52. The latching system according to claim 51, wherein said latch mechanism further comprises a first set of gear teeth supported for rotation with said first magnet, a second set of gear teeth supported for rotation with said second magnet, and wherein said actuation mechanism comprises:

a rack bar supported for rectilinear movement by said housing, said rack bar having a first plurality of gear teeth that are capable of engaging said first set gear teeth that rotate with said first magnet such that said first magnet and said first hook-shaped pawl rotate together between their latched and unlatched positions as said rack bar moves rectilinearly between its latched and unlatched positions, respectively, relative to said housing, said rack bar having a second plurality of gear teeth that are capable of engaging said second set gear teeth that rotate with said second magnet such that said second magnet and said second hook-shaped pawl rotate together between their latched and unlatched positions as said rack bar moves rectilinearly between its latched and unlatched positions, respectively, relative to said housing.

53. The latching system according to claim 52, wherein said latch mechanism further comprises a ball bearing carried by said rack bar, and wherein said actuation mechanism further comprises:

a sliding bar supported for rectilinear movement relative to said rack bar between a locked and an unlocked position relative to said rack bar, said ball bearing being capable of movement relative to said rack bar in response to movement of said sliding bar relative to said rack bar, said ball bearing moving into engagement with said housing in order to prevent movement of said rack bar from said latched position to said unlatched position when said rack bar is in said latched position relative to said housing and said sliding bar is in said locked position relative to said rack bar, said ball bearing being capable of disengagement from said housing when said sliding bar is in said unlocked position relative to said rack bar, said rack bar moving from its latched position to its unlatched position relative to said housing in response to further rectilinear movement of said sliding bar relative to said housing.

54. The latching system according to claim 53, wherein said latch mechanism further comprises:

first and second control pins each being supported by said latch housing for rectilinear movement between extended and retracted positions, each of said first and second control pins being spring biased toward said respective extended position thereof, each of said first and second control pins engaging said rack bar to prevent movement of said rack bar to said latched position when each of said first and second control pins is in said respective extended position thereof, said first control pin being moved to its respective retracted position when the first door is moved to the closed position, said second control pin being moved to its respective retracted position when the second door is moved to the closed position, such that said first and second hookshaped pawls will not rotated to their latched positions until both the first door and the second door are in their closed positions.

55. The latching system according to claim 54, wherein said latch housing has a U-shaped track, wherein said latch mechanism further comprises:

a flexible link movably supported by said latch housing, said sliding bar being capable of engagement by said flexible link, said flexible link including a flexible ribbon portion and a receptacle for attachment of a respective one of said first and second cables, said ribbon portion extending at least in part along said U-shaped track, said receptacle of said flexible link being engaged by said respective one of said first and second cables such that, when said respective one of said first and second cables is pulled, said sliding bar is moved to said unlocked position relative to said rack bar and said rack bar is moved toward said unlatched position as pulling of said respective one of said first and second cables is continued.

56. The latching system according to claim 44, wherein said sliding rack has a length and wherein said transmission means comprises:

a set of gear teeth distributed along at least a portion of said length of said sliding rack;

and a torque reduction gear train provided in said motor drive housing, said torque reduction gear train engaging said set of gear teeth of said sliding rack to transmit motive force from said motor to said sliding rack.

57. The latching system according to claim 56, wherein said sliding rack has a first receptacle for the attachment of said first Bowden cable and a second receptacle for attachment of said second Bowden cable such that movement of said sliding rack toward said retracted position pulls both said first and second cables to simultaneously place said first and second latch mechanisms in their unlatched configurations.

58. The latching system according to claim 47, wherein said latch mechanism further comprises:

first and second control pins each being supported by said latch housing for rectilinear movement between extended and retracted positions, each of said first and second control pins being spring biased toward said respective extended position thereof, each of said first and second control pins engaging said rack bar to prevent movement of said rack bar to said latched position when each of said first and second control pins is in said respective extended position thereof, said first control pin being moved to its respective retracted position when the first door is moved to the closed position, said second control pin being moved to its respective retracted position when the second door is moved to the closed position, such that said first and second hook-shaped pawls will not rotated to their latched positions until both the first door and the second door are in their closed positions.

* * * * *